US011816960B2

(12) United States Patent
Decasa, Jr. et al.

(10) Patent No.: US 11,816,960 B2
(45) Date of Patent: Nov. 14, 2023

(54) GAME OF CHANCE WITH MULTI-LEVEL FRENZY MODE AND SYSTEMS FOR PROVIDING THE SAME

(71) Applicant: Aristocrat Technologies, Inc., Las Vegas, NV (US)

(72) Inventors: Rogelio Decasa, Jr., Renton, WA (US); Hanna Sanborn, Georgetown, TX (US); Jeffrey Uss, Liberty Hill, TX (US); Jennifer Mizzi, Round Rock, TX (US); Erick Ching, Cedar Park, TX (US); Nathan Warms, Austin, TX (US); Zachary Smith, Austin, TX (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 0 days.

(21) Appl. No.: 17/449,633

(22) Filed: Sep. 30, 2021

(65) Prior Publication Data

US 2023/0098012 A1 Mar. 30, 2023

(51) Int. Cl.
*G07F 17/32* (2006.01)

(52) U.S. Cl.
CPC ..... *G07F 17/3267* (2013.01); *G07F 17/3213* (2013.01); *G07F 17/3244* (2013.01); *G07F 17/3269* (2013.01); *G07F 17/3295* (2013.01)

(58) Field of Classification Search
CPC ..... G07F 17/3267; G07F 17/3213; G07F 17/3244; G07F 17/3269; G07F 17/3295
See application file for complete search history.

(56) References Cited

U.S. PATENT DOCUMENTS

| | | | | |
|---|---|---|---|---|
| 5,833,537 | A | 11/1998 | Barrie | |
| 6,095,921 | A * | 8/2000 | Walker | G07F 17/32 273/138.2 |
| 6,146,273 | A | 11/2000 | Olsen | |
| 6,905,407 | B2 | 6/2005 | Nordman | |
| 7,753,778 | B2 | 7/2010 | Kato | |
| 8,342,945 | B2 | 1/2013 | Gomez | |

(Continued)

OTHER PUBLICATIONS

Office Action (Non-Final Rejection) dated Mar. 23, 2022 for U.S. Appl. No. 17/341,750 (pp. 1-15).

(Continued)

*Primary Examiner* — Robert T Clarke, Jr.
*Assistant Examiner* — Jeffrey K Wong
(74) *Attorney, Agent, or Firm* — Weaver Austin Villeneuve & Sampson LLP

(57) ABSTRACT

Nested frenzy modes for games of chance are disclosed. When a first frenzy mode is activated, opportunities are provided to obtain first frenzy item symbols as part of game outcomes. Each first frenzy item symbol that is obtained in an outcome may cause a number of obtained frenzy items of a featured set of frenzy items to be incremented by a first value. When all frenzy items in the featured set of frenzy items are obtained, a featured set prize is awarded and a new set of frenzy items presented. Additionally, there are opportunities within the first frenzy mode to trigger a second frenzy mode in which second frenzy item symbols are potentially obtainable. Should a second frenzy item symbol be obtained, then the number of obtained frenzy items of the featured set of frenzy items may be incremented by a second value that is greater than the first value.

20 Claims, 31 Drawing Sheets

(56) References Cited

U.S. PATENT DOCUMENTS

| | | | | |
|---|---|---|---|---|
| 9,972,171 | B2 | 5/2018 | Marston | |
| 10,102,711 | B2 | 10/2018 | Zoltewicz | |
| 10,607,439 | B2 | 3/2020 | Caputo | |
| 10,769,882 | B2 | 9/2020 | Uss | |
| 10,796,528 | B2 | 10/2020 | Bridges | |
| 11,551,527 | B2 | 1/2023 | Cohn | |
| 2004/0077395 | A1 | 4/2004 | Tuhy | |
| 2004/0102238 | A1 | 5/2004 | Taylor | |
| 2004/0127282 | A1 | 7/2004 | Naobayashi | |
| 2004/0229700 | A1 | 11/2004 | Cannon | |
| 2006/0025203 | A1* | 2/2006 | Thomas | G07F 17/32 463/20 |
| 2008/0153577 | A1 | 6/2008 | Seelig | |
| 2008/0311973 | A1 | 12/2008 | Jaffe | |
| 2011/0111826 | A1 | 5/2011 | Baerlocher | |
| 2012/0108324 | A1 | 5/2012 | King | |
| 2014/0287812 | A1 | 9/2014 | Friedman | |
| 2018/0204422 | A1 | 7/2018 | Berman | |
| 2019/0311571 | A1 | 10/2019 | Halvorson | |
| 2020/0074784 | A1* | 3/2020 | Caputo | G07F 17/3213 |
| 2020/0294367 | A1 | 9/2020 | Oliver | |
| 2020/0364974 | A1 | 11/2020 | Marks | |

OTHER PUBLICATIONS

Office Action (Notice of Allowance and Fees Due (PTOL-85)) dated Sep. 23, 2022 for U.S. Appl. No. 17/341,750 (pp. 1-7).
Office Action (Notice of Allowance and Fees Due (PTOL-85)) dated Oct. 6, 2022 for U.S. Appl. No. 17/341,750 (pp. 1-4).
Notice of Allowance dated Apr. 4, 2023 for U.S. Appl. No. 18/066,125 (pp. 1-8).

* cited by examiner

| | | Frenzy Item Set # (b) | 1 | 2 | 3 | 4 | 5 | 6 | 7 | 8 | 9 | 10 |
|---|---|---|---|---|---|---|---|---|---|---|---|---|
| Reel Set (a) | Reelset Notes | | Weights (c) | Weights | Weights | Weights | Weights | Weights | Weights | Weights | Weights | Weights |
| 1 | Normal (no random wilds) | | 548400 | 531400 | 518400 | 540400 | 545400 | 555400 | 568200 | 563400 | 571900 | 568900 |
| 2 | Random Wilds Triggered | | 25000 | 42000 | 55000 | 33000 | 28000 | 18000 | 5200 | 10000 | 1500 | 4500 |
| 3 | Frenzy item symbols - low | | 100 | 100 | 100 | 100 | 100 | 100 | 100 | 100 | 100 | 100 |
| 4 | Frenzy item symbols - med | | 500 | 500 | 500 | 500 | 500 | 500 | 500 | 500 | 500 | 500 |
| 5 | Frenzy item symbols - high | | 1000 | 1000 | 1000 | 1000 | 245000 | 1000 | 1000 | 1000 | 245000 | 245000 |
| 6 | Frenzy item symbols - higher | | 5000 | 5000 | 5000 | 245000 | 1000 | 5000 | 5000 | 5000 | 1000 | 1000 |
| 7 | Frenzy item symbols - max | | 245000 | 245000 | 245000 | 5000 | 5000 | 245000 | 245000 | 245000 | 5000 | 5000 |
| | | Total Weight: | 825000 | 825000 | 825000 | 825000 | 825000 | 825000 | 825000 | 825000 | 825000 | 825000 |
| (i) RTP: | 95.0367% | (d) Base Game RTP: | 61.28% | 59.88% | 58.82% | 60.19% | 60.61% | 61.85% | 62.90% | 62.51% | 62.79% | 62.54% |
| | | (e) Random Wilds RTP: | 14.65% | 24.61% | 32.23% | 19.34% | 16.41% | 10.55% | 3.05% | 5.86% | 0.88% | 2.64% |
| | | (f) Frenzy RTP: | 9.21% | 22.58% | 15.41% | 21.14% | 11.23% | 19.30% | 20.08% | 11.63% | 21.23% | 0.00% |
| | | (g) Total RTP: | 85.14% | 107.08% | 106.47% | 100.67% | 88.26% | 91.70% | 86.03% | 80.00% | 84.90% | 65.18% |
| (h) % of Frenzy Spins for each Frenzy Item Set: | | | 9.05% | 7.38% | 16.22% | 19.70% | 37.87% | 8.72% | 1.03% | 0.04% | 0.00% | 0.00% |

Fig. 30

GAME OF CHANCE WITH MULTI-LEVEL FRENZY MODE AND SYSTEMS FOR PROVIDING THE SAME

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In some cases, a player may qualify for a special mode of the base game, a secondary game, or a bonus round of the base game by attaining a certain winning combination or triggering event in, or related to, the base game, or after the player is randomly awarded the special mode, secondary game, or bonus round. In the special mode, secondary game, or bonus round, the player is given an opportunity to win extra game credits, game tokens or other forms of payout. In the case of "game credits" that are awarded during play, the game credits are typically added to a credit meter total on the EGM and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

SUMMARY

Discussed herein are various techniques for providing games of chance that may involve nested frenzy modes, e.g., a frenzy mode that occurs within another frenzy mode. In a frenzy mode, a featured set of frenzy items may be presented as part of the game of chance, and outcomes of the game of chance generated while the frenzy mode is active may have a chance of including one or more first frenzy item symbols. When each such frenzy item symbol is displayed as part of an outcome, a number of frenzy items in the featured set of frenzy items that have been obtained may be incremented by a first value. When the number of frenzy items that have been obtained is greater than or equal to the number of frenzy items in the featured set of frenzy items, a featured set prize may be awarded, the featured set of frenzy items may be replaced with a new set of frenzy items, and the number of frenzy items in the featured set of frenzy items that have been obtained may be reset.

Frenzy modes features, as discussed herein, are presented in tandem with play of an underlying game of chance and for a time-limited duration, e.g., three minutes, two minutes, 100 seconds, one minute, etc. During a frenzy mode, each play of the game of chance may result in an outcome that may include one or more frenzy item symbols, one or more winning symbol patterns that result in an award during play of the game of the game of chance regardless of whether or not the frenzy mode feature is active, one or more winning symbol patterns (that result in an award during play of the game of the game of chance regardless of whether or not the frenzy mode feature is active) and one or more frenzy item symbols, or neither frenzy item symbols nor one or more winning symbol patterns that result in an award during play of the game of the game of chance regardless of whether or not the frenzy mode feature is active. By coupling frenzy mode play with play of the normal game of chance, the normal play of the underlying game of chance is enhanced with additional opportunities for a player to win additional prizes or awards.

As mentioned, such a game of chance may also feature nested frenzy modes, e.g., a second frenzy mode that is active while the initial frenzy mode is active. Such a second frenzy mode is for a shorter duration and may be triggered, for example, by the occurrence of a particular outcome while the initial frenzy mode is active. During the second frenzy mode, second frenzy item symbols may potentially be displayed as part of outcomes for the game of chance. When a second frenzy item symbol is displayed as part of an outcome, the number of frenzy items in the featured set of frenzy items that have been obtained may be incremented by a second value that is greater than the first value.

Various other features may also be included as part of such a game of chance, as are discussed in more detail below.

A further aspect of some such games of chance is the use of a multi-layered probabilistic tuning system that allows for a large amount of flexibility in tuning the RTP for the game of chance while accommodating a wide variety of different ways that a player may earn awards and providing a game-play experience that is fresh and engaging to players—particularly if the second frenzy mode becomes activated and briefly accelerates the rate at which featured set prizes may be obtained.

In some such multi-layered probabilistic tuning approaches, a game of chance may include a plurality of sets of reel strips, each set of reel strips having a plurality of reel strips and each reel strip having a plurality of symbols arranged in an ordered sequence. Random selections of symbols from each of the reel strips in a given reel strip set may be used to determine an outcome for the game of chance using that reel strip set. One or more of the reel strip sets may have one or more first frenzy item symbols in one or more of the reel strips thereof, and one or more of the reel strip sets may not have any frenzy item symbols in any of the reel strips thereof. Each reel strip set may also be associated with a probabilistic weighting factor that governs how frequently that reel strip set is selected as compared to other potentially selectable reel strip sets based on a randomly generated number. Moreover, there may be multiple sets of frenzy items that may be sequentially presented as the featured set of frenzy items during a frenzy mode, and each such set of frenzy items may have a corresponding set of probabilistic weights that are assigned to each of the reel strip sets that may be selectable during the first and/or second frenzy mode so as to govern how frequently each such reel strip set is randomly selected while that set of frenzy items is the featured set of frenzy items.

Such a framework allows for multiple opportunities for the probabilities of the various potential outcomes (and thus the RTP) to be flexibly adjusted so as to provide exciting and engaging frenzy mode gameplay while still allowing for precise control of RTP for such a game of chance. For example, certain featured sets of frenzy items may be caused to be more easily completed than others, thereby allowing players that play fast enough during the frenzy mode to potentially be presented with an intermediate featured set of frenzy items that is noticeably easier to obtain than the immediately preceding featured set of frenzy items, while still causing the overall RTP of the game of chance to remain at a desired level.

While various implementations will become evident from the discussion that follows, this disclosure includes, but is not limited to, the implementations discussed below.

In some implementations, an electronic gaming system may be provided that includes one or more displays and a game controller that includes one or more processors and one or more memory devices. The one or more processors, the one or more memory devices, and the one or more displays may be operably connected and the one or more memory devices store computer-executable instructions for controlling the one or more processors to cause a first game of chance to be presented via the one or more displays, cause an outcome for the first game of chance to be presented responsive to each receipt of a player input signal indicating a play of the first game of chance, determine if one or more first frenzy mode trigger conditions is met, and cause, during presentation of the first game of chance and responsive to the one or more first frenzy mode trigger conditions being met, a first frenzy mode to be initiated for a first time period. The first frenzy mode may be associated with a featured set of frenzy items and the one or more memory devices may further store additional computer-executable instructions for controlling the one or more processors to, for each play of the first game of chance during the first frenzy mode, determine each instance in which a qualifying first frenzy item symbol is displayed on the one or more displays as a result of that play of the first game of chance, increment, responsive to each determination that a qualifying first frenzy item symbol is displayed on the one or more displays for that play of the first game of chance, a number of frenzy items of the featured set of frenzy items that have been obtained by a first value, determine if one or more second frenzy mode trigger conditions is met as a result of that play of the first game of chance, cause, during the first frenzy mode and responsive to the one or more second frenzy mode trigger conditions being met, a second frenzy mode to be initiated for a second time period, the second time period being shorter than the first time period and at least partially temporally overlapping with the first time period, determine each instance in which a qualifying second frenzy item symbol is displayed on the one or more displays as a result of that play of the first game of chance during the second frenzy mode, and increment, responsive at least to each determination that a qualifying second frenzy item symbol is displayed on the one or more displays for that play of the first game of chance while the number of frenzy items of the featured set of frenzy items that have been obtained is less than the number of frenzy items in the featured set of frenzy items by at least a second value, the number of frenzy items of the featured set of frenzy items that have been obtained by the second value. In such implementations, the second value may be greater than the first value.

In some implementations of the electronic gaming system, the first value may be one. In some further or alternative such implementations, the second value may be two.

In some implementations of the electronic gaming system, the one or more memory devices may further store additional computer-executable instructions for further controlling the one or more processors to cause, responsive to the number of frenzy items of the featured set of frenzy items that have been obtained equaling the number of frenzy items in the featured set of frenzy items, a featured set prize associated with the featured set of frenzy items to be awarded.

In some implementations of the electronic gaming system, the one or more memory devices may further store additional computer-executable instructions for further controlling the one or more processors to: cause a first graphical indicator to be displayed on the one or more displays for each frenzy item in a first subset of frenzy items in the featured set of frenzy items, where the number of frenzy items in the first subset is equal to the number of frenzy items in the featured set of frenzy items minus the number of frenzy items in the featured set of frenzy items that have been obtained, receive a first player input indicative of a selection of one of the first graphical indicators after the conclusion of the first frenzy mode, determine if the selected first graphical indicator is a winning selection, and cause, responsive to determining that the selected first graphical indicator is a winning selection, the featured set prize associated with the featured set of frenzy items to be awarded.

In some such implementations of the electronic gaming system, the one or more memory devices may further store additional computer-executable instructions for further controlling the one or more processors to cause, responsive to determining that the selected first graphical indicator is not a winning selection, a frenzy item prize associated with the one of the frenzy items in the featured set of frenzy items that is associated with the selected first graphical indicator to be awarded.

In some additional or alternative such implementations of the electronic gaming system, the one or more memory devices may further store additional computer-executable instructions for further controlling the one or more processors to cause second graphical indicators of the frenzy items in the featured set of frenzy items that are not in the first set of frenzy items to be displayed, and the first graphical indicators may be different in character from the second graphical indicators.

In some such implementations of the electronic gaming system, the first and second graphical indicators may be in the shape of puzzle pieces or tiles that, when arranged in a particular pattern, depict, in aggregate, a coherent image or animation.

In some implementations of the electronic gaming system, the one or more memory devices may further store additional computer-executable instructions for further controlling the one or more processors to cause, responsive to each determination that a qualifying first frenzy item symbol is displayed on the one or more displays for a play of the first game of chance, a first frenzy item symbol prize associated with that qualifying first frenzy item symbol to be awarded.

In some implementations of the electronic gaming system, the one or more memory devices may further store additional computer-executable instructions for further controlling the one or more processors to cause the second frenzy mode to conclude in conjunction with the first frenzy mode when the second frenzy mode is still active at the conclusion of the first time period.

In some implementations of the electronic gaming system, the one or more memory devices may further store additional computer-executable instructions for further controlling the one or more processors to cause the second frenzy mode to conclude after the first frenzy mode when the second frenzy mode is active at the conclusion of the first time period and the end of the second time period has not yet occurred.

In some implementations of the electronic gaming system, the one or more memory devices may further store additional computer-executable instructions for further controlling the one or more processors to: a) determine, during at least the first time period, that the number of frenzy items of the featured set of frenzy items that have been obtained equals the number of frenzy items in the featured set of frenzy items, b) select, responsive to determining that the number of frenzy items of the featured set of frenzy items that have been obtained equals the number of frenzy items in the featured set of frenzy items, a new set of frenzy items to be the featured set of frenzy items, and c) reset, responsive to determining that the number of frenzy items of the featured set of frenzy items that have been obtained equals the number of frenzy items in the featured set of frenzy items, the number of frenzy items of the featured set of frenzy items that have been obtained to a number lower than the number of frenzy items in the new set of frenzy items.

In some implementations of the electronic gaming system, the one or more memory devices may further store additional computer-executable instructions for further controlling the one or more processors to repeat (b) and (c) each time (a) occurs during the first time period.

In some implementations of the electronic gaming system, the one or more memory devices may further store additional computer-executable instructions for further controlling the one or more processors to, each time (b) is performed, select a new set of frenzy items in (b) that has a number of frenzy items that is greater than or equal to the number of frenzy items in the featured set of frenzy items of (a).

In some implementations of the electronic gaming system, each new set of frenzy items in (b) may be associated with a corresponding prize that is used as a featured set prize while the new set of frenzy items is the featured set of frenzy items.

In some implementations of the electronic gaming system, the corresponding prize for each new set of frenzy items in (b) may be greater than or equal to a featured set prize associated with the featured set of frenzy items that the new set of frenzy items is to replace.

In some implementations of the electronic gaming system, the one or more memory devices may further store additional computer-executable instructions for further controlling the one or more processors to, as part of (c), reset the number of frenzy items of the featured set of frenzy items that have been obtained to zero.

In some such implementations of the electronic gaming system, the one or more memory devices may further store computer-executable instructions for controlling the one or more processors to, for each play of the game of chance, determine the outcome to be presented responsive to the receipt of the player input signal indicating the play of the game of chance by using a selected reel strip set, and select the selected reel strip set from a plurality of reel strip sets associated with the featured set of frenzy items, each reel strip set in the plurality of reel strip sets having a plurality of reel strips, and each reel strip having a set of symbols associated therewith. In such implementations, the plurality of reel strip sets from which the selected reel strip set may be selected during the first time period includes at least one reel strip set that has at least one reel strip with at least one first frenzy item symbol, and the plurality of reel strip sets from which the selected reel strip set is selected during the second time period may include at least one reel strip set that has at least one reel strip with at least one second frenzy item symbol.

In some such implementations of the electronic gaming system, each reel strip set in the plurality of reel strip sets from which the selected reel strip set is selected during the first time period may have associated therewith a corresponding reel strip set weight, and the one or more memory devices may further store computer-executable instructions for controlling the one or more processors to, for each play of the game of chance, select the selected reel strip set from the plurality of reel strip sets through weighted random selection based on the corresponding reel strip set weights for each of the reel strip sets in the plurality of reel strip sets.

In some such implementations of the electronic gaming system, the one or more memory devices may further store computer-executable instructions for controlling the one or more processors to select the featured set of frenzy items from a plurality of sets of frenzy items. In such implementations, each set of frenzy items in the sets of frenzy items may be associated with a corresponding plurality of reel strip sets that are selectable for use in determining the outcome to be presented responsive to the receipt of the player input signal indicating the play of the game of chance when that set of frenzy items is the featured set of frenzy items, each reel strip set in the plurality of reel strip sets that is associated with each set of frenzy items may be associated with a corresponding reel strip set weight, and the one or more memory devices may further store additional computer-executable instructions for controlling the one or more processors to, for each play of the game of chance, select the selected reel strip set from the plurality of reel strip sets that are associated with the set of frenzy items that is the featured set of frenzy items and to select the selected reel strip set through weighted random selection based on the corresponding reel strip set weights for each of the reel strip sets that are associated with the set of frenzy items that is the featured set of frenzy items.

BRIEF DESCRIPTION OF THE DRAWINGS

FIG. 30 depicts a table showing example reel set weights that may be used for a plurality of sets of reel strip sets for a given game of chance.

DETAILED DESCRIPTION

Figure 1:
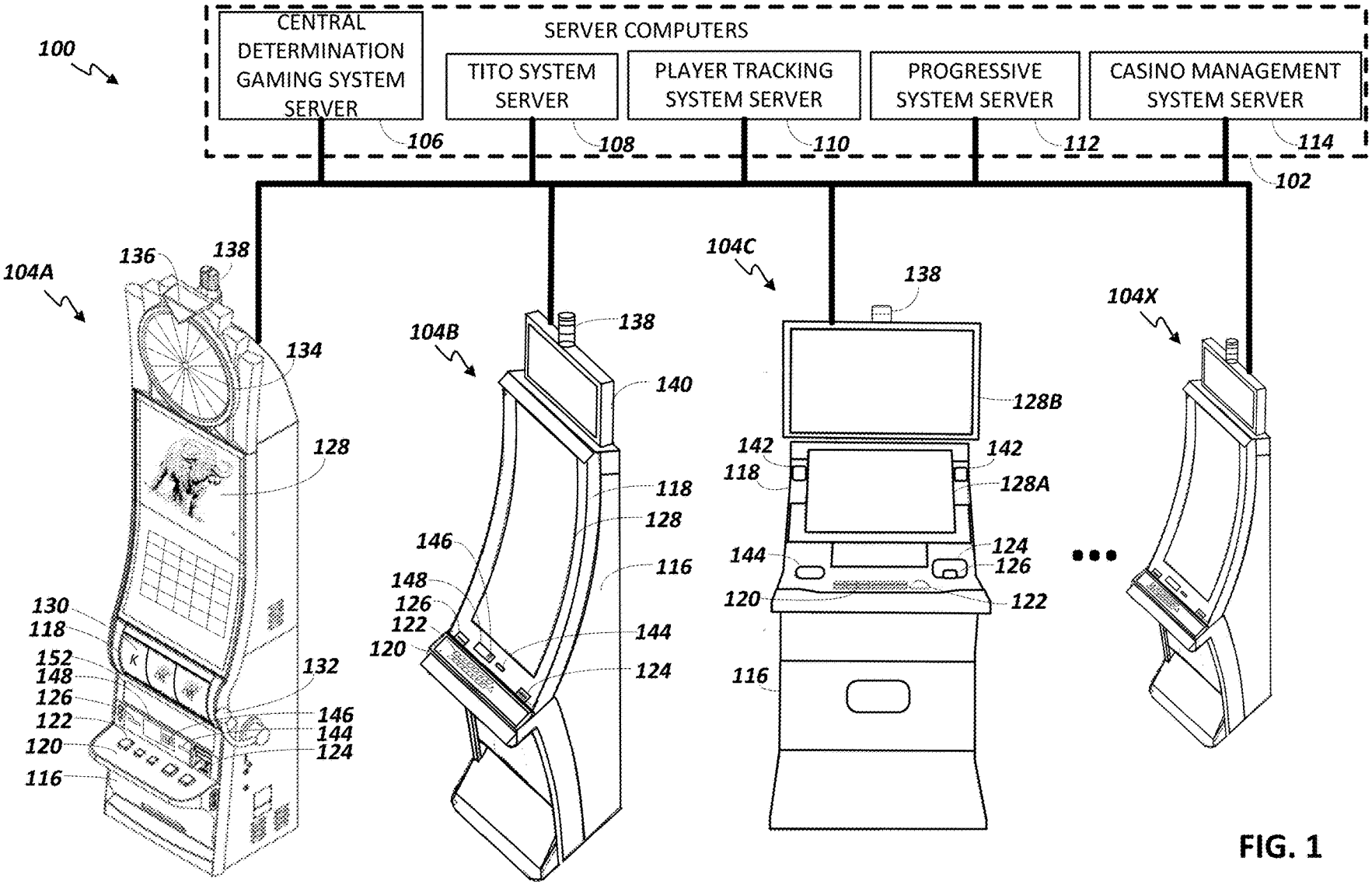
FIG. 1 is an exemplary diagram showing several EGMs networked with various gaming related servers.

As mentioned above, a variety of techniques for providing games of chance that involve nested frenzy modes, e.g., a frenzy mode that occurs within another frenzy mode, are disclosed. In the initial frenzy mode, a featured set of frenzy items may be presented as part of the game of chance, and outcomes of the game of chance generated while the frenzy mode is active may have a chance of including one or more first frenzy item symbols. As noted earlier, when each such frenzy item symbol is displayed as part of an outcome, a number of frenzy items in the featured set of frenzy items that have been obtained may be incremented by a first value. When the number of frenzy items that have been obtained is greater than or equal to the number of frenzy items in the featured set of frenzy items, a featured set prize may be awarded, the featured set of frenzy items may be replaced with a new set of frenzy items, and the number of frenzy items in the featured set of frenzy items that have been obtained may be reset.

The nested frenzy mode is a second frenzy mode that is active for a second time period during the first time period in which the initial frenzy mode is active. During the second frenzy mode, second frenzy item symbols may potentially be displayed as part of outcomes for the game of chance. When a second frenzy item symbol is displayed as part of an outcome, the number of frenzy items in the featured set of frenzy items that have been obtained may be incremented by a second value that is greater than the first value.

As noted earlier, a further aspect of some such games of chance is the use of a multi-layered probabilistic tuning system that allows for a large amount of flexibility in tuning the RTP for the game of chance while accommodating a wide variety of different ways that a player may earn awards and providing a gameplay experience that is fresh and engaging to players—particularly if the second frenzy mode becomes activated and briefly accelerates the rate at which featured set prizes may be obtained. Given the number of ways that a player can earn awards in such a game of chance, the RTP therefore may be quite challenging to manage.

As discussed, in some such multi-layered probabilistic tuning approaches, a game of chance may include a plurality of sets of reel strips, each set of reel strips having a plurality of reel strips and each reel strip having a plurality of symbols arranged in an ordered sequence. Random selections of symbols from each of the reel strips in a given reel strip set may be used to determine an outcome for the game of chance using that reel strip set. One or more of the reel strip sets may have one or more first frenzy item symbols in one or more of the reel strips thereof, and one or more of the reel strip sets may not have any frenzy item symbols in any of the reel strips thereof. Each reel strip set may also be associated with a probabilistic weighting factor that governs how frequently that reel strip set is selected as compared to other potentially selectable reel strip sets based on a randomly generated number. Moreover, there may be multiple sets of frenzy items that may be sequentially presented as the featured set of frenzy items during a frenzy mode, and each such set of frenzy items may have a corresponding set of probabilistic weights that are assigned to each of the reel strip sets that may be selectable during the first and/or second frenzy mode so as to govern how frequently each such reel strip set is randomly selected while that set of frenzy items is the featured set of frenzy items.

Such a framework allows for multiple opportunities for the probabilities of the various potential outcomes (and thus the RTP) to be flexibly adjusted so as to provide exciting and engaging frenzy mode gameplay while still allowing for precise control of RTP for such a game of chance. For example, certain featured sets of frenzy items may be caused to be more easily completed than others, thereby allowing players that play fast enough during the frenzy mode to potentially be presented with an intermediate featured set of frenzy items that is noticeably easier to obtain than the immediately preceding featured set of frenzy items, while still causing the overall RTP of the game of chance to remain at a desired level.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a website maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (WiFi®) and Bluetooth®), cable TV, satellite links and the like.

In some implementation, server computers 102 may not be necessary and/or preferred. For example, in one or more implementations, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The mechanical reels 130 are independently spun and stopped to show a set of symbols within the gaming display area 118 which may be used to determine an outcome to the game.

In many configurations, the gaming device 104A may have a main display 128 (e.g., video display monitor) mounted to, or above, the gaming display area 118. The main display 128 can be a high-resolution liquid crystal display (LCD), plasma, light emitting diode (LED), or organic light emitting diode (OLED) panel which may be flat or curved as shown, a cathode ray tube, or other conventional electronically controlled video monitor.

In some implementations, the bill validator 124 may also function as a "ticket-in" reader that allows the player to use a casino issued credit ticket to load credits onto the gaming device 104A (e.g., in a cashless ticket ("TITO") system). In such cashless implementations, the gaming device 104A may also include a "ticket-out" printer 126 for outputting a credit ticket when a "cash out" button is pressed. Cashless TITO systems are used to generate and track unique barcodes or other indicators printed on tickets to allow players to avoid the use of bills and coins by loading credits using a ticket reader and cashing out credits using a ticket-out printer 126 on the gaming device 104A. The gaming device 104A can have hardware meters for purposes including ensuring regulatory compliance and monitoring the player credit balance. In addition, there can be additional meters that record the total amount of money wagered on the gaming device, total amount of money deposited, total amount of money withdrawn, total amount of winnings on gaming device 104A.

In some implementations, a player tracking card reader 144, a transceiver for wireless communication with a mobile device (e.g., a player's smartphone), a keypad 146, and/or an illuminated display 148 for reading, receiving, entering, and/or displaying player tracking information is provided in gaming device 104A. In such implementations, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some implementations, the information panel(s) 152 may be implemented as an additional video display.

Gaming devices 104A have traditionally also included a handle 132 typically mounted to the side of main cabinet 116 which may be used to initiate game play.

Figure 2A:
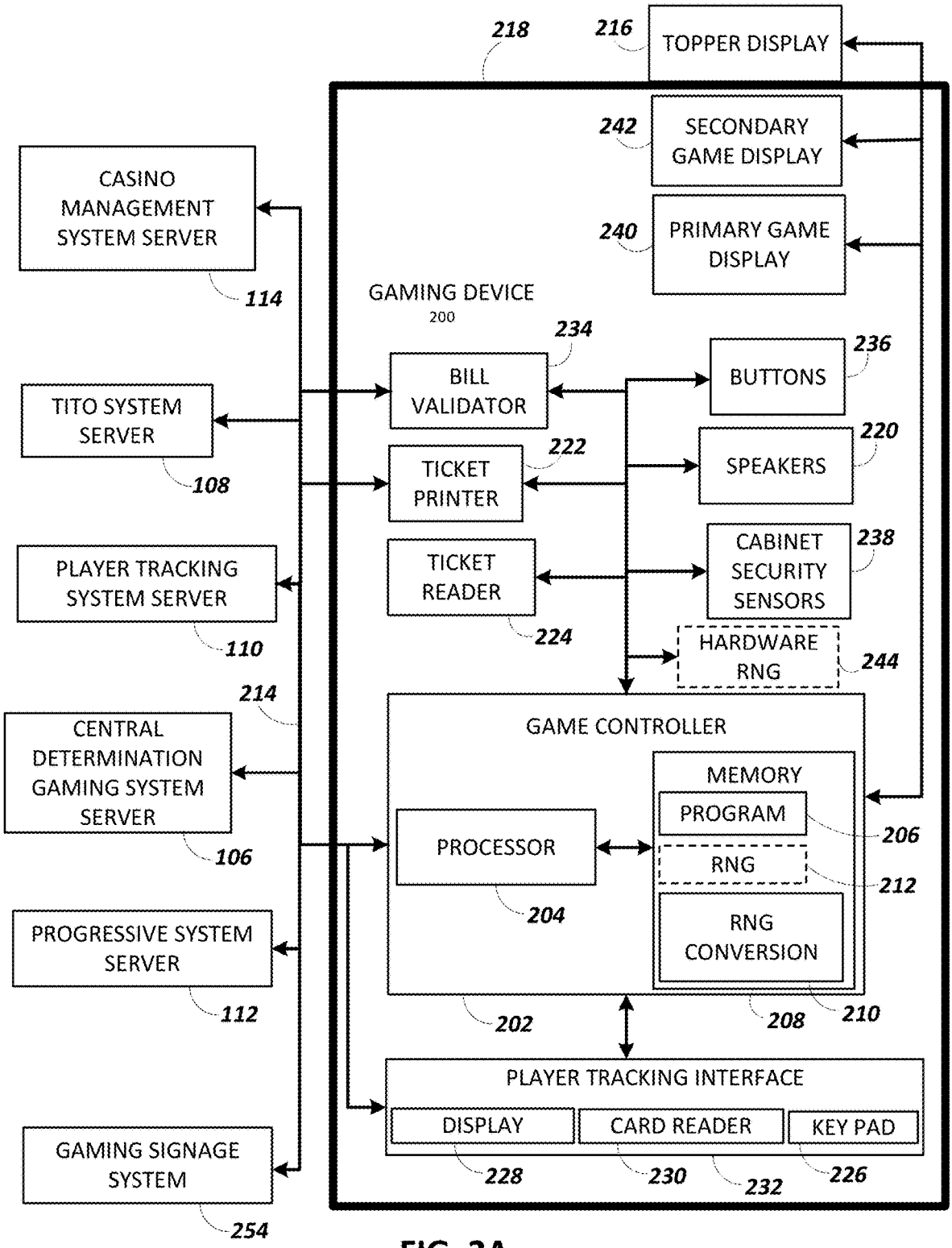
FIG. 2A is a block diagram showing various functional elements of an exemplary EGM.

Many or all the above described components can be controlled by circuitry (e.g., a game controller) housed inside the main cabinet 116 of the gaming device 104A, the details of which are shown in FIG. 2A.

An alternative example gaming device 104B illustrated in FIG. 1 is the Arc™ model gaming device manufactured by Aristocrat® Technologies, Inc. Note that where possible, reference numerals identifying similar features of the gaming device 104A implementation are also identified in the gaming device 104B implementation using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some implementations, the optional topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The main or service door may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the main display 128A may have a curvature radius from top to bottom, or alternatively from side to side. In some implementations, main display 128A is a flat panel display. Main display 128A is typically used for primary game play while secondary display 128B is typically used for bonus game play, to show game features or attraction activities while the game is not in play or any other information or media desired by the game designer or operator. In some implementations, example gaming device 104C may also include speakers 142 to output various audio such as game sound, background music, etc.

Many different types of games, including mechanical slot games, video slot games, video poker, video blackjack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2A is a block diagram depicting exemplary internal electronic components of a gaming device 200 connected to various external systems. All or parts of the gaming device 200 shown could be used to implement any one of the example gaming devices 104A-X depicted in FIG. 1. As shown in FIG. 2A, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2 also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2A illustrates that game controller 202 includes a single processor 204, game controller 202 is not limited to this representation and instead can include multiple processors 204 (e.g., two or more processors).

FIG. 2A illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory (RAM), read-only memory (ROM), hard disk drives, solid-state drives, universal serial bus (USB) flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2A illustrates that game controller 202 includes a single memory 208, game controller 202 could include multiple memories 208 for storing program instructions and/or data.

Memory 208 can store one or more game programs 206 that provide program instructions and/or data for carrying out various implementations (e.g., game mechanics) described herein. Stated another way, game program 206 represents an executable program stored in any portion or component of memory 208. In one or more implementations, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be set up to generate one or more game instances based on instructions and/or data that gaming device 200 exchanges with one or more remote gaming devices, such as a central determination gaming system server 106 (not shown in FIG. 2A but shown in FIG. 1). For purpose of this disclosure, the term "game instance" refers to a play or a round of a game that gaming device 200 presents (e.g., via a user interface (UI)) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2A illustrates that gaming device 200 could include an RNG 212 that utilizes hardware and/or software to generate RNG outcomes that lack any pattern. The RNG operations are often specialized and non-generic in order to comply with regulatory and gaming requirements. For example, in a slot game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more implementations, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred to as a "random number").

In FIG. 2A, RNG 212 and hardware RNG 244 are shown in dashed lines to illustrate that RNG 212, hardware RNG 244, or both can be included in gaming device 200. In one implementation, instead of including RNG 212, gaming device 200 could include a hardware RNG 244 that generates RNG outcomes. Analogous to RNG 212, hardware RNG 244 performs specialized and non-generic operations in order to comply with regulatory and gaming requirements. For example, because of regulation requirements, hardware RNG 244 could be a random number generator that securely produces random numbers for cryptography use. The gaming device 200 then uses the secure random numbers to generate game outcomes for one or more game features. In another implementation, the gaming device 200 could include both hardware RNG 244 and RNG 212. RNG 212 may utilize the RNG outcomes from hardware RNG 244 as one of many sources of entropy for generating secure random numbers for the game features.

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). A game can use one or more lookup tables (also called weighted tables) as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP. (In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts.) Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility.

FIG. 2A illustrates that gaming device 200 includes an RNG conversion engine 210 that translates the RNG outcome from RNG 212 to a game outcome presented to a player. To meet a designated RTP, a game developer can set up the RNG conversion engine 210 to utilize one or more lookup tables to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2A also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gaming device. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Additionally, or alternatively, gaming devices 104A-104X and 200 can include or be coupled to one or more wireless transmitters, receivers, and/or transceivers (not shown in FIGS. 1 and 2A) that communicate (e.g., Bluetooth® or other near-field communication technology) with one or more mobile devices to perform a variety of wireless operations in a casino environment. Examples of wireless operations in a casino environment include detecting the presence of mobile devices, performing credit, points, comps, or other marketing or hard currency transfers, establishing wagering sessions, and/or providing a personalized casino-based experience using a mobile application. In one implementation, to perform these wireless operations, a wireless transmitter or transceiver initiates a secure wireless connection between a gaming device 104A-104X and 200 and a mobile device. After establishing a secure wireless connection between the gaming device 104A-104X and 200 and the mobile device, the wireless transmitter or transceiver does not send and/or receive application data to and/or from the mobile device. Rather, the mobile device communicates with gaming devices 104A-104X and 200 using another wireless connection (e.g., WiFi® or cellular network). In another implementation, a wireless transceiver establishes a secure connection to directly communicate with the mobile device. The mobile device and gaming device 104A-104X and 200 sends and receives data utilizing the wireless transceiver instead of utilizing an external network. For example, the mobile device would perform digital wallet transactions by directly communicating with the wireless transceiver. In one or more implementations, a wireless transmitter could broadcast data received by one or more mobile devices without establishing a pairing connection with the mobile devices.

Although FIGS. 1 and 2A illustrate specific implementations of a gaming device (e.g., gaming devices 104A-104X and 200), the disclosure is not limited to those implementations shown in FIGS. 1 and 2. For example, not all gaming devices suitable for implementing implementations of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or tabletops and have displays that face upwards. Gaming devices 104A-104X and 200 may also include other processors that are not separately shown. Using FIG. 2A as an example, gaming device 200 could include display controllers (not shown in FIG. 2A) configured to receive video input signals or instructions to display images on game displays 240 and 242. Alternatively, such display controllers may be integrated into the game controller 202. The use and discussion of FIGS. 1 and 2 are examples to facilitate ease of description and explanation.

Figure 2B:
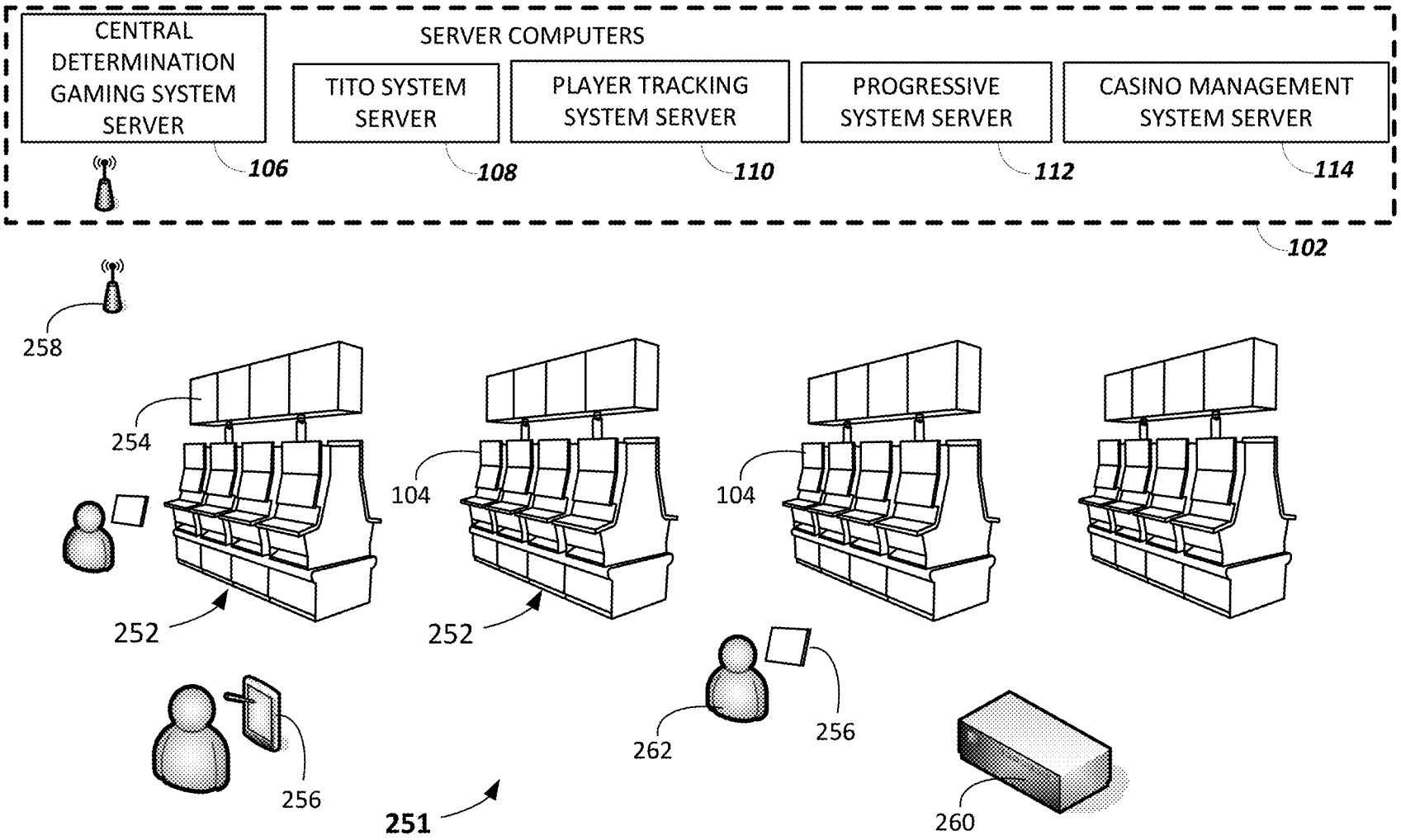
FIG. 2B depicts a casino gaming environment according to one example.

FIG. 2B depicts a casino gaming environment according to one example. In this example, the casino 251 includes banks 252 of EGMs 104. In this example, each bank 252 of EGMs 104 includes a corresponding gaming signage system 254 (also shown in FIG. 2A). According to this implementation, the casino 251 also includes mobile gaming devices 256, which are also configured to present wagering games in this example. The mobile gaming devices 256 may, for example, include tablet devices, cellular phones, smart phones and/or other handheld devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the EGMs 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the casino patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor(s) to verify the identity of an authorized patron. Some mobile gaming devices 256 may be configured to function only within a predetermined or configurable area, such as a casino gaming area.

Figure 2C:
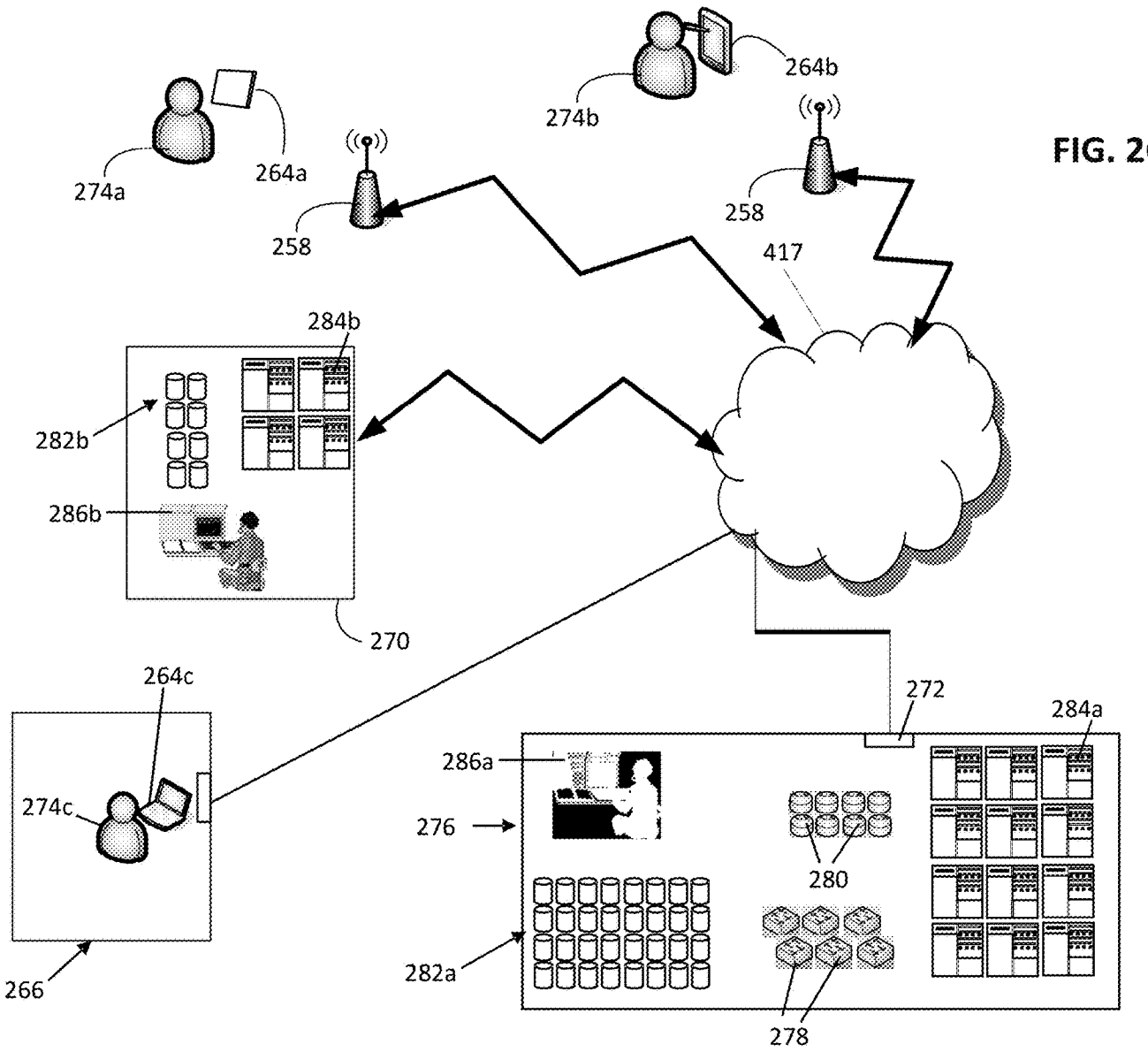
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the numbers, types and arrangements of gaming devices shown in FIG. 2C are merely shown by way of example. In this example, various gaming devices, including but not limited to end user devices (EUDs) 264*a*, 264*b* and 264*c* are capable of communication via one or more networks 417. The networks 417 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG. 2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 417. The gaming data center 276 is capable of communication with the networks 417 via the gateway 272. In this example, switches 278 and routers 280 are configured to provide network connectivity for devices of the gaming data center 276, including storage devices 282*a*, servers 284*a* and one or more workstations 570*a*. The servers 284*a* may, for example, be configured to provide access to a library of games for online game play. In some examples, code for executing at least some of the games may initially be stored on one or more of the storage devices 282*a*. The code may be subsequently loaded onto a server 284*a* after selection by a player via an EUD and communication of that selection from the EUD via the networks 417. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 417. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server(s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Figure 3:
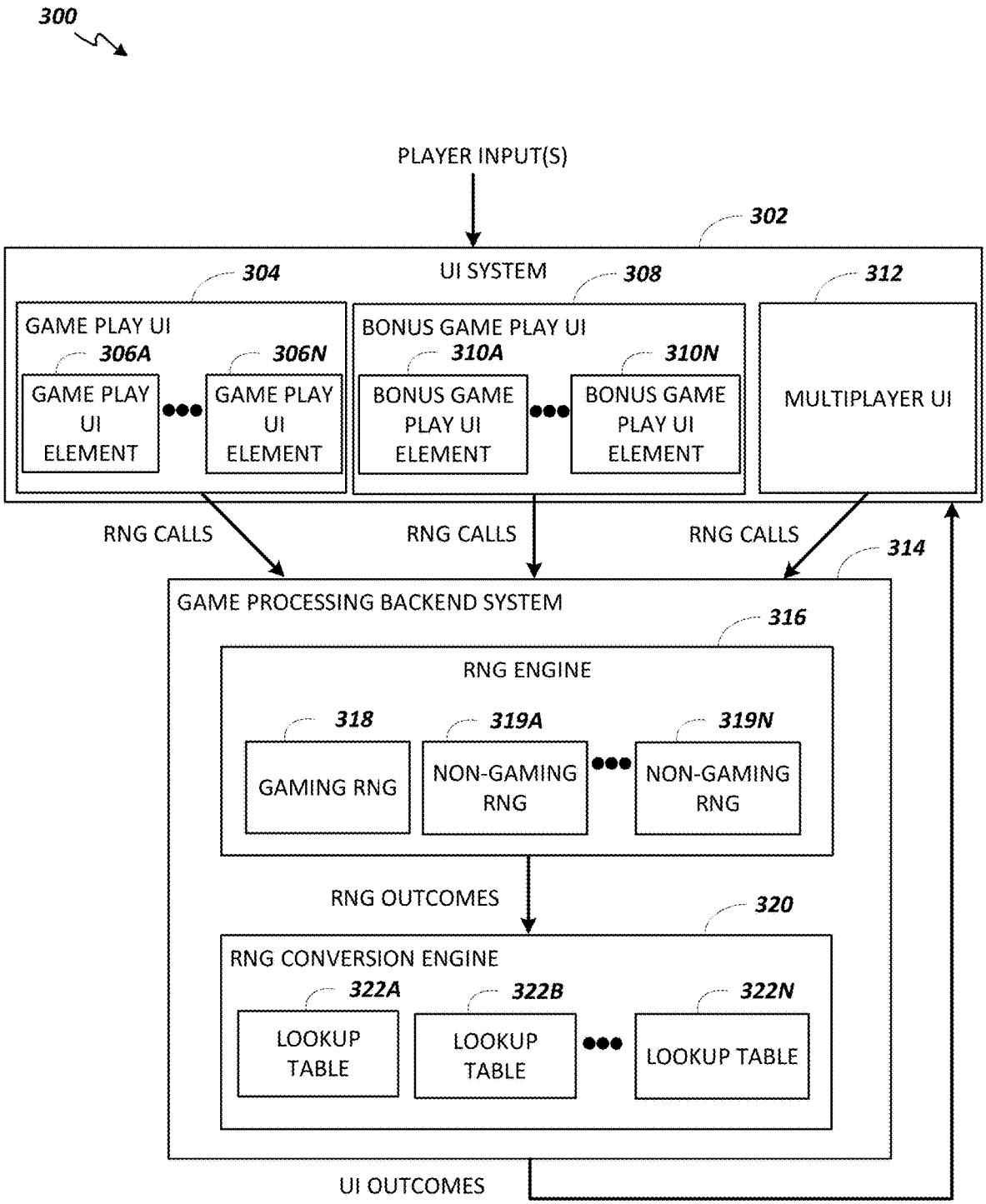
FIG. 3 illustrates, in block diagram form, an implementation of a game processing architecture algorithm that implements a game processing pipeline for the play of a game in accordance with various implementations described herein.

FIG. 3 illustrates, in block diagram form, an implementation of a game processing architecture 300 that implements a game processing pipeline for the play of a game in accordance with various implementations described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes for the UI system 302 to display to a player. The game processing architecture 300 can implement the game processing pipeline using a gaming device, such as gaming devices 104A-104X and 200 shown in FIGS. 1 and 2, respectively. Alternatively, portions of the gaming processing architecture 300 can implement the game processing pipeline using a gaming device and one or more remote gaming devices, such as central determination gaming system server 106 shown in FIG. 1.

The UI system 302 includes one or more UIs that a player can interact with. The UI system 302 could include one or more game play UIs 304, one or more bonus game play UIs 308, and one or more multiplayer UIs 312, where each UI type includes one or more mechanical UIs and/or graphical UIs (GUIs). In other words, game play UI 304, bonus game play UI 308, and the multiplayer UI 312 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more implementations, at least some of the game play UI element 306A-306N are similar to the bonus game play UI elements 310A-310N. In other implementations, the game play UI element 306A-306N can differ from the bonus game play UI elements 310A-310N.

FIG. 3 also illustrates that UI system 302 could include a multiplayer UI 312 purposed for game play that differs or is separate from the typical base game. For example, multiplayer UI 312 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces (APIs) to generate the RNG calls. To process the RNG calls, the RNG engine 316 could utilize gaming RNG 318 and/or non-gaming RNGs 319A-319N. Gaming RNG 318 could corresponds to RNG 212 or hardware RNG 244 shown in FIG. 2A. As previously discussed with reference to FIG. 2A, gaming RNG 318 often performs specialized and non-generic operations that comply with regulatory and/or game requirements. For example, because of regulation requirements, gaming RNG 318 could correspond to RNG 212 by being a cryptographic RNG or pseudorandom number generator (PRNG) (e.g., Fortuna PRNG) that securely produces random numbers for one or more game features. To securely generate random numbers, gaming RNG 318 could collect random data from various sources of entropy, such as from an operating system (OS) and/or a hardware RNG (e.g., hardware RNG 244 shown in FIG. 2A). Alternatively, non-gaming RNGs 319A-319N may not be cryptographically secure and/or be computationally less expensive. Non-gaming RNGs 319A-319N can, thus, be used to generate outcomes for non-gaming purposes. As an example, non-gaming RNGs 319A-319N can generate random numbers for generating random messages that appear on the gaming device.

The RNG conversion engine 320 processes each RNG outcome from RNG engine 316 and converts the RNG outcome to a UI outcome that is feedback to the UI system 302. With reference to FIG. 2A, RNG conversion engine 320 corresponds to RNG conversion engine 210 used for game play. As previously described, RNG conversion engine 320 translates the RNG outcome from the RNG 212 to a game outcome presented to a player. RNG conversion engine 320 utilizes one or more lookup tables 322A-322N to regulate a prize payout amount for each RNG outcome and how often the gaming device pays out the derived prize payout amounts. In one example, the RNG conversion engine 320 could utilize one lookup table to map the RNG outcome to a game outcome displayed to a player and a second lookup table as a pay table for determining the prize payout amount for each game outcome. In this example, the mapping between the RNG outcome and the game outcome controls the frequency in hitting certain prize payout amounts. Different lookup tables could be utilized depending on the different game modes, for example, a base game versus a bonus game.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to updating the appropriate UI, the player may subsequently provide additional player inputs to initiate a subsequent game instance that progresses through the game processing pipeline.

Systems such as those discussed above, e.g., with respect to FIGS. 2A and 3, may be used to provide games of chance such as those discussed herein. For example, the RNG engine of FIG. 3 may be used to provide randomized outcomes that may be used to select between different reel strip sets for use in determining outcomes and to then make further random selections of symbols from reel strips within the selected reel strip set.

The UI system may, for example, be used to cause the various graphical indicators of frenzy items (both obtained and unobtained) to be displayed during game play, as well as outcomes that are determined during play of the game of chance, timer(s) relating to first and/or second frenzy modes, and other UI elements that are shown, e.g., such as, but not limited to, the UI elements shown in FIGS. 4 through 26.

FIGS. 4 through 25 depict a graphical user interface (GUI) 402 for a game of chance during various stages of game play. The GUI 402 has a primary game display area 404 and a bonus game display area 406, although this is simply one example of how the GUI 402 may be arranged. It will be understood that the mechanics of the game of chance discussed herein may be implemented in a number of different ways.

The primary game display area 404 depicts a slot-machine type game of chance, but any game of chance may be used in which different outcomes may be depicted in response to each play of the game. Such outcomes may be randomly determined for each play of the game of chance, e.g., based on the outcome of a random number generator. In the depicted game of chance, symbols 408 from a plurality of reels, e.g., five reels in this example, are shown. Each reel may be associated with a reel strip, e.g., an ordered sequence of symbols 408. For each play of the game of chance, a set of adjacent symbols 408, e.g., three symbols 408 in this example, from each reel strip may be selected and displayed (the symbols 408 of each reel strip in this example are displayed in vertical columns). Such selections may be made according to output from a random number generator so as to generate a randomized outcome for each play of the game of chance.

Figure 4:
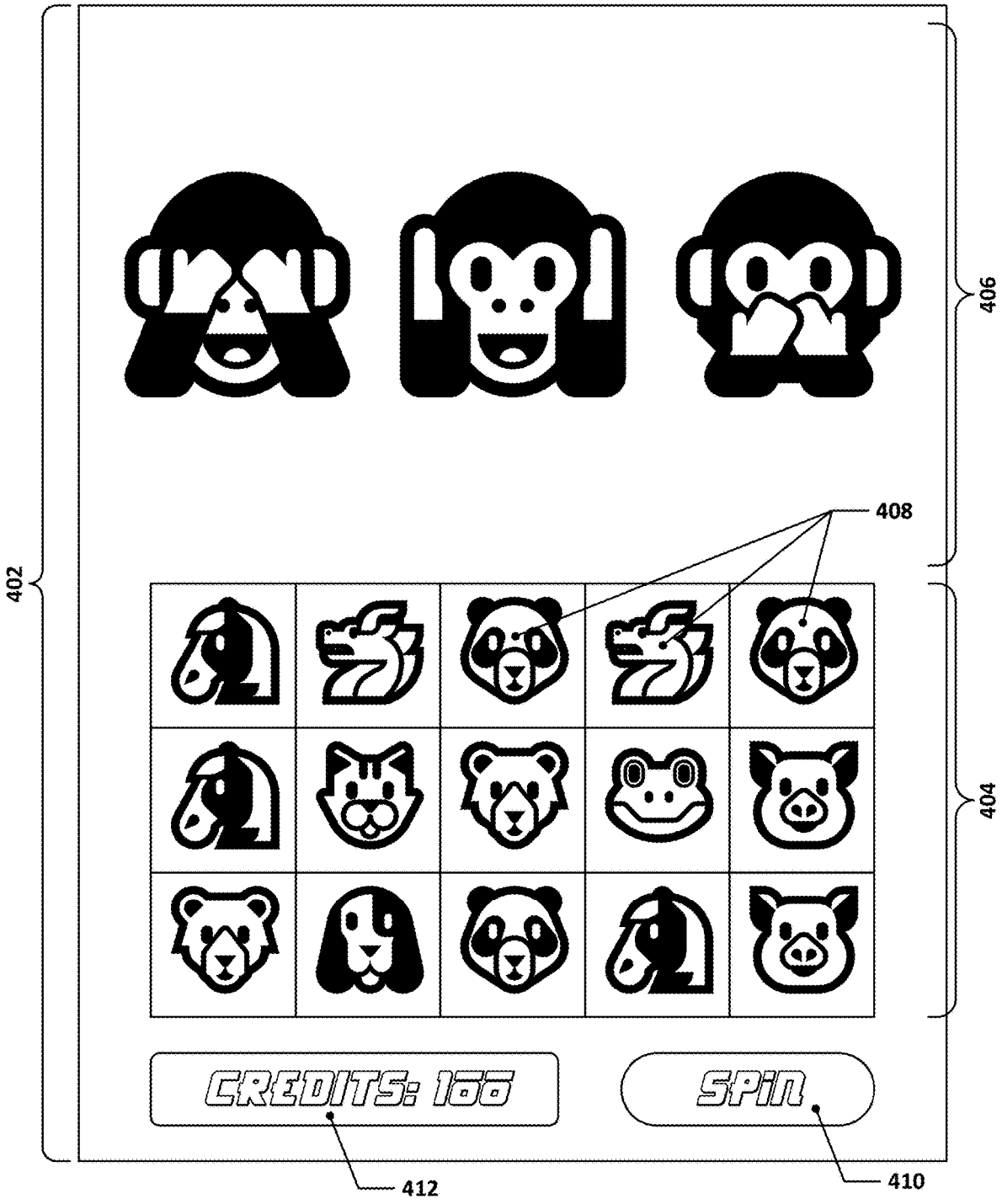
FIGS. 4 through 26 depict a GUI for a game of chance according to the present disclosure.

The bonus game display area 406 is a region of the GUI 402 may be used to display, for example, a bonus game or game feature. In FIG. 4, the bonus game display area 406 is not showing a bonus game or game feature, but is instead showing a graphic of three monkeys, e.g., graphical content that may provide thematic color or content that relates to the game of chance.

The GUI 412 also features a user control 410, e.g., a spin button, that may be selected by a player in order to initiate a play of the game of chance, as well as a credits display 412 that may be updated periodically to reflect credits that may be won in the game of chance and/or credits that may be wagered in the game of chance.

Each time the user control 410 is selected by a player, for example, the electronic gaming system providing the game of chance may cause a random outcome to be generated, e.g., a random outcome that determines which symbols from the reel strips are shown. Such outcomes may, if certain patterns of symbols occur, result in a prize or prizes being awarded to the player in association with those outcomes, as is typical in a slot-machine type game of chance.

However, the game of chance shown in FIGS. 4 through 25 also offers a frenzy mode feature that may, under certain conditions, be activated. Such conditions may vary depending on the particular implementation of the game of chance. For example, in some implementations, the frenzy mode feature may be activated responsive to the occurrence of a particular symbol or pattern of symbols, a particular number of credits being won by a player (either cumulatively across multiple plays of the game of chance by the player or within a single play of the game of chance), a preset time on a predetermined day occurring (which may be set according to a predetermined schedule, such as each Tuesday at 2:00 PM in a particular time zone), when all of the players playing instances of that game of chance across a predetermined number or group of electronic gaming machines (or other devices) in aggregate and at the same time exceed a particular threshold amount (such as 500 players), when a total number of plays of the game of chance across a predetermined number or group of electronic gaming machines (or other devices) over a predetermined period of time (such as an hour) exceeds a predetermined threshold (such as 1 million spins), a player making a purchase of a particular power-up or other item (either virtual or tangible) while playing the game of chance, a player achieving a particular experience level either within the game of chance (e.g., having made 500 plays within a single gaming session) or in a player tracking system (e.g., achieving "silver" status within the player tracking system), etc.

Figure 5:
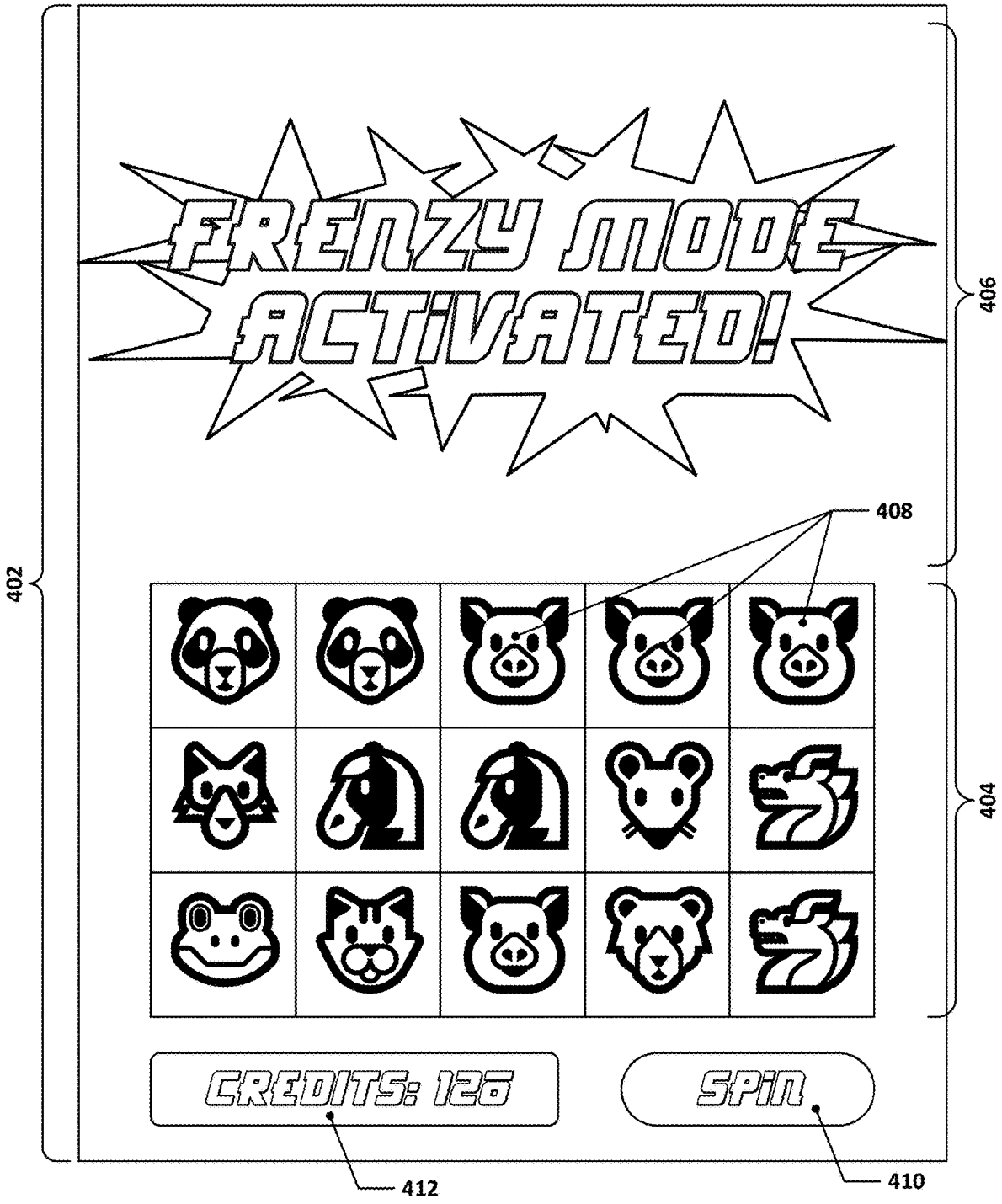

In FIG. 5, a first frenzy mode has been activated responsive to the occurrence of one or more first frenzy mode trigger conditions being met. The GUI may provide a notification that the first frenzy mode is active, e.g., by displaying a notification that frenzy mode is activated.

Figure 6:
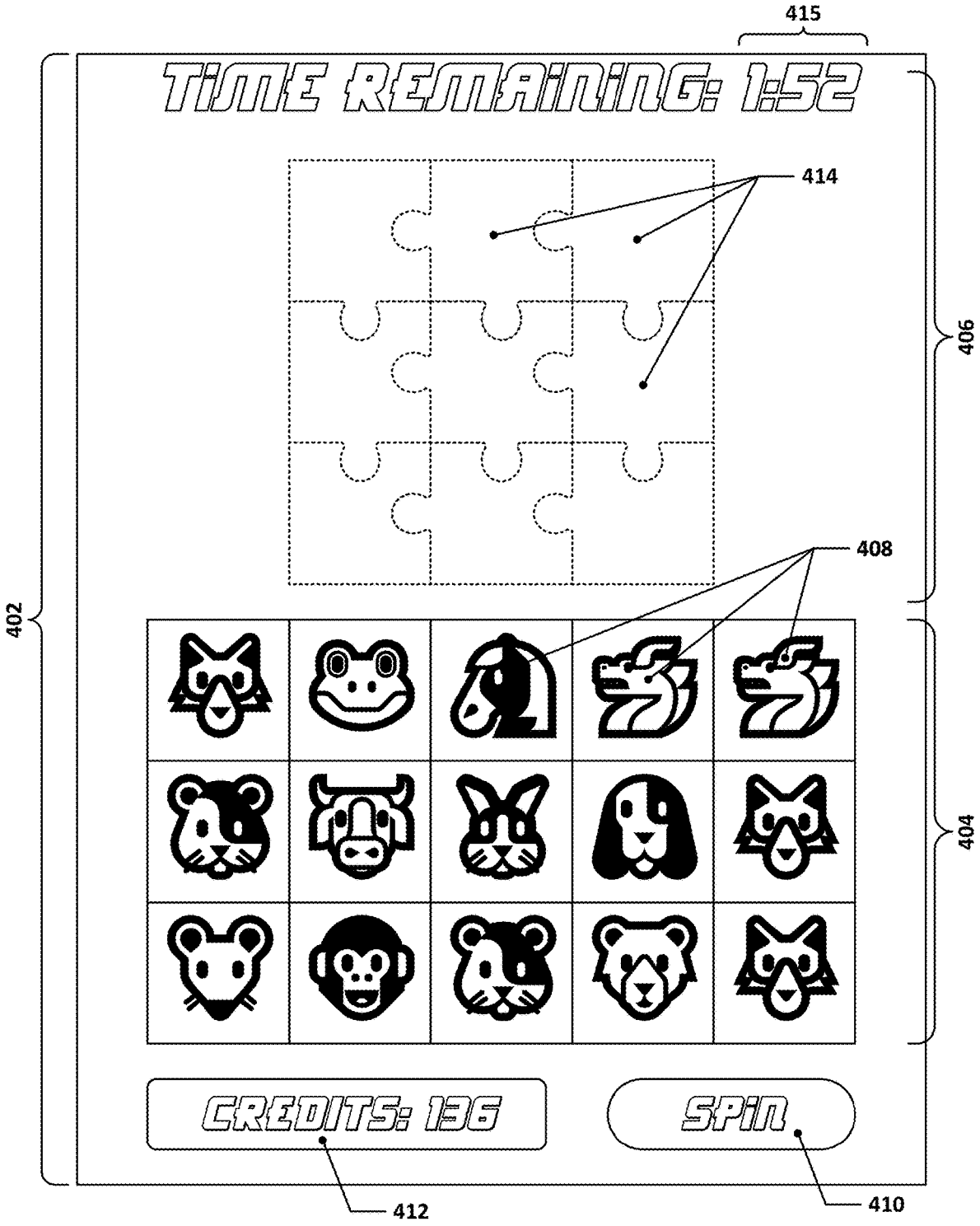

In FIG. 6, the GUI may be updated to provide graphical content associated with the first frenzy mode. Once activated, the first frenzy mode may be active for a predefined first time period, e.g., two minutes. During the first frenzy mode, a featured set of frenzy items may be indicated to the player. The outcomes for the game of chance may also be configured such that there is a possibility of one or more qualifying first frenzy item symbols being displayed as part of any given outcome. Each time a play of the game of chance results in a qualifying first frenzy item symbol being displayed, the number of obtained frenzy items in the featured set of frenzy items may be incremented by a first value until the number of obtained frenzy items equals the number of frenzy items in the featured set of frenzy items. When the number of obtained frenzy items equals the number of frenzy items in the featured set of frenzy items, the electronic gaming system may cause a featured set prize to be awarded to the player. The first frenzy item symbols (and, discussed later, the second frenzy item symbols) may be additional symbols that are displayed in addition to the normal symbol that is displayed in the corresponding symbol location as part of an outcome. Thus, for example, a given symbol position may include a symbol that, in combination with other displayed symbols in an outcome, forms a winning pattern for the game of chance, as well as a frenzy item symbol that causes the number of obtained frenzy items in the featured set of frenzy items to be incremented by a corresponding value.

The featured set of frenzy items may be provided in a number of different ways. In FIG. 6, the featured set of frenzy items 414 takes the form of a set of puzzle pieces, and each time a first frenzy item symbol is displayed as part of a given outcome, the number of obtained frenzy items may be incremented by one. This may be represented, as shown in later Figures, by a "blank" puzzle piece being replaced by an illustrated puzzle piece, i.e., a puzzle piece that shows a portion of an image that is formed when the complete featured set of frenzy 414 items is obtained.

Figure 7:
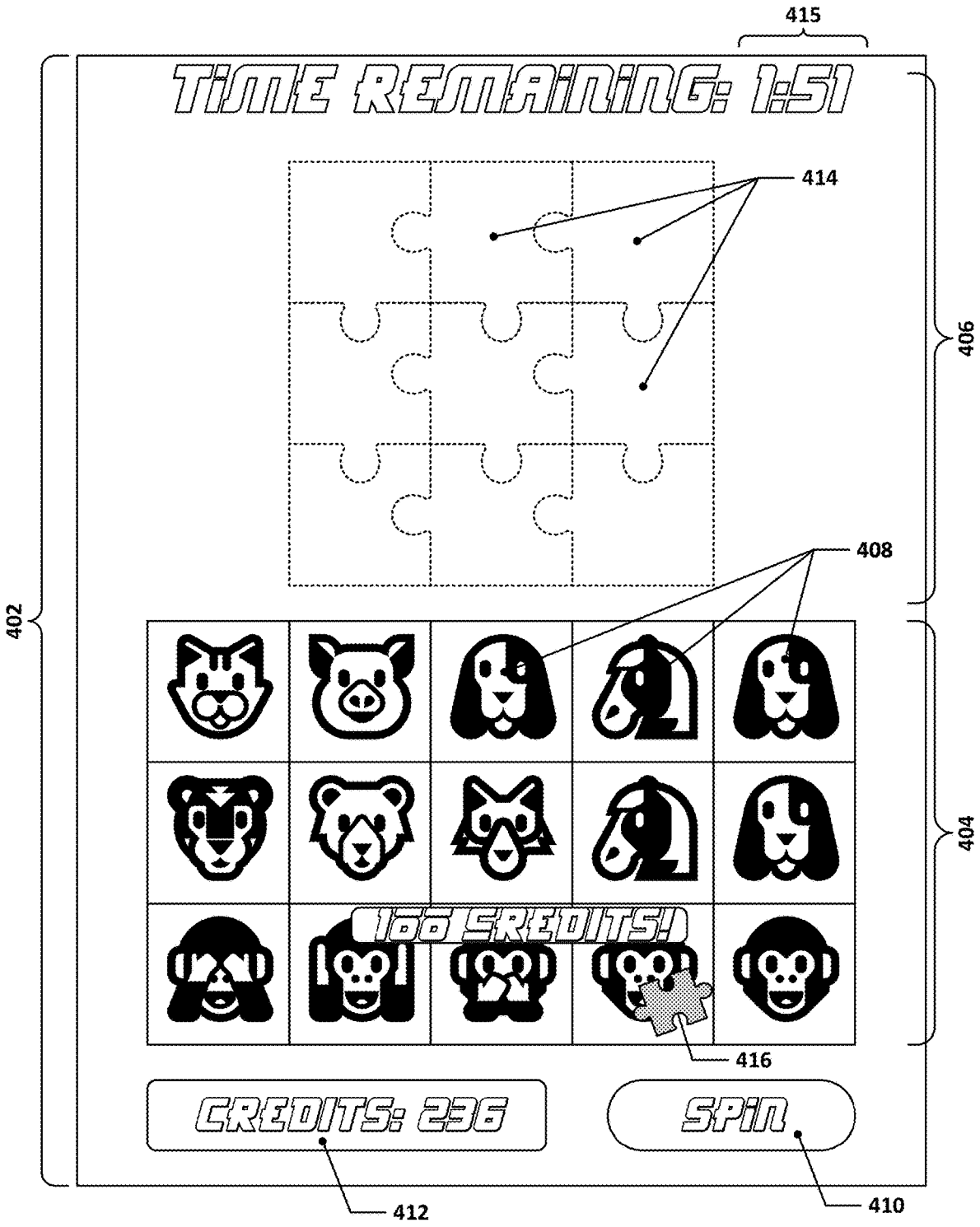

In FIG. 7, a further play of the game of chance has occurred while the first frenzy mode is active. In the depicted play of the game of chance, a first frenzy item symbol 416 has been displayed as part of the outcome. The first frenzy item symbol 416 is, in this example, a puzzle piece, although it will be recognized that the first frenzy item symbol 416 may take any of a variety of different forms. For example, the first frenzy item symbol may take the form of a particular graphical modification of one of the symbols of the game of chance, such as a symbol with a different color, animation effect, colored highlighting effect, etc. It will also be noted that this particular outcome also includes a winning pattern outcome, e.g., the bottom row contains five monkey symbols that result in a 100 credit win that causes the credit meter 412 to increment by 100 units.

As noted above, the number of obtained frenzy items may be incremented by the first value responsive to each display of a qualifying first frenzy item symbol as part of an outcome of the game of chance. A qualifying first frenzy item symbol is a first frenzy item symbol that causes the number of obtained frenzy items to be incremented by a first value when the qualifying first frenzy item symbol is displayed as part of an outcome of the game of chance.

For example, in some implementations, any first frenzy item symbol that is displayed as part of an outcome of the game of chance is deemed to be a "qualifying" first frenzy item symbol. However, in other implementations, there may be additional criteria that need to be met in order to increment the number of obtained frenzy item symbols.

For example, if the featured set of frenzy items is presented in the form of a set of puzzle pieces, the first frenzy items symbols may each be specific to a different one of those puzzle pieces. In the event that a particular first frenzy item symbol is displayed as part of an outcome after the frenzy item corresponding thereto has already been obtained (e.g., as a result of that first frenzy item symbol being displayed in conjunction with an earlier play of the game), the subsequent display of that same first frenzy item symbol may be deemed to not be a qualifying first frenzy item symbol.

Alternatively, the game of chance may be configured to limit the number of frenzy items that may be obtained for any given play of the game of chance, e.g., to permit only a single frenzy item to be obtained for any given play of the game of chance regardless of how many first frenzy item symbols are displayed as part of the outcome of that play of the game of chance. In such an implementation, only one of the displayed first frenzy item symbols may be deemed to be a qualifying first frenzy item symbol and result in the number of obtained frenzy items being incremented by the first value, while the other displayed first frenzy item symbols may be deemed to be non-qualifying first frenzy item symbols and not result in any incrementing of the number of obtained frenzy item symbols.

The incrementation of the number of obtained frenzy items may be depicted in a variety of ways. In the depicted implementation, the total number of frenzy items in the featured set of frenzy items is represented by first graphical indicators 414 of individual puzzle pieces, e.g., one puzzle piece for each frenzy item in the featured set of frenzy items. The featured set of frenzy items in this example includes nine frenzy items. The number of obtained frenzy items in such an implementation may be indicated by the number of such graphical puzzle pieces that are displayed in a different graphical format, e.g., with a portion of an image that is formed by all of the puzzle pieces that is contained within the boundaries of a particular puzzle piece filled in, as second graphical indicators. In other implementations, however, the number of frenzy items in the featured set of frenzy items may be represented in another manner, e.g., simply as a number. In such other implementations, the number of frenzy items that have been obtained may be similarly represented as a number, e.g., "2 of 9 frenzy items obtained." In another implementation, the frenzy items in the set of featured frenzy items may be individually represented by separate graphical objects, but such graphical objects may be the same (as compared to the puzzle pieces of FIG. 7, which are different shapes and which each have different portions of a larger graphic associated therewith). For example, each frenzy item may be represented by a pie segment of a set of identically sized pie segments, and the number of obtained frenzy items may be indicated by formatting the corresponding pie segments in a manner different from how the other pie segments are formatted.

It will be understood that the featured set of frenzy items may be either a relatively generic set of frenzy items, e.g., all identical and/or all interchangeable with one other or simply an abstract item, such as a number, or may be a set of potentially differentiated frenzy items, e.g., representing different parts of a puzzle, having different portions of an image or animation displayed thereupon. In the latter case, some implementations may feature first frenzy item symbols that are specific to each such different frenzy item. However, in other implementations, the first frenzy item symbols may be non-specific to each different frenzy item, e.g., the display of a qualifying first frenzy item symbol may cause one of the frenzy items to be considered to have been obtained without any specific association being required between the qualifying first frenzy item symbol and the obtained frenzy item.

As can also be seen in FIG. 7, a first frenzy mode countdown timer 415 is shown that indicates the amount of the first time period that is remaining. In this particular example, the first time period is two minutes, and FIG. 7 shows the GUI after nine seconds of the first time period have elapsed. It will be understood that the first frenzy mode may be activated for any time period, e.g., 2 minutes, 3 minutes, 4 minutes, etc.

Figure 8:
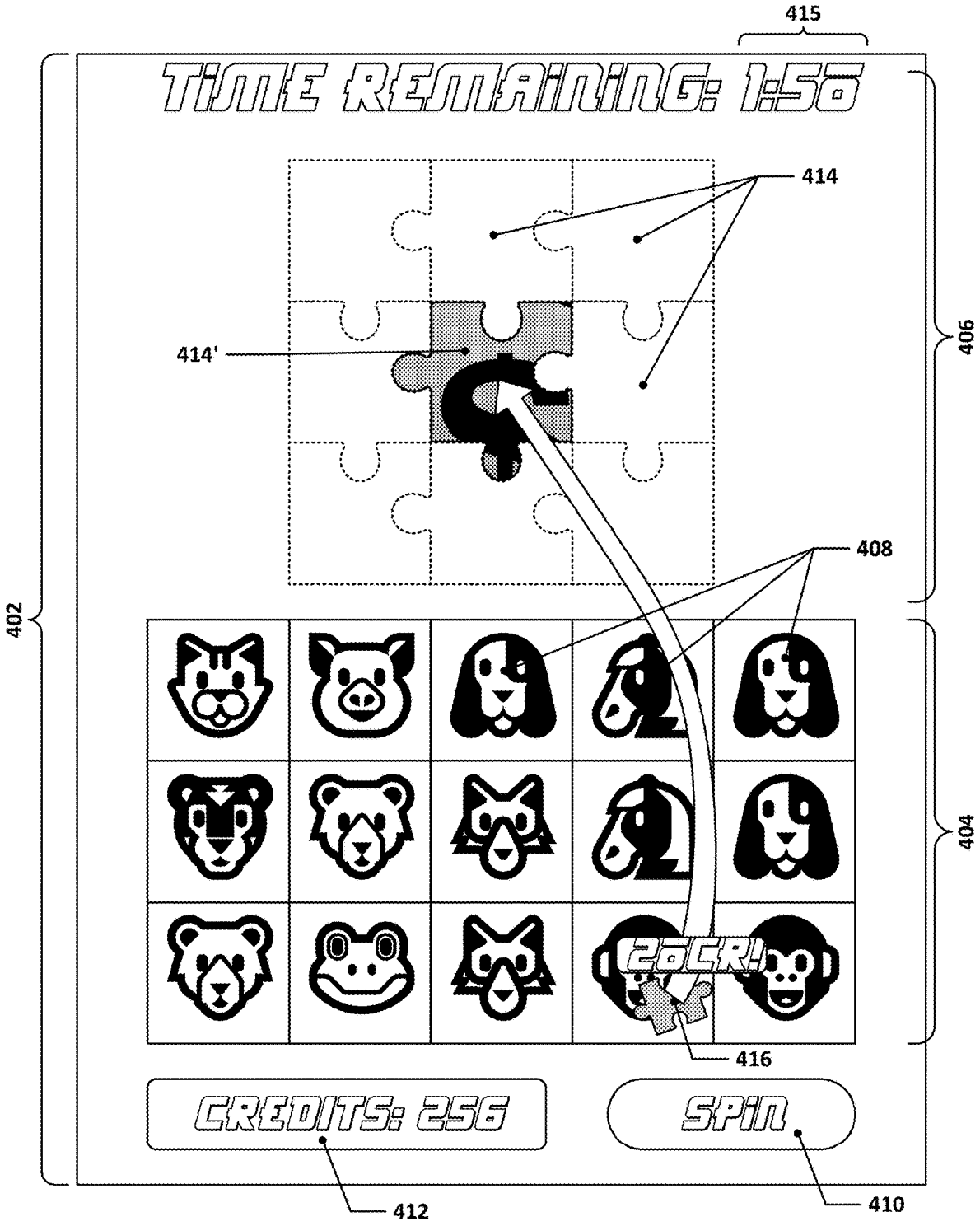

In FIG. 8, the electronic gaming machine has caused a first graphical indicator of the nine graphical indicators 414 to be changed to a second graphical indicator 414' to indicate that it is an obtained frenzy item. In this example, the first graphical indicators 414 are blank puzzle pieces with dotted outlines, while the second graphical indicator 414' is a puzzle piece with a fragment of a larger image on it and having a solid outline. Also shown in FIG. 8 is an indication that the display of the first frenzy item symbol has also resulted in an award of 20 additional credits that have been added to the credit meter 412. In the rest of this example, any displayed first or second frenzy item symbol results in an award of 20 additional credits, although in some implementations, no additional award may automatically occur in conjunction with any displayed first or second frenzy item symbol.

Figure 9:
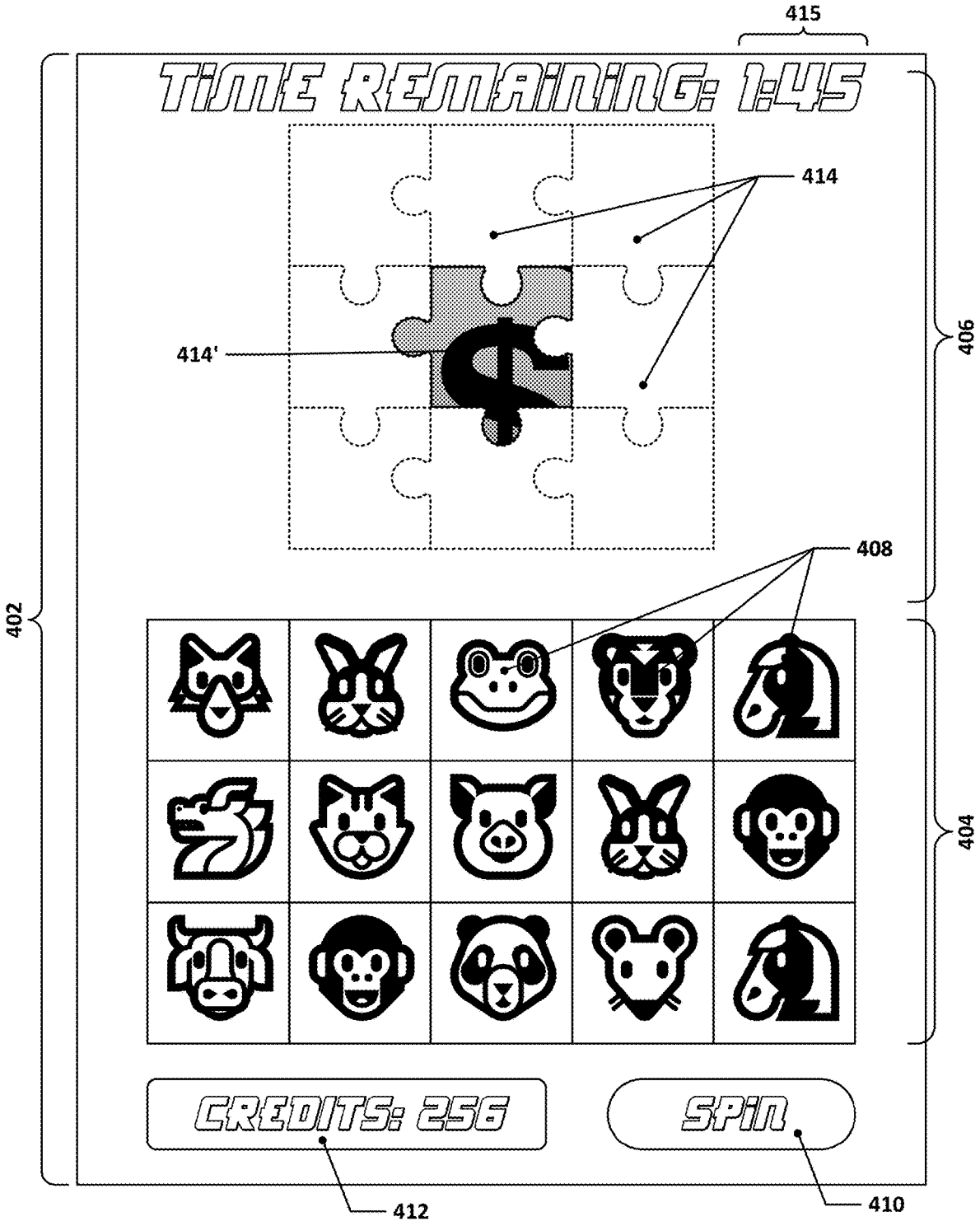

In FIG. 9, a further play of the game of chance has occurred without any first frenzy item symbol being displayed. Accordingly, no change to the frenzy items in the bonus game display area 406 has occurred from FIG. 8.

Figure 10:
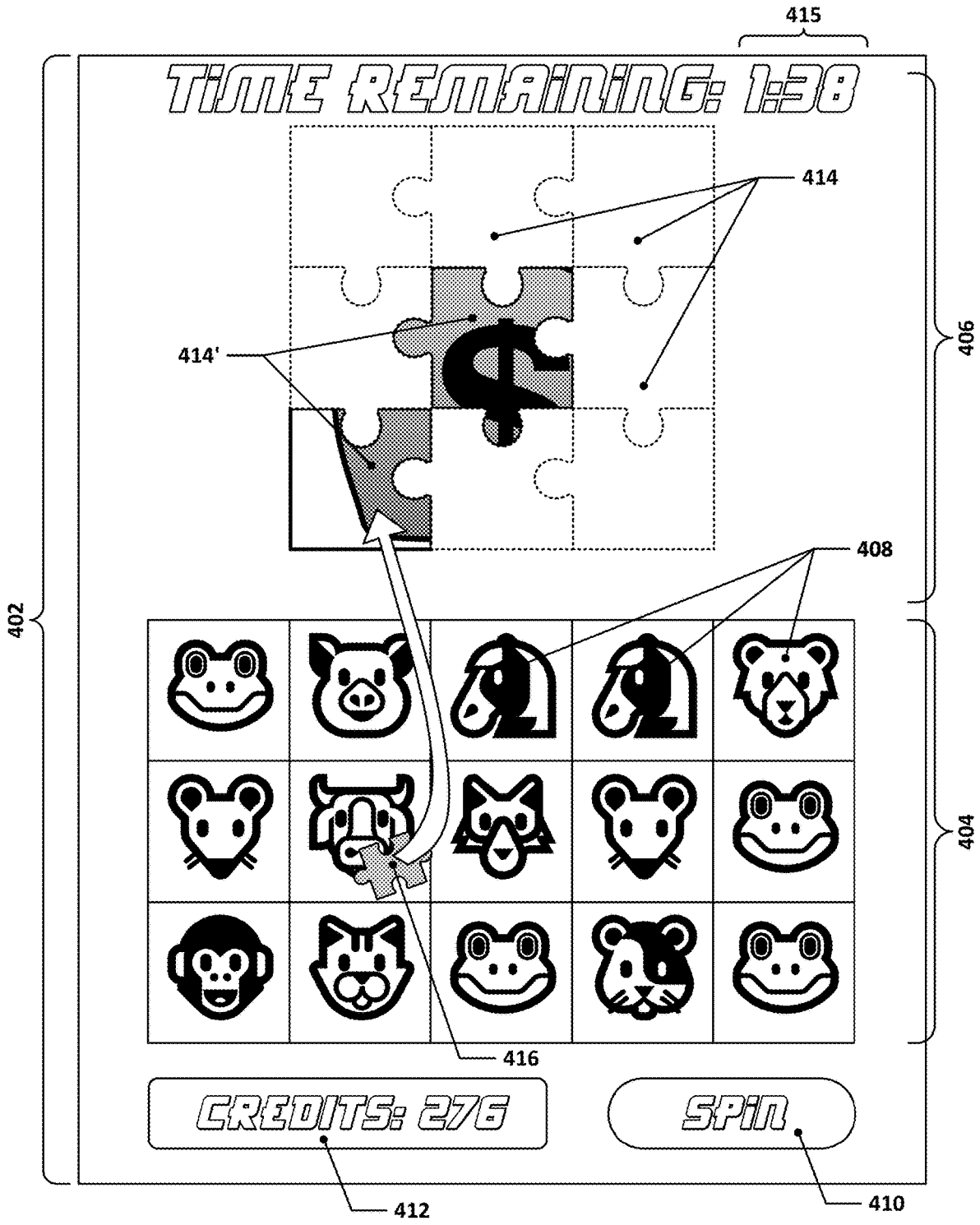

In FIG. 10, another first frenzy item symbol has been displayed as part of an outcome for the game of chance shown in the primary game display area 404. Accordingly, another first graphical indicator 414 has been changed to another second graphical indicator 414'; the number of obtained frenzy items is now equal to two.

Figure 11:
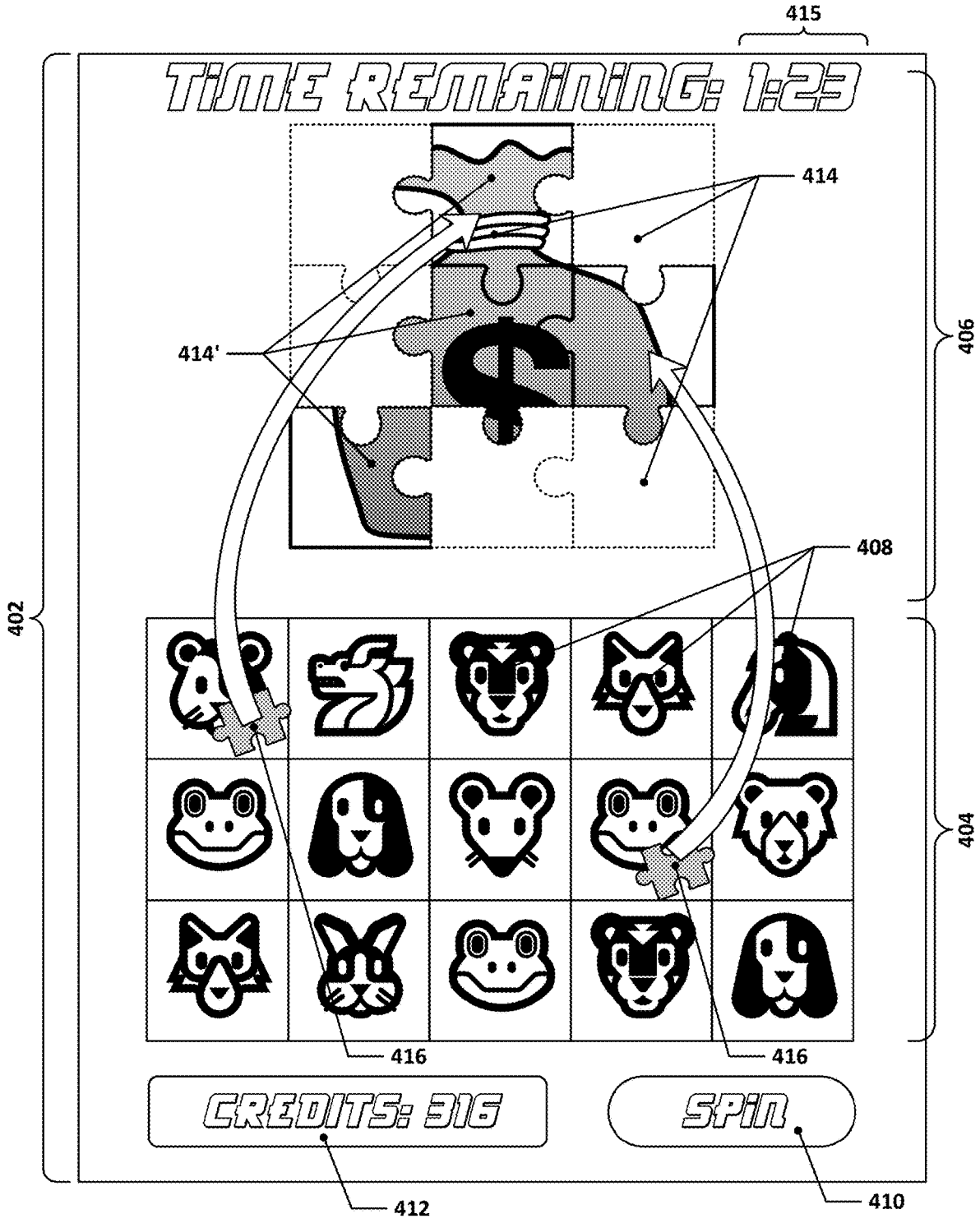

In some implementations, as shown in FIG. 11, the display of multiple first frenzy item symbols 416 in a single outcome of the game of chance may cause a corresponding number of frenzy items to be obtained. In FIG. 11, two first frenzy item symbols 416 are shown in the displayed outcome of the game of chance, and two more first graphical indicators 414 have been changed to second graphical indicators 414', thereby indicating that four frenzy items of the nine frenzy items in the featured set of frenzy items have been obtained.

Figure 12:
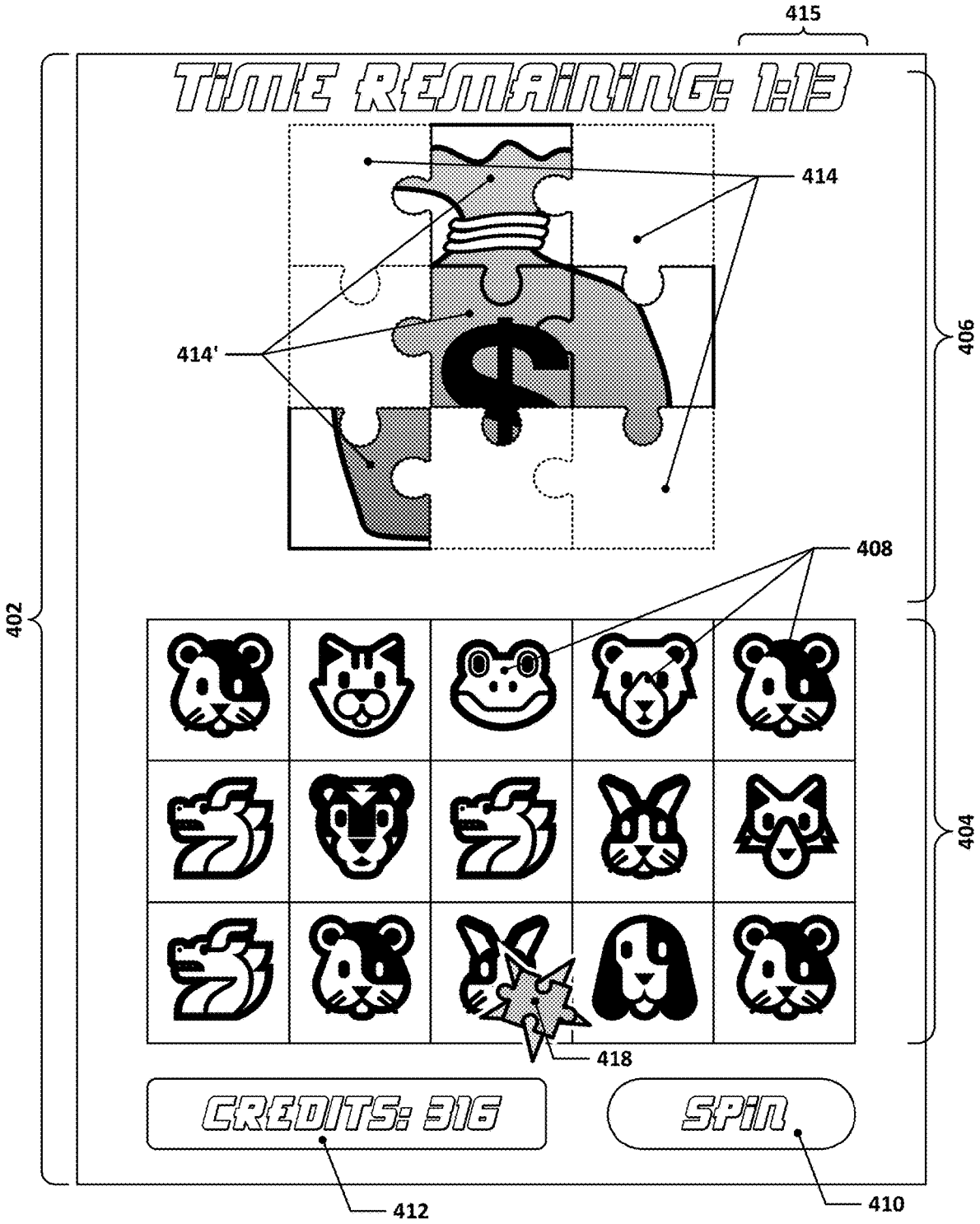

In FIG. 12, one or more additional plays of the game of chance have occurred, and the current play of the game of chance has resulted in an outcome that includes a second frenzy mode trigger symbol 418 that, when displayed, may cause a second frenzy mode to be initiated for a second time period. The second frenzy mode is, in effect, an enhancement of the first frenzy mode in which there is a possibility of second frenzy item symbols being displayed as part of the outcome of the game of chance presented for each play of the game of chance. The electronic gaming machine may, in response to each display of a second frenzy item symbol as part of an outcome of the game of chance, cause the number of obtained frenzy items to be incremented by a second value. For example, the electronic gaming machine may cause the number of obtained frenzy items to be incremented by a first value, e.g., one, for each first frenzy item symbol that is displayed in an outcome, but may cause the number of obtained frenzy items to be incremented by a second value, e.g., two, for each second frenzy item symbol that is displayed in an outcome. Generally speaking, the second value is a higher number than the first value. In the present example, the first value is one, and the second value is two. In other implementations, however, the second value may be two or three, or even higher. In some implementations, the second value may be variable, e.g., two for some second frenzy item symbols and three for other second frenzy item symbols.

As is likely apparent, the first frenzy mode is an operational mode of the game of chance in which making plays of the game of chance as quickly as possible may provide a heightened chance for obtaining additional winnings, as the first frenzy mode is time-limited. Thus, players playing electronic gaming systems that have an active first frenzy mode are likely to play quickly, with the intention of maximizing their chances of obtaining all of the frenzy items in the feature set of frenzy items and thus winning the prize associated therewith before the expiration of the first time period. The second frenzy mode is generally active for a much shorter time period, i.e., a sub-portion of the first time period. For example, if the first time period is two minutes, the second time period may be 10 seconds or 20 seconds. The second frenzy mode may introduce an additional level of excitement for players, and may cause them to engage in even more frequent game play of the game of chance in the second time period (as compared with in the first time period) in the hopes of obtaining additional frenzy items as a result of their plays (and having such additional frenzy items be obtained at a greater rate due to the difference between the first and second values).

A game of chance that is in the second frenzy mode may, in some implementations, be configured to potentially show first and/or second frenzy item symbols as part of any given outcome. In other implementations, when the game of chance is in the second frenzy mode, the game of chance may be alternatively be configured to potentially show only the second frenzy item symbols as part of an outcome (suspending potential display of a first frenzy item symbol as part of an outcome until after the second time period has expired).

Electronic gaming systems offering frenzy mode game play as discussed herein may be configured to handle the situation in which a second frenzy mode initiates late enough in the first time period of the first frenzy mode that the second time period of the second frenzy mode would extend beyond the end of the first time period in different ways. In some implementations, the electronic gaming system may cause the second frenzy mode to terminate contemporaneously with the first time period, e.g., the second time period may be set to a value that equals the amount of time remaining in the first time period at the time the second frenzy mode is activated. In other implementations, the first frenzy mode may be extended so as to terminate simultaneously with the second time period of the second frenzy mode. In yet other implementations, the first frenzy mode may terminate at the end of the first time period, and the second frenzy mode may simply continue until the end of the second time period some time later.

While the second frenzy mode is initiated in FIG. 12 responsive to the second frenzy mode trigger symbol 418 being displayed as part of the outcome of the game of chance, it will be understood that any suitable trigger conditions may cause the second frenzy mode to be initiated, e.g., a particular combination of symbols in the primary game display area 404 occurring, a particular symbol being shown in the primary game display area 404, etc.

Figure 13:
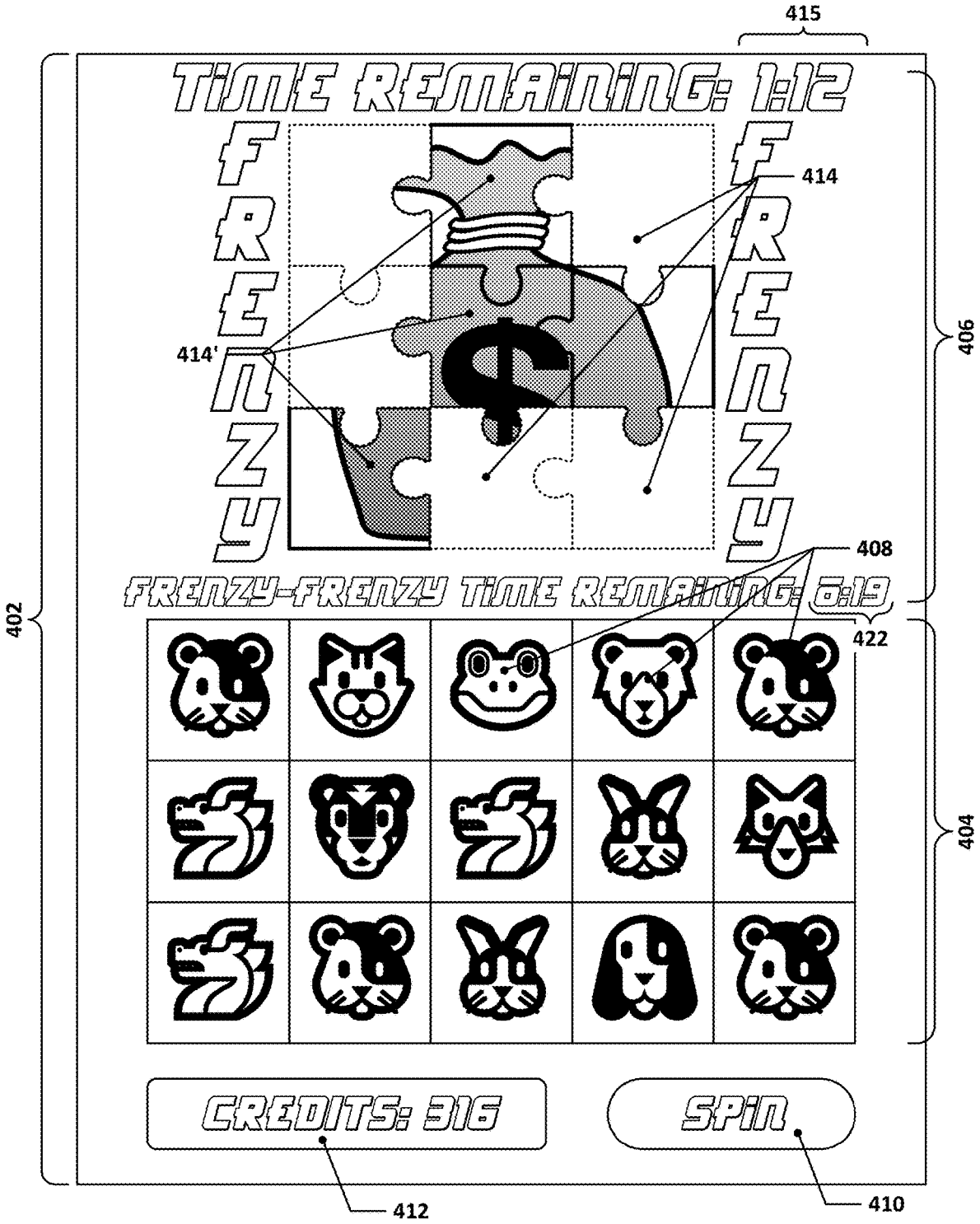

FIG. 13 depicts the GUI immediately after the second frenzy mode has been activated (in this example, the second frenzy mode is active during a second time period that has a length of 20 seconds). A second frenzy mode countdown timer 422 is shown that indicates the amount of time remaining in the second time period during which the second frenzy mode is active. In this particular case, the second frenzy mode (which may also be referred to herein as "frenzy-frenzy" mode) has 19 seconds left in which it will be active. The GUI 402 may also optionally provide additional indications that the second frenzy mode is active, e.g., by displaying the word "frenzy" along both sides of the portion of the bonus game display area that is used to display the first and second graphical indicators 414 and 414', for example.

Figure 14:
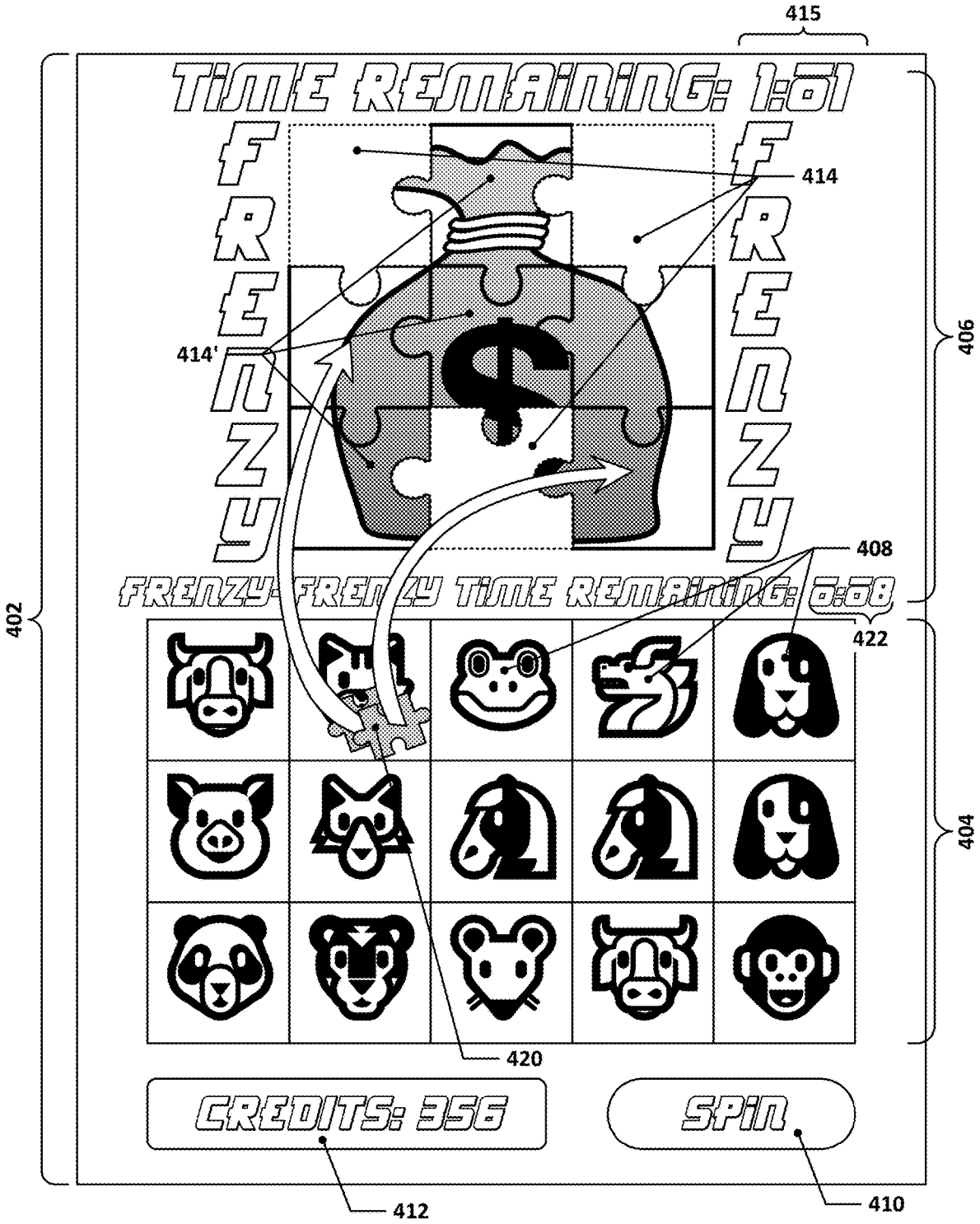

FIG. 14 depicts the GUI after 12 seconds of the second time period have elapsed, e.g., in which 8 seconds of the second time period are remaining in this example. One or more plays of the game of chance may have occurred in between FIGS. 13 and 14, but in FIG. 14, the outcome of the game of chance that is displayed has a second frenzy item symbol 420 displayed. The electronic gaming system that provides the GUI 402 may, responsive to the display of the second frenzy item symbol 420 being displayed, cause the number of frenzy items that have been obtained to be incremented by the second value. In this particular example, the second value is two, and two additional first graphical indicators 414 (indicated by the arrows from the second frenzy item symbol 420) have been changed to second graphical indicators 414' to indicate the increment of the number of obtained frenzy items from four to six.

Figure 15:
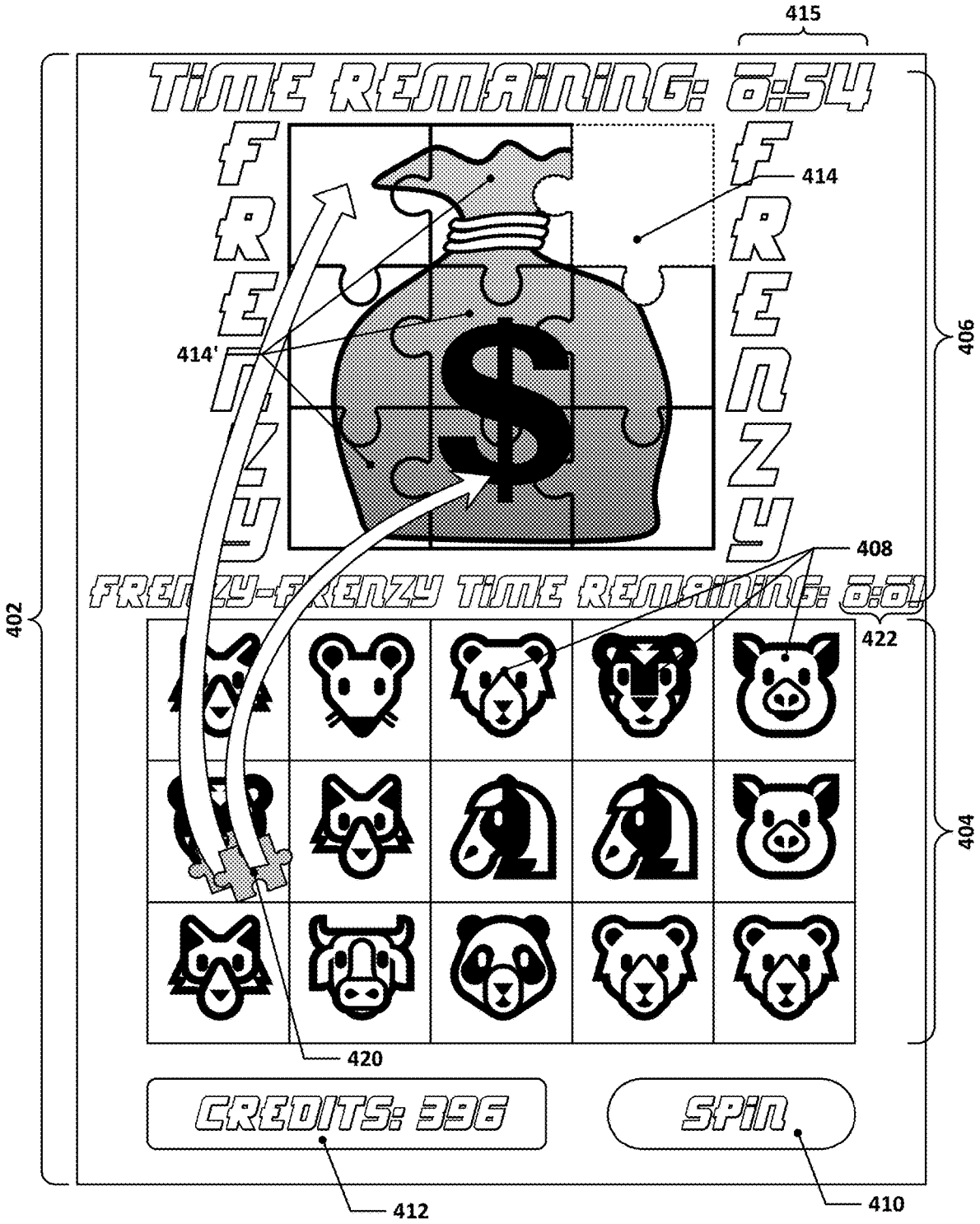

In FIG. 15, the second frenzy mode is nearly complete, and the most recent game of chance outcome that is displayed in the GUI 402 includes a further second frenzy item symbol 420, resulting in the electronic gaming system that provides the game of chance incrementing the number of frenzy items that have been obtained by the second value again. In this example, the incrementing of the number of obtained frenzy items is indicated by the replacement of two of the first graphical indicators 414 with another two of the second graphical indicators 414'. At this point, eight of the nine graphical indicators representing the featured set of frenzy items are second graphical indicators 414', and the featured set of graphical indicators is nearly complete.

Figure 16:
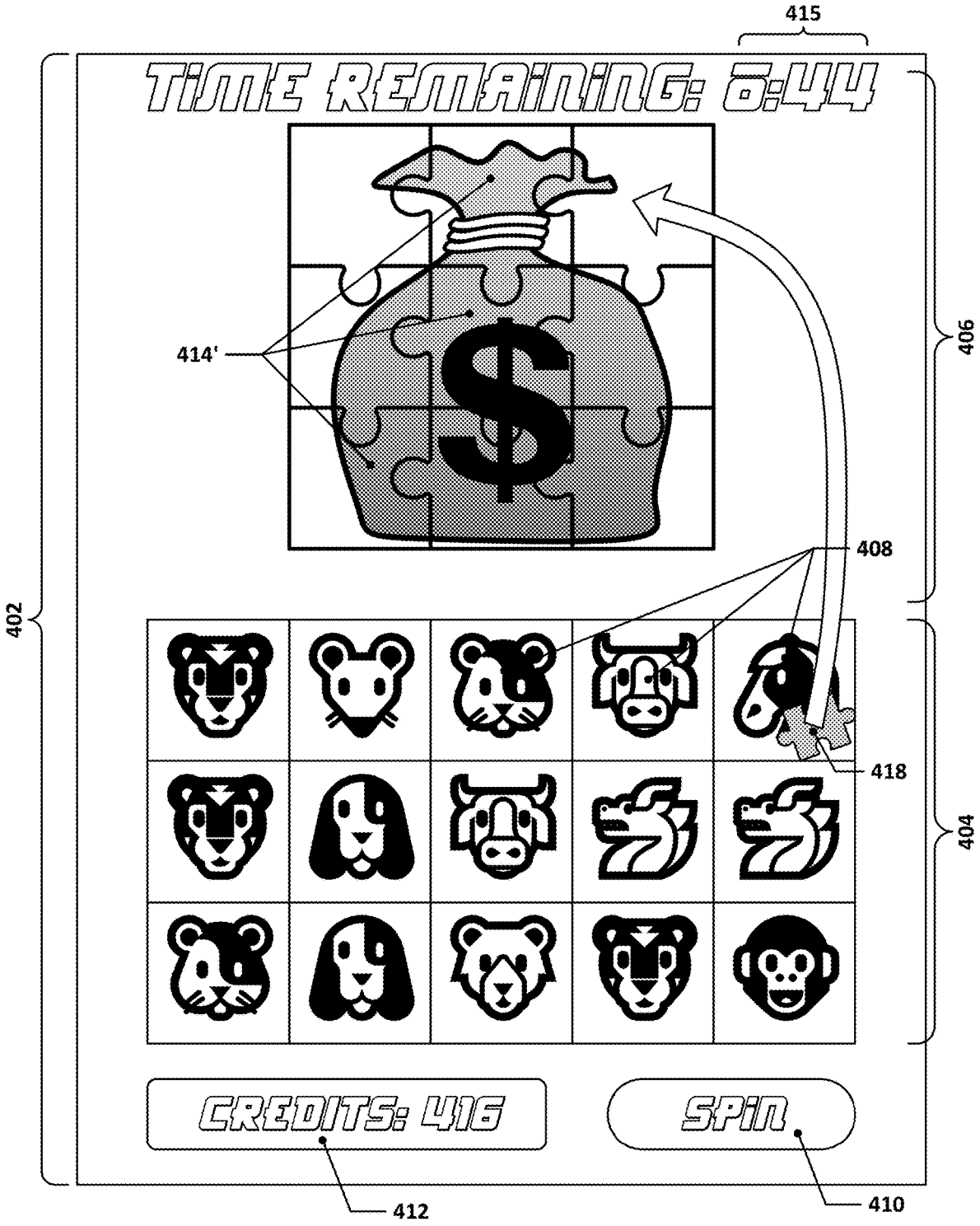

In FIG. 16, the second frenzy mode has expired and is no longer active. One or more plays of the game of chance may have occurred in between FIGS. 15 and 16, but in FIG. 16, the outcome of the game of chance that is displayed has a first frenzy item symbol 418 displayed. The electronic gaming system that provides the GUI 402 may, responsive to the display of the first frenzy item symbol 418 being displayed, cause the number of frenzy items that have been obtained to be incremented by the first value. In this particular example, this causes the number of obtained frenzy items to equal the number of frenzy items in the featured set of frenzy items (nine frenzy items in this example).

Figure 17:
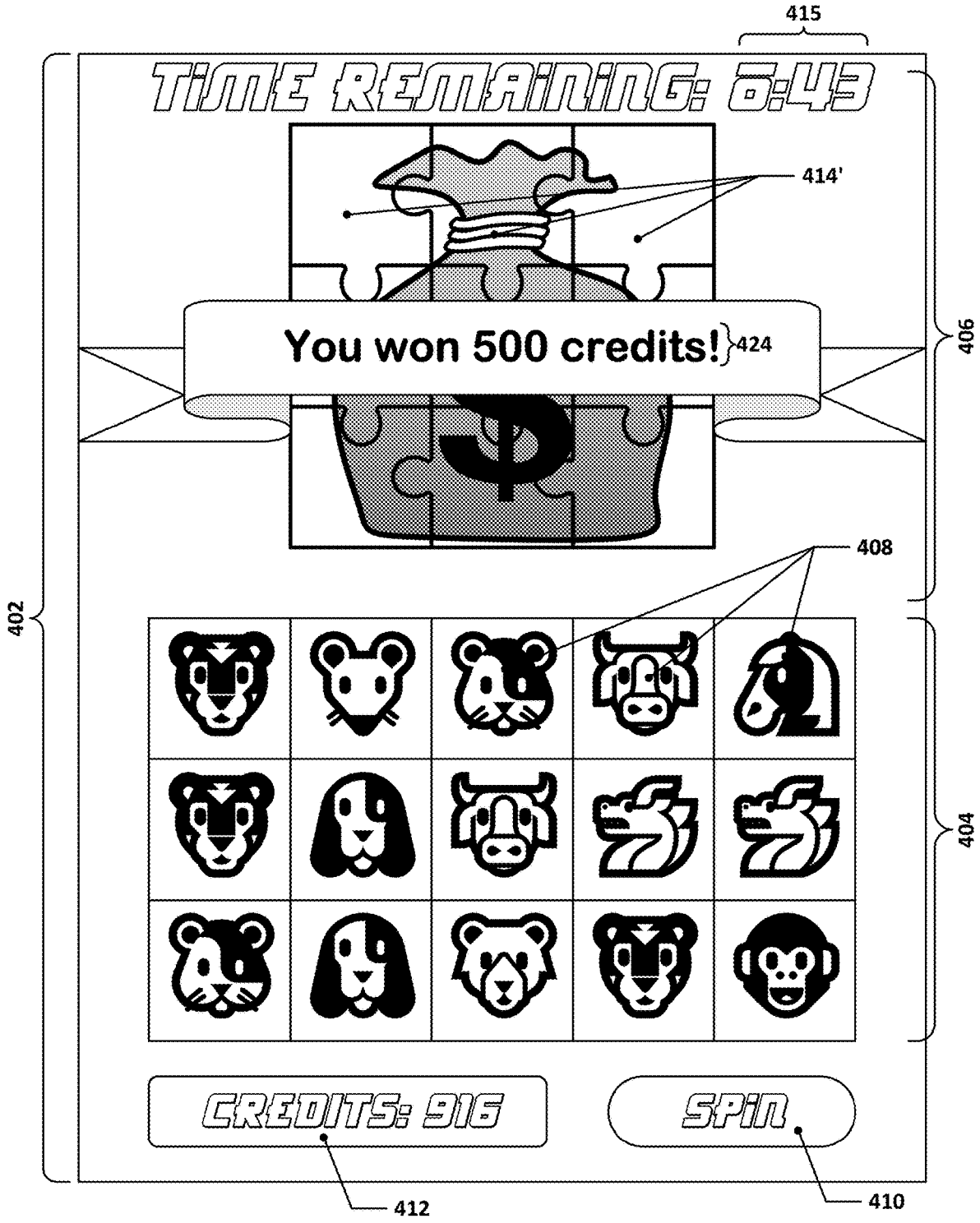

In FIG. 17, the GUI 402 has been updated to provide a notification 424 that indicates that a featured set prize has been awarded due to the number of obtained frenzy items equaling the number of frenzy items in the featured set of frenzy items. In this example, the featured set prize is 500 credits, but other implementations may feature other featured set prizes of other amounts. As can be seen, there is still time remaining in the first time period, as indicated by the first frenzy mode countdown timer 415, after the number of obtained frenzy items has been determined to equal the number of frenzy items in the featured set of frenzy items. In such a situation, a new set of frenzy items may be selected as the featured set of frenzy items, as indicated in FIG. 18.

Figure 18:
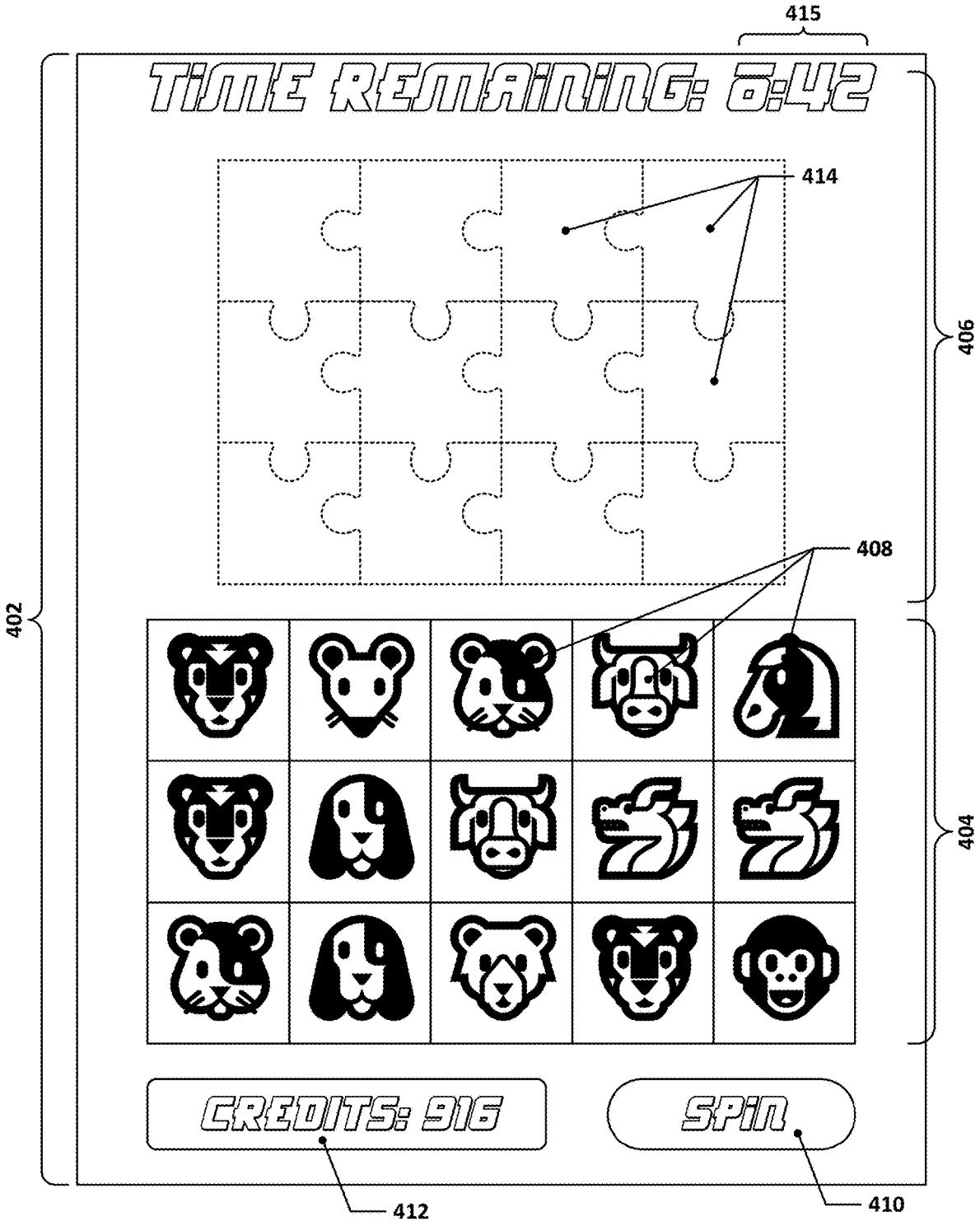

In FIG. 18, the featured set of frenzy items has been replaced with a new featured set of frenzy items. The new featured set of frenzy items has a total of twelve frenzy items therein, represented, in this example, by first graphical indicators 414 of twelve puzzle pieces. The number of obtained frenzy items may, in conjunction therewith, be reset, e.g., to zero. In some implementations, the number of frenzy items obtained may be reset to a value greater than zero, e.g., a player may be given a new featured set of frenzy items with some of the frenzy items already "obtained." Regardless, the number of frenzy items obtained will be reset to a value less than the number of frenzy items in the new featured set of frenzy items.

Figure 19:
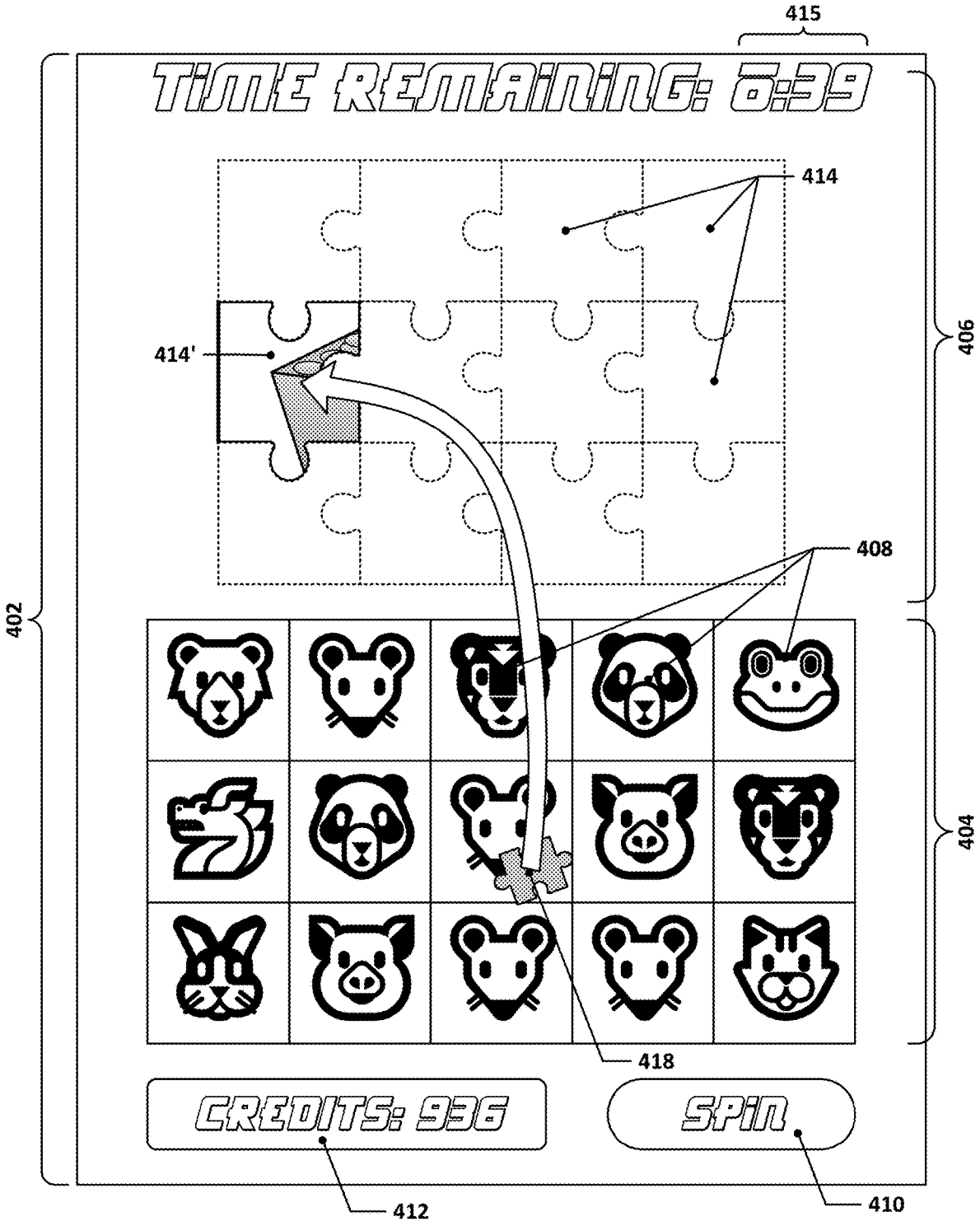

In FIG. 19, an outcome for the game of chance has been displayed that includes another first frenzy item symbol 418. The electronic gaming system that provides the game of chance may then, responsive to the display thereof, cause the number of obtained frenzy items to be incremented by the first value. To indicate such an increment of the number of obtained frenzy items, one of the first graphical indicators 414 has been changed to a second graphical indicator 414'.

Figure 20:
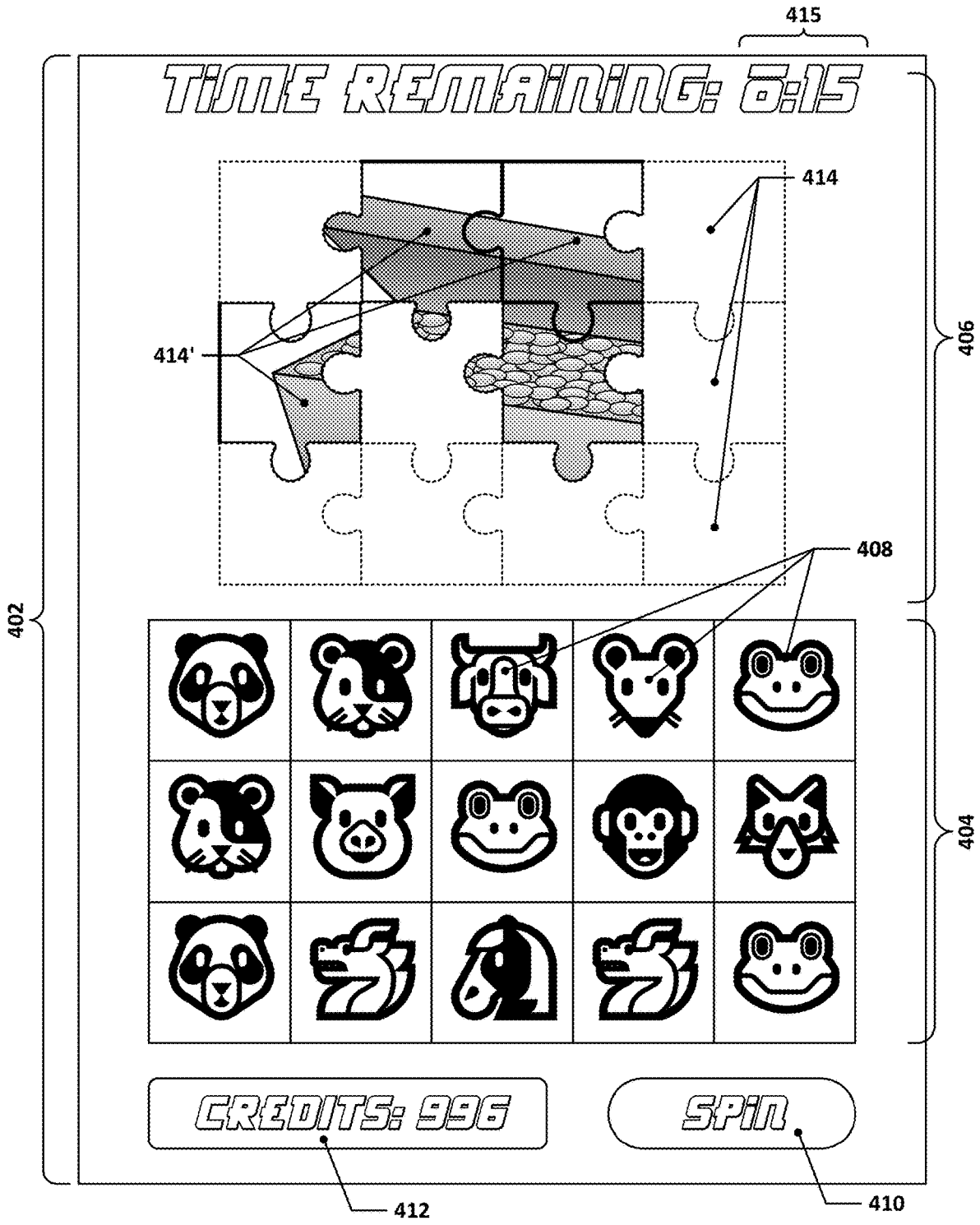

In FIG. 20, the GUI 402 is shown with 15 seconds left in the first time period. At this point, the four frenzy items of the featured set of twelve frenzy items have been obtained, as indicated by the second graphical indicators 414' shown in the bonus game display area 406.

Figure 21:
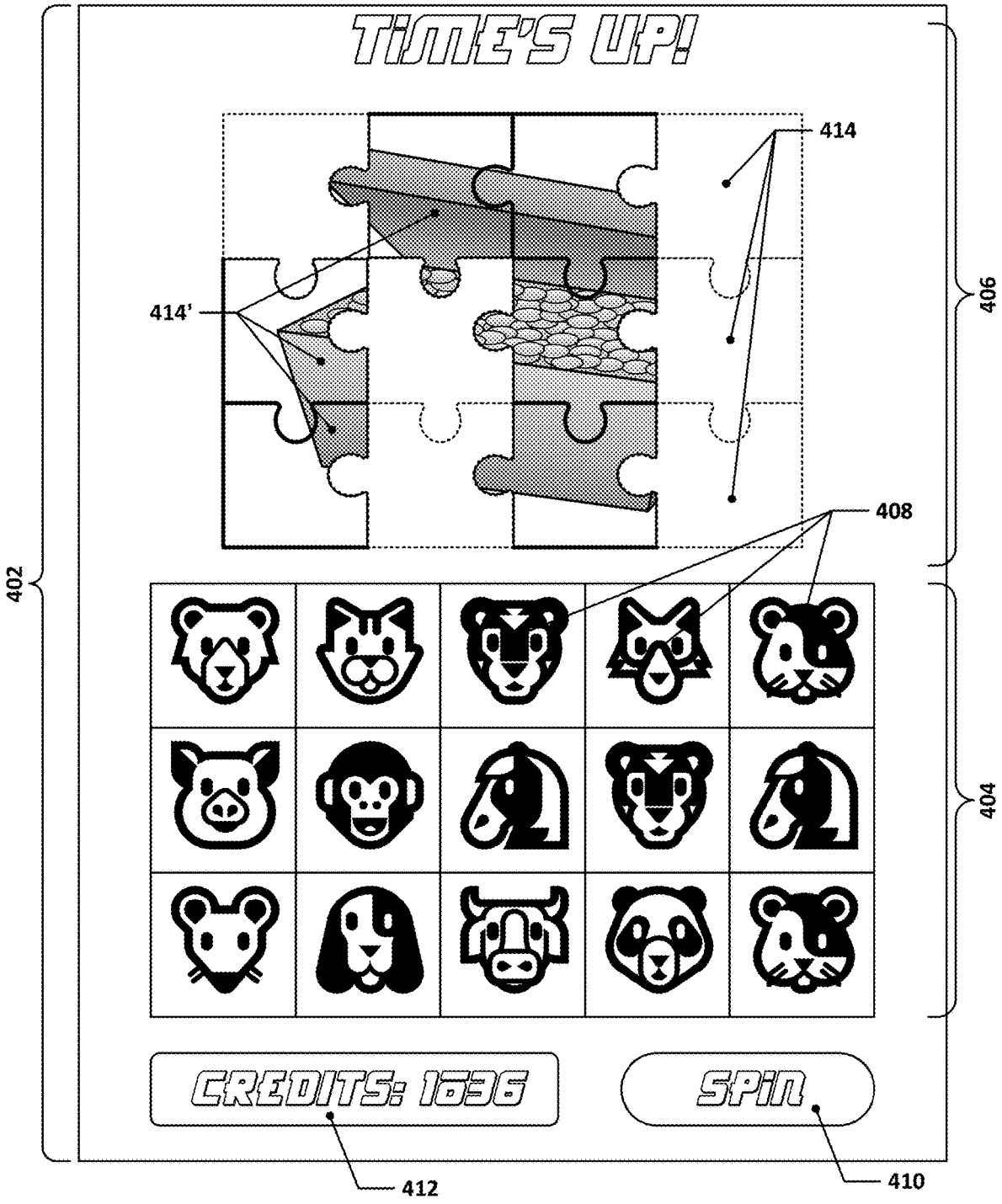

In FIG. 21, the GUI 402 is shown as the first time period expires—the first frenzy mode countdown timer 415 has been replaced with a notification of "Time's Up!" to indicate that the first frenzy mode has terminated. At the completion of the first frenzy mode in this example, six frenzy items have been obtained, leaving the other six frenzy items in the featured set of frenzy items unobtained.

In some implementations, the conclusion of the first frenzy mode may simply cause normal play of the game of chance to resume without any further operations occurring. Thus, whatever credits may have been won during the first frenzy mode (and second frenzy mode, if it occurs) may be retained at the end of the first frenzy mode, and the first frenzy mode may simply cease. In other implementations, however, the player of the game of chance may be provided with an opportunity to potentially obtain the remaining unobtained frenzy items in order to completely obtain the frenzy items in the featured set of frenzy items and thus win the featured set prize for that featured set of frenzy items.

Figure 22:
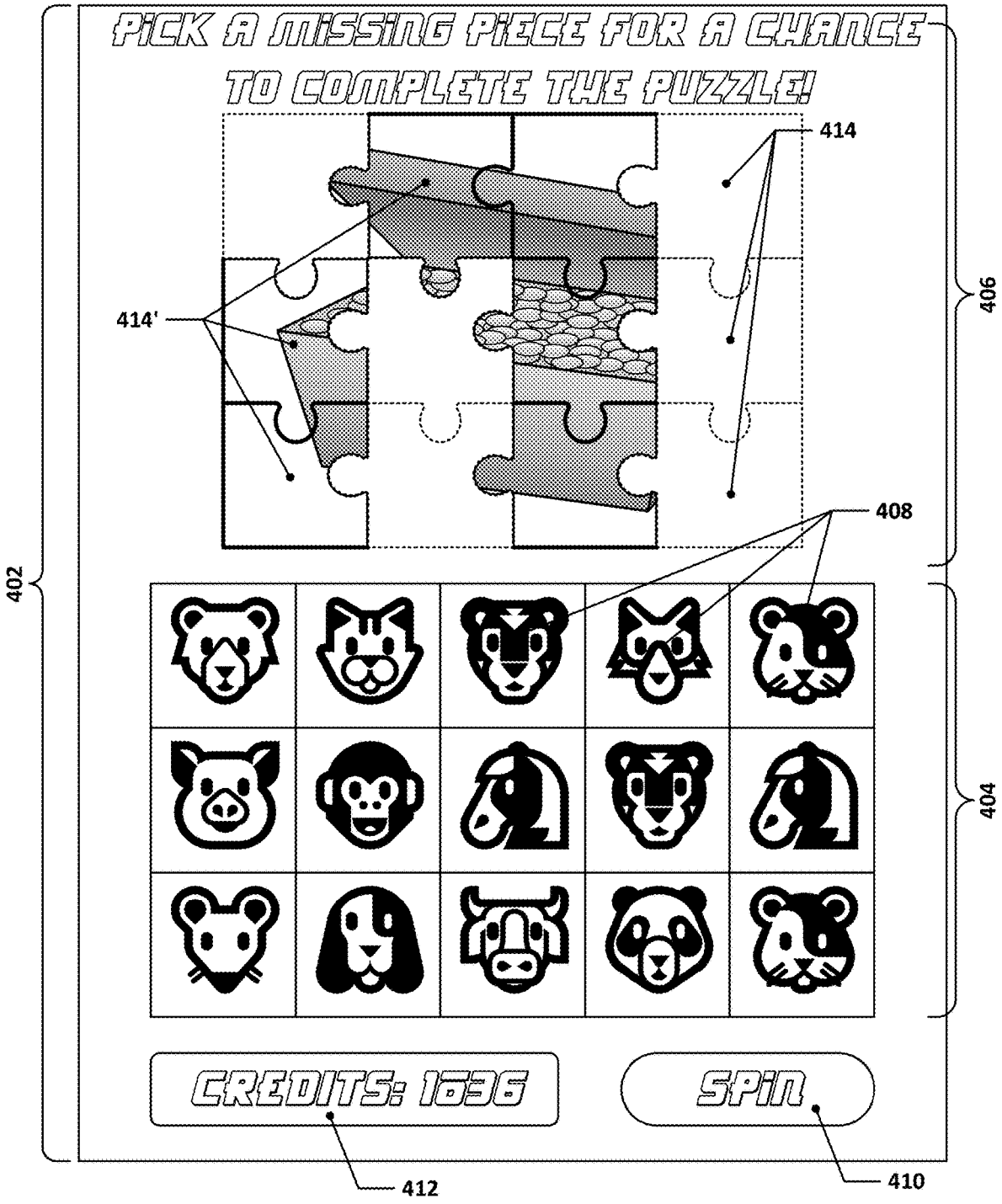

For example, in FIG. 22, the GUI 402 has provided a notification to the player to select one of the first graphical indicators 414 (the "missing pieces" of the puzzle) for a chance to complete the puzzle. For example, one or more of the first graphical indicators 414 may be associated with a successful chance of obtaining the remaining unobtained frenzy items, while the remainder of the first graphical indicators 414 may be associated with an unsuccessful chance of obtaining the remaining frenzy items. When the player provides, e.g., via a touch-screen input, a selection of one of the first graphical indicators 414, the electronic gaming system may determine whether the selected first graphical indicator 414 corresponds with either the successful chance or one of the successful chances of obtaining the remaining frenzy items or, if present, the unsuccessful chance or chances of obtaining the remaining frenzy items (if only one first graphical indicator 414 is present at this stage, then there may not be any first graphical indicator that is associated with an unsuccessful chance of obtaining the remaining unobtained frenzy items. Alternatively, the various first graphical indicators may not be pre-assigned any association with a successful chance of obtaining the remaining unobtained frenzy items, or an unsuccessful chance of obtaining the remaining frenzy items. Instead, a random determination—based on the number of unobtained frenzy items of the featured set of frenzy items—may be made as to whether or not the player, after selecting one of the first graphical indicators 414, made a selection that results in successfully or unsuccessfully obtaining the remaining unobtained frenzy items. The random determination that is used to determine whether or not the player successfully or unsuccessfully obtained the remaining unobtained frenzy items may be, for example, made according to a weighted random selection that factors into account the number of unobtained frenzy items. For example, if there are two unobtained frenzy items, the random determination that is made as to whether or not the player successfully obtained the remaining unobtained frenzy items may be configured such that the player would, on average, win 50% of the time. If there are three unobtained frenzy items, the random determination may similarly be configured such that the player would, on average, win 33% of the time, and so forth.

Figure 23:
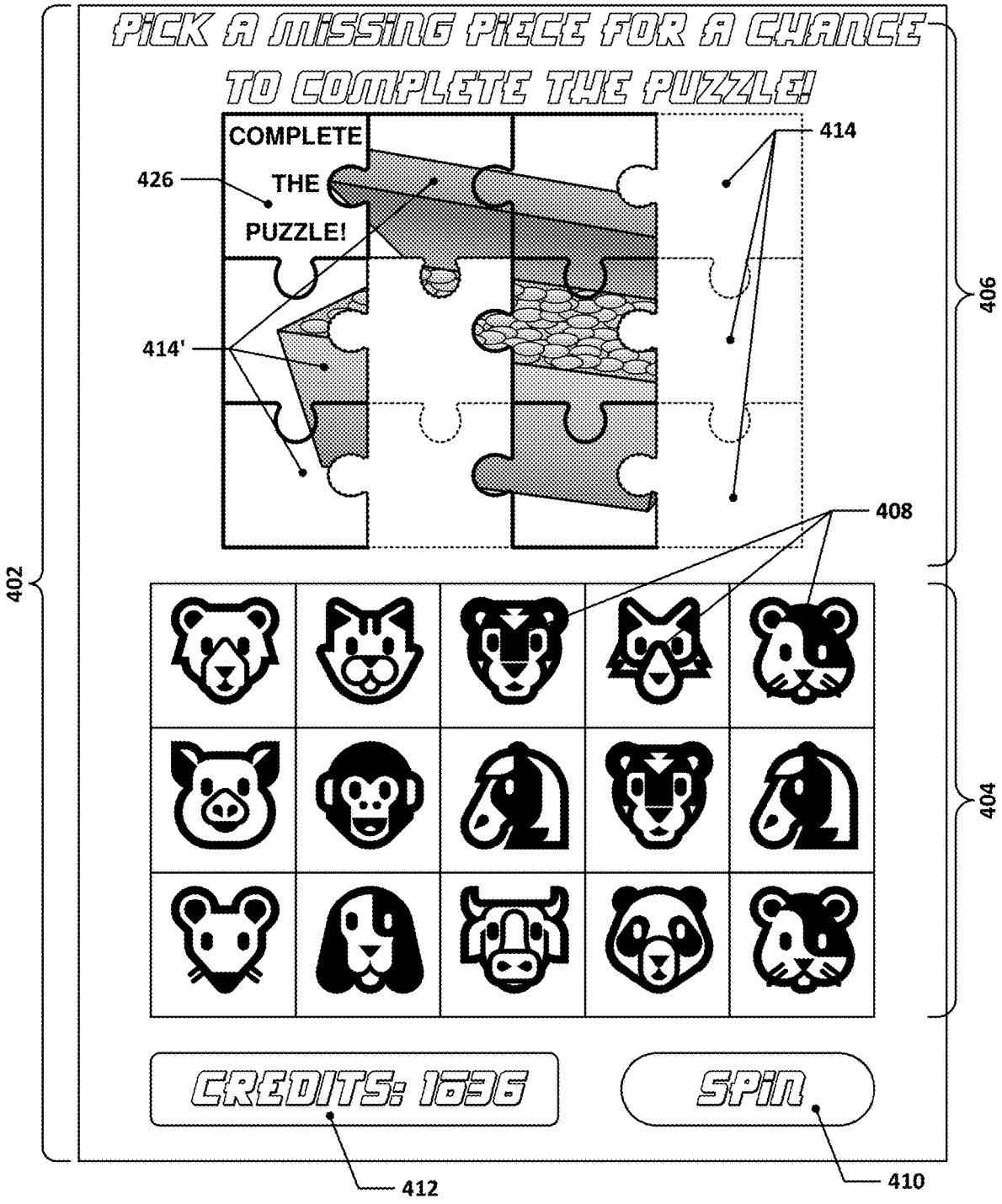

In FIG. 23, a player input has been received that indicates that the player has selected the first graphical indicator 414 that is in the upper left corner of the array of first and second graphical indicators. Responsive to this selection, the electronic gaming system that provides the game of chance has determined that the player has made a selection that will result in the player successfully obtaining the remaining unobtained frenzy items. To inform the player of this determination, a notification of success 426 is caused to be shown in place of the selected first graphical indicator 414.

Figure 24:
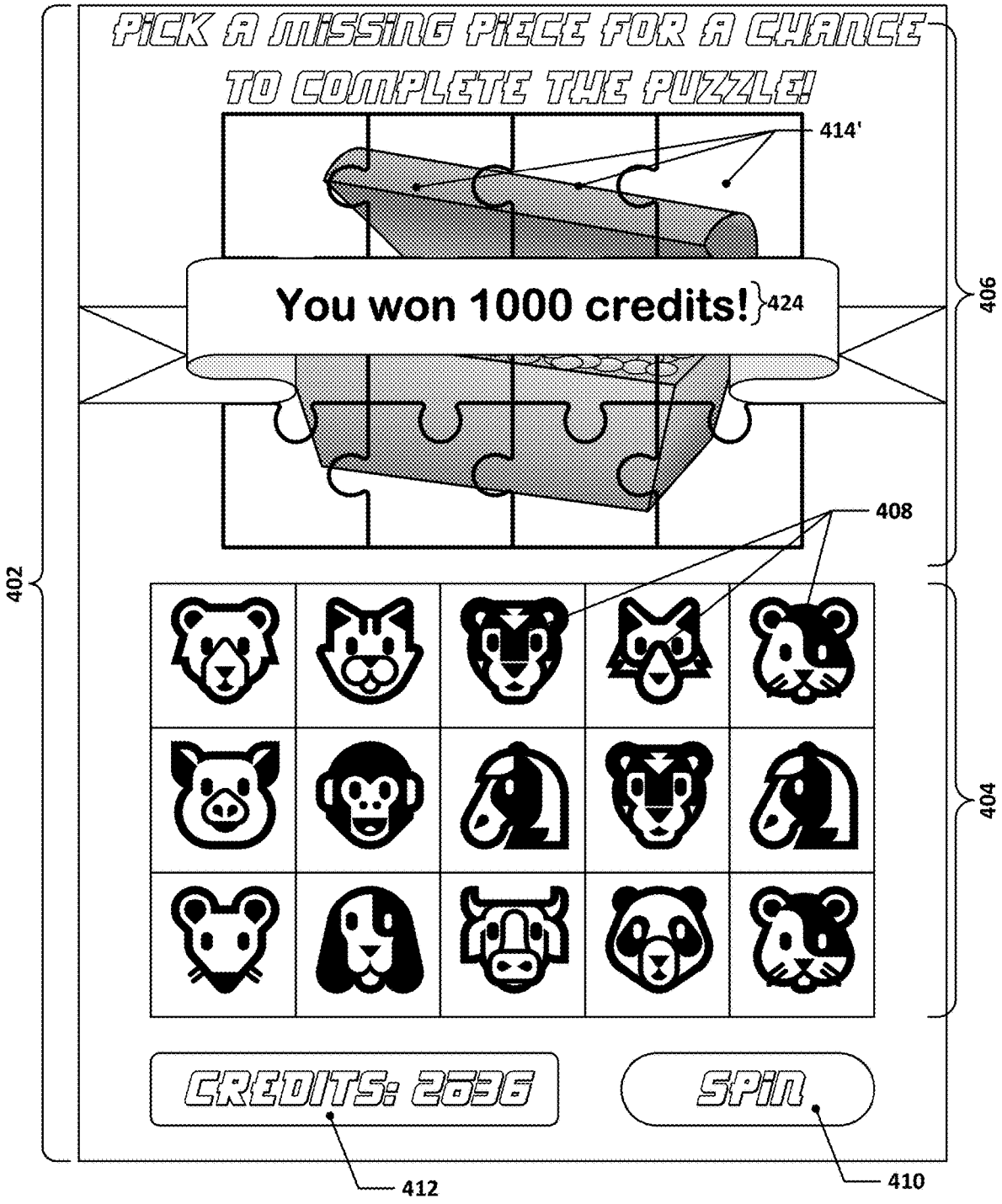

In FIG. 24, the remaining first graphical indicators 414 have been replaced with second graphical indicators 414' to indicate that the complete featured set of frenzy items has been obtained. Additionally, the notification 424 that indicates that a featured set prize has been awarded due to the number of obtained frenzy items equaling the number of frenzy items in the featured set of frenzy items has been caused to be displayed. In this example, the featured set prize that is awarded is 1000 credits, which is higher than that awarded responsive to the player obtaining all of the frenzy items in the previous featured set of frenzy items—this may reflect the increased difficulty of obtaining all twelve of the frenzy items in the featured set of frenzy items as compared with the nine frenzy items in the previous featured set of frenzy items.

In some such implementations, when a player makes a selection of a first graphical indicator 414 that does not result in successfully obtaining the remaining unobtained frenzy items in the featured set of frenzy items, the electronic gaming machine that provides the game of chance may simply resume normal play of the game of chance, e.g., without any further awards relating to the first frenzy mode other than what the player earned during the first (and, if applicable, second) frenzy mode. In other such implementations, however, the electronic gaming machine may be configured to present the player, responsive to making such an unsuccessful selection of one of the first graphical indicators 414, with a "consolation prize." FIG. 25 depicts an alternate scenario from FIGS. 23 and 24 in which the player makes an unsuccessful selection of a first graphical indicator.

Figure 25:
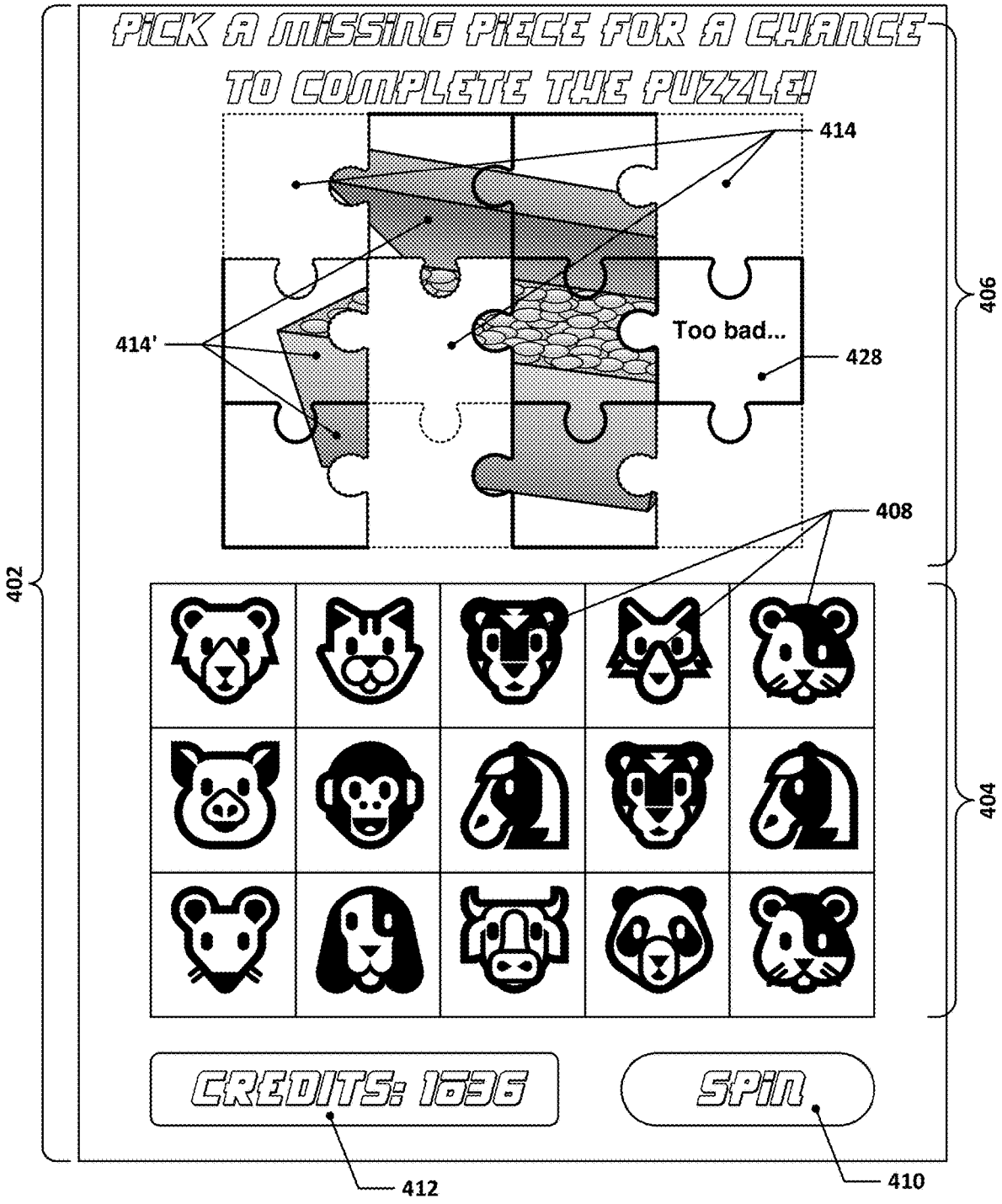

In FIG. 25, a player input has been received that indicates that the player has selected the middle graphical indicator 414 along the right side of the array of first and second graphical indicators. Responsive to this selection, the electronic gaming system that provides the game of chance has determined that the player has made a selection that will result in the player being unsuccessful in obtaining the remaining unobtained frenzy items. To inform the player of this determination, a notification of failure 428 is caused to be shown in place of the selected first graphical indicator 414.

Figure 26:
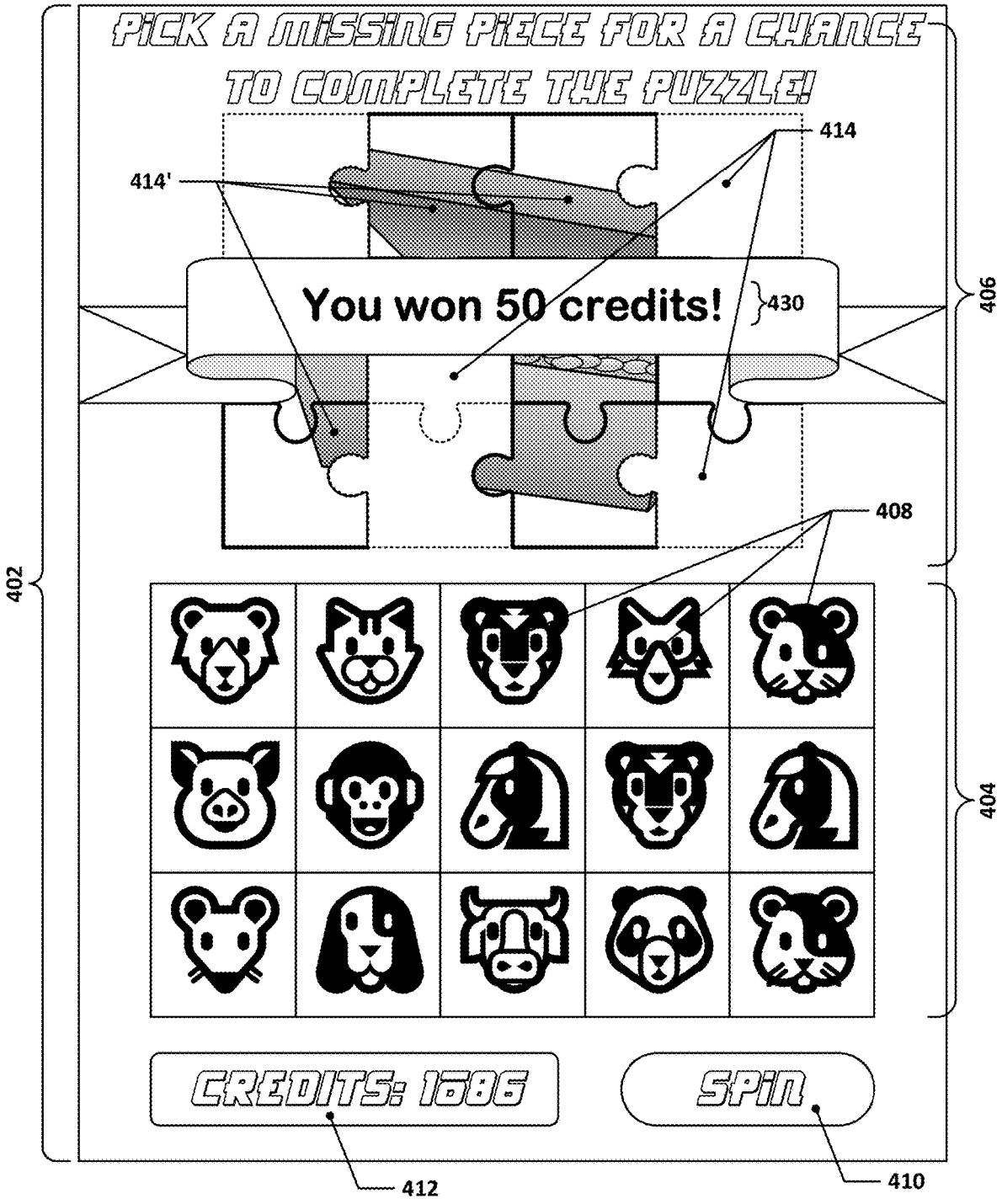

In FIG. 26, a notification 430 that indicates that a consolation prize has been awarded due to unsuccessful selection made in FIG. 25. In this example, the consolation prize that is awarded is 50 credits, which is much lower than what would have been won if the player had made a successful first graphical indicator selection, e.g., as shown in FIGS. 23 and 24.

Figure 27:
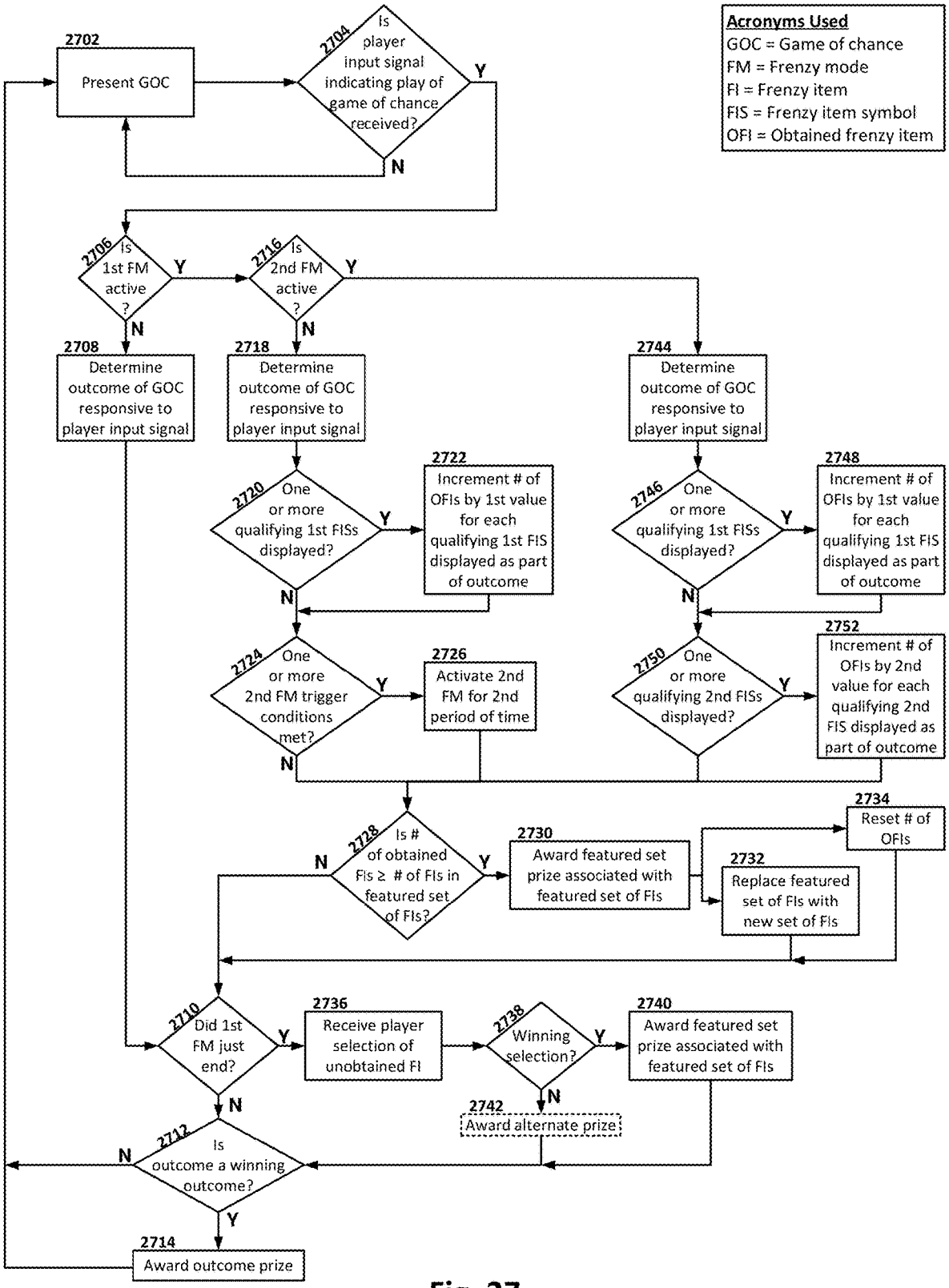
FIG. 27 depicts a flow diagram for providing a game of chance according to the concepts discussed herein.

It will be appreciated that games of chance that provide gameplay experiences such as are discussed above may be implemented in any of a variety of different manners. FIG. 27 depicts a flow diagram of one such technique for providing a game of chance in accord with the examples discussed herein, although FIG. 27 is not be considered an exclusive technique for providing such gameplay experience.

The technique of FIG. 27 may begin in block 2702, in which a game of chance (represented in FIG. 27 by the acronym "GOC" in order to conserve space—this and other acronyms used in FIG. 27 are presented in a legend in the upper right corner of FIG. 27) may be caused to be presented by an electronic gaming system. Such a game of chance may be caused to be displayed on one or more displays of the electronic gaming system.

In block 2704, a determination may be made as to whether a player input signal has been received that is indicative of a play of the game of chance by a player. For example, if the player pushes a "spin" or "play" button to initiate a play of the game of chance, the signal that results from such a player action may serve as the player input signal.

If it is determined in block 2704 that no such player input signal has been received, then the technique may return to block 2702 and the start of the technique of FIG. 27 may repeat itself. This may continue until a player input signal is received.

If it is determined in block 2704 that the player input signal has been received, then the technique may progress to block 2706, in which a determination may be made as to whether or not a first frenzy mode is active. The first frenzy mode may, for example, be activated responsive to any of a number of conditions being met. For example, in some implementations, the first frenzy mode may be activated responsive to a particular outcome being achieved in the game of chance, while in other implementations, the first frenzy mode may be activated responsive to one or more conditions being met with respect to other players' gaming activities, e.g., a group of players playing the game of chance on a plurality of electronic gaming machines arranged in a common bank of gaming machines may win a combined amount of credits within a given period of time that exceeds a predefined amount of credits.

If it is determined in block 2706 that the first frenzy mode is not active, then the technique may proceed to block 2708, in which an outcome of the game of chance may be determined responsive to the receipt of the player input signal. In other implementations, the outcome may have been generated prior to receipt of the player input signal but may be selected in response to the receipt of the player input signal.

The technique may then proceed to block 2710, in which a determination may be made as to whether the first frenzy mode just ended, e.g., as part of this play of the game of chance.

If it is determined in block 2710 that the first frenzy mode has not just ended, then the technique may proceed to block 2712, in which a determination may be made as whether or not the outcome that is generated for the game of chance is a winning outcome. For example, if the outcome of the game of chance that is displayed features one or more patterns of symbols that are associated with corresponding winning outcomes, then such an outcome may be determined to be a winning outcome.

If it is determined in block 2712 that the outcome for the game of chance that is presented includes a winning outcome, then the technique may proceed to block 2714, in which the electronic gaming system presenting the game of chance may cause one or more awards associated with the winning outcome (or outcomes) to be provided. For example, the electronic gaming system may cause a meter that indicates an amount of credits won or available on the electronic gaming system to be incremented by an amount commensurate with one or more award amounts associated with such a winning outcome or outcomes. The technique may then return to block 2702, where the game of chance may continue to be presented, and then block 2704, in which a determination may be made as to whether a further player input signal has been received. Generally speaking, reference herein to "awarding" a prize may be understood to refer to any operations or actions taken to associate a benefit, e.g., an amount of credits that may be used to play the game of chance or that may, in some implementations, be redeemable for a corresponding actual monetary amount, with a particular player. For example, in many implementations, an electronic gaming system may include a meter that reflects a total number of credits available for play of a game of chance. Such a meter may be incremented via a number of mechanisms, including, for example, through the player's purchase of such credits via a financial transaction, e.g., using a credit card. Such a meter may also be incremented as a result of the player winning an award of credits in the game of chance. Similarly, such a meter may also be decremented each time the player engages in a play of the game, e.g., in an amount equal to the amount wagered on the game of chance.

If it is determined in block 2712 that the presented outcome does not include a winning outcome, then the technique may proceed to block 2702 instead.

Returning to block 2710, if it is determined therein that the first frenzy mode just ended, e.g., during the current play of the game of chance, the technique may proceed to block 2736, in which input indicative of a player selection of an unobtained frenzy item may be received. Such a selection, for example, may be made via a touch-sensitive control of a GUI that shows graphical indicators that represent the obtained and unobtained frenzy items in a featured set of frenzy items.

The technique may then proceed to block 2738, in which a determination may be made as to whether the selection of an unobtained frenzy item in block 2736 is a winning selection, i.e., causing the remaining unobtained frenzy items in the featured set of frenzy items to be obtained. If the selection of the unobtained frenzy item is determined in block 2738 to be a winning selection, then the technique may proceed to block 2740, in which the electronic gaming system may cause a featured set prize associated with the featured set of frenzy items to be awarded to the player of the game of chance. The electronic gaming system may also cause the remaining first graphical indicators 414 to be turned into the second graphical indicators 414' responsive to the selection of the first graphical indicator that is determined to be a winning selection so as to visually indicate that all of the frenzy items in the featured set of frenzy items have been obtained.

At the conclusion of block 2740, the technique may then proceed to block 2712, and the operations of block 2712 discussed earlier may be carried out.

If it is determined in block 2738 that the selected first graphical indicator is not a winning selection, then the technique may optionally proceed to block 2742 before continuing on to block 2712. In block 2742, an alternate prize, e.g., a consolation prize in place of the featured set prize, may be caused to be awarded to the player.

Thus far, the above discussion addresses primarily what occurs in the technique when there is no active frenzy mode or when a frenzy mode has just finished. However, if it is determined in block 2706 that the first frenzy mode is active, then the technique may proceed to block 2716 instead of to block 2708. In block 2716, a determination may be made as to whether or not a second frenzy mode is active. If it is determined that the second frenzy mode is not active, the technique may proceed to block 2718, in which an outcome of the game of chance may be determined responsive to the receipt of the player input signal. In other implementations, the outcome may have been generated prior to receipt of the player input signal but may be selected in response to the receipt of the player input signal.

The technique may then proceed to block 2720, in which a determination may be made as to whether or not one or more qualifying first frenzy item symbols are displayed as part of the outcome of block 2718. As discussed above, a qualifying first frenzy item symbol is to be understood to be a first frenzy item symbol that will, when displayed, cause the number of frenzy items in the featured set of frenzy items that have been obtained to be incremented by a first value (or that will cause the number of frenzy items in the featured set of frenzy items that have been obtained to meet or exceed the number of frenzy items in the featured set of frenzy items). As discussed above, in some implementations any displayed first frenzy item symbol may be deemed to be a qualifying first frenzy item symbol (at least in the case in which the number of such first frenzy item symbols displayed for any particular play of the game of chance is less than or equal to the number of unobtained frenzy items in the featured set of frenzy items—in the case where there are more first frenzy item symbols displayed than the number frenzy items in the featured set of frenzy items that have not yet been obtained, then some of the first frenzy item symbols may not be deemed to be qualifying first frenzy item symbols). As also mentioned, in some implementations, frenzy item symbols may be specific to particular frenzy items in the featured set of frenzy items, in which case a displayed first frenzy item symbol may only be deemed to be a qualifying first frenzy item symbol if it is specific to a frenzy item in the featured set of frenzy items that has not yet been obtained. For example, if the frenzy items in the featured set of frenzy items are represented by a set of different puzzle pieces, as in the example discussed above, there may be one or more first frenzy item symbols that are miniature replicas of each of the different frenzy items in the featured set of frenzy items. Thus, for example, if a first frenzy item symbol is displayed that is a replica of the first graphical indicator for the frenzy item in the upper right corner of an array of graphical indicators of the frenzy items (or the second graphical indicator that corresponds thereto), then the first graphical indicator that is located in the upper right corner of that array may be changed to a second graphical indicator to indicate that the frenzy item associated with that array position has been obtained. However, if the same first frenzy item symbol is subsequently displayed again, then the subsequent display of that same first frenzy item symbol may be deemed to not be a display of a qualifying first frenzy item symbol, and there may be no change in the number of frenzy items in the featured set of frenzy items that has been obtained responsive to such display.

If it is determined in block 2720 that one or more qualifying first frenzy item symbols is displayed in association with the outcome of the game of chance, then the technique may proceed to block 2722, in which the number of frenzy items from the featured set of frenzy items that have been obtained is incremented by the first value for each qualifying first frenzy item symbol that is displayed as part of the outcome of the game of chance. Thus, for example, if the first value is one and two qualifying first frenzy item symbols are displayed as part of an outcome of the game of chance, then the number of frenzy items of the featured set of frenzy items that have been obtained may be incremented by two.

Regardless of the determination made in block 2720, the technique may ultimately proceed to block 2724 (via block 2722, if the determination in block 2720 warrants), in which a further determination may be made as to whether or not one or more second frenzy mode trigger conditions has been met. Such second frenzy mode trigger conditions may be met, for example, when a particular symbol or symbols is displayed as part of the outcome of the game of chance, or when a particular combination of symbols is displayed as part of the outcome of the game of chance (for example, if two or more first frenzy mode symbols are shown in a common outcome of the game of chance, then this may satisfy one example of a second frenzy mode trigger condition). In some implementations, the number of second frenzy modes that may be activated during any given first frenzy mode may be capped to a specific number, e.g., only one, only two, etc. In other implementations, however, the number of second frenzy modes that may be activated during any given first frenzy mode may not be subject to such constraints, allowing for multiple repeat second frenzy modes to be activated.

If it is determined in block 2724 that the one or more second frenzy mode trigger conditions have been met, then the technique may proceed to block 2726, in which the second frenzy mode may be activated for a second time period. The second time period is shorter than the first time period. As mentioned, the electronic gaming system may be configured to handle the situation that occurs when the second frenzy mode is activated close enough to the end of the first time period that the second time period would extend beyond the end of the first time period in a variety of different ways depending on the implementation. For example, in some implementations the electronic gaming system may, in such cases, curtail the second time period so as to end contemporaneously with the end of the first time period. In other implementations, the electronic gaming system may, in such cases, extend the first time period so as to end contemporaneously with the end of the second time period.

Regardless of the determination made in block 2724, the technique may ultimately proceed to block 2728 (via block 2726, if the determination in block 2724 warrants), where a determination may be made as to whether the number of frenzy items in the featured set of frenzy items that have been obtained is greater than or equal to the number of frenzy items in the featured set of frenzy items. Such a determination may, for example, involve inspecting a counter indicating the number of obtained frenzy items and comparing its value against a number indicating the number of frenzy items in the featured set of frenzy items. Alternatively or additionally, such a determination may, for example, involve inspecting a data array that features multiple cells, each cell corresponding to a different frenzy item of the featured set of frenzy items and each cell having a corresponding setting indicating whether or not the corresponding frenzy item has been obtained. If it is determined in block 2728 that the number of frenzy items in the featured set of frenzy items that have been obtained is less than the number of frenzy items in the featured set of frenzy items, then the technique may proceed to block 2710 and continue as discussed above with respect to block 2710.

However, if it is determined in block 2728 that the number of frenzy items in the featured set of frenzy items that have been obtained is greater than or equal to the number of frenzy items in the featured set of frenzy items, the technique may instead proceed to block 2730, in which the featured set prize associated with the featured set of frenzy items may be caused to be awarded to the player.

The technique may then proceed to blocks 2732 and 2734.

In block 2732, the featured set of frenzy items may be replaced with a new featured set of frenzy items. For example, the game of chance may be associated with a plurality of sets of frenzy items, with each set of frenzy items having an award amount associated therewith. The electronic gaming system that presents the game of chance may be configured to select one of the sets of frenzy items to be the featured set of frenzy items at the start of the first frenzy mode. When (or if) a player obtains sufficient frenzy items through the display of qualifying first frenzy item symbols (and/or, as discussed later, qualifying second frenzy item symbols) to equal or exceed the number of frenzy items in the featured set of frenzy items, then the player may be awarded the featured set prize associated with the featured set of frenzy items and the featured set of frenzy items may then be replaced with a new featured set of frenzy items.

In some implementations, the plurality of sets of frenzy items and the electronic gaming system may be configured such that each set of frenzy items that is selected to be the featured set of frenzy items may have at least as many, if not more, frenzy items in it as the featured set of frenzy items that it replaces. Thus, if the first set of frenzy items to be selected as the featured set of frenzy items has four frenzy items in it, the second set of frenzy items that is selected to replace the first set of frenzy items as the featured set of frenzy items may have four or six frenzy items in it. Similarly, the third set of frenzy items that is to be selected to replace the second set of frenzy items as the featured set of frenzy items may have eight or nine frenzy items, and so forth. Similarly, in some implementations, each set of frenzy items that is selectable to be the featured set of frenzy items, at least two consecutive such sets of frenzy items (if not a majority or all of the sets of frenzy items) may have a featured set prize that is generally greater than or equal to the featured set prize of the set of frenzy items that is to immediately precede that set of frenzy items as a featured set of frenzy items. Thus, in such implementations, obtaining all of the frenzy items in a featured set of frenzy items will generally result in an award of the featured set prize for that featured set of frenzy items followed by the presentation of a new featured set of frenzy items that has either the same or a higher number of frenzy items in it and which has a featured set prize that is greater than or equal to the featured set prize that was most recently awarded to the player. Thus, the challenge, and potential rewards, of completing the featured set of frenzy items may appear to a player to increase as the player progresses through the sets of frenzy items during a first frenzy mode.

In block 2734, the number of frenzy items in the featured set of frenzy items that have been obtained may be reset in association with the selection of a new set of frenzy items to be the featured set of frenzy items. As noted earlier, this may be a reset to zero or may be reset to some value less than the current number of obtained frenzy items. For example, there may be three sets of frenzy items that each have the same number of frenzy items, e.g., nine frenzy items, in them. The three sets of frenzy items in this example are intended to be selected in sequence for presentation as the featured set of frenzy items. However, the reset value of the number of obtained frenzy items may be different for each of the three sets. For example, when the first of the three sets is selected to be the featured set of frenzy items, the number of obtained frenzy items may be reset to two—thus requiring the player to obtain the remaining seven frenzy items in order to obtain all of the frenzy items in the featured set of frenzy items. The next set of nine frenzy items that may be selected as the featured set of frenzy items may be accompanied by a reset of the number of obtained frenzy items to one, thereby requiring the player to obtain the remaining eight frenzy items in order to obtain all of the frenzy items in the featured set of frenzy items. When the last set of nine frenzy items are selected as the featured set of frenzy items, the number of obtained frenzy items may be reset to zero, thereby requiring the player to obtain all nine frenzy items in order to obtain all of the frenzy items in the featured set of frenzy items. This allows for a scenario in which the number frenzy items in the featured set of frenzy items may remain the same for successive featured sets of frenzy items, but the perceived (or actual) difficulty of obtaining all of the frenzy items in the featured set of frenzy may become (or appear to become) progressively more difficult with each successive featured item set.

After blocks 2732 and 2734 have completed, the technique may then proceed to block 2710 and the operation(s) of block 2710 may be performed as discussed earlier.

The above-discussed blocks 2716-2734 relate to portions of the technique that are performed when the first frenzy mode is active. However, if it is determined in block 2716 that the second frenzy mode is active, then the technique may proceed to block 2744. In block 2744 an outcome of the game of chance may be determined responsive to the receipt of the player input signal. In other implementations, the outcome may have been generated prior to receipt of the player input signal but may be selected in response to the receipt of the player input signal.

The technique may then proceed to block 2746, in which a determination may be made as to whether or not one or more qualifying first frenzy item symbols are displayed as part of the outcome of block 2744.

If it is determined in block 2746 that one or more qualifying first frenzy item symbols is displayed in association with the outcome of the game of chance, then the technique may proceed to block 2748, in which the number of frenzy items from the featured set of frenzy items that have been obtained is incremented by the first value for each qualifying first frenzy item symbol that is displayed as part of the outcome of the game of chance. Blocks 2746 and 2748 are, it will be recognized, generally identical to blocks 2720 and 2722, and serve to ensure that any first frenzy item symbols that are displayed during the second frenzy mode are still handled appropriately. Thus, the second frenzy mode does not replace the first frenzy mode, but instead enhances the first frenzy mode. However, in some implementations, the second frenzy mode may, in effect, replace the first frenzy mode. For example, in some implementations, the game of chance may be configured to prevent any first frenzy item symbols from being displayed during the second time period (while the second frenzy mode is active) and only potentially display one or more second frenzy item symbols as part of an outcome that is displayed while the second frenzy mode is active. In such implementations, blocks 2746 and 2748 (or their equivalents) may be omitted.

After the technique has proceed through block 2746 and, if warranted, block 2748, the technique may proceed to block 2750, in which a determination may be made as to whether or not one or more qualifying second frenzy item symbols are displayed as part of the outcome of block 2744.

If it is determined in block 2750 that one or more qualifying second frenzy item symbols is displayed in association with the outcome of the game of chance, then the technique may proceed to block 2752, in which the number of frenzy items from the featured set of frenzy items that have been obtained is incremented by the second value for each qualifying second frenzy item symbol that is displayed as part of the outcome of the game of chance.

It will be understood that in cases where the number of frenzy items in a featured set of frenzy items that have been obtained is to be incremented by a first value or a second value that exceeds the difference between the number of frenzy items in a featured set of frenzy items that have been obtained and the number of frenzy items in the featured set of frenzy items, reference to "incrementing the number of frenzy items in a featured set of frenzy items that have been obtained" or the like is inclusive of: a) incrementing the number of frenzy items in the featured set of frenzy items that have been obtained, b) incrementing the number of frenzy items in the featured set of frenzy items that have been obtained to a value higher than the number of frenzy items in the featured set of frenzy items (in some such cases, the GUI may only indicate that the number of frenzy items in the featured set of frenzy items has been obtained, although a counter or data structure that stores data hidden from the user may reflect that the number of frenzy items in the featured set of frenzy items that have been obtained is higher than the number of frenzy items in the featured set of frenzy items), c) incrementing the number of frenzy items in the featured set of frenzy items that have been obtained to a value that equals the number of frenzy items in the featured set of frenzy items, and d) determining a first total amount by which the number of frenzy items in the featured set of frenzy items that have been obtained is to be incremented (based on the first and/or second values), determining a first difference between the number of frenzy items in the featured set of frenzy items that have been obtained, incrementing the number of frenzy items in the featured set of frenzy items that have been obtained by the first difference, and then, after selecting a new set of frenzy items to serve as the featured set of frenzy items and resetting the number of frenzy items in the featured set of frenzy items that have been obtained in association therewith, incrementing the newly reset number of frenzy items in the featured set of frenzy items that have been obtained by a second difference that is determined by subtracting the first difference from the first total amount. Thus, games of chance according to this disclosure may handle the situation that occurs when an outcome is displayed that would result in more frenzy items being obtained than are currently needed to obtain all of the frenzy items in the featured set of frenzy items in a variety of different ways, depending on how the game of chance is configured. In some implementations, the current featured set of frenzy items may be deemed to be completely obtained as a result of such an outcome, but there may be no further benefit derived from additional frenzy items that would be obtained based on that outcome. In other implementations, the "extra" frenzy items that a player may obtain as a result of the display of qualifying first and/or second frenzy item symbols as part of a given outcome may be applied towards completion of the next set of frenzy items, thereby allowing the player the full benefit of all of the qualifying first and/or second frenzy item symbols that are displayed as part of an outcome.

It will be appreciated that the technique of FIG. 27 may be modified in a number of ways that do not substantively impact the game experience that the technique of FIG. 27 is intended to provide. For example, the order of some of the blocks may be changed as desired in some cases, e.g., blocks 2720 and 2722 may be performed after blocks 2724 and 2726 instead of before, locks 2746 and 2748 may be performed after blocks 2750 and 2752, etc.

A game of chance such as may be provided by the technique of FIG. 27 may have paytable mechanics that may be specially configured in order to provide a desired game-play experience while maintaining a desired RTP. For example, the symbols that form each outcome responsive to a play of the game of chance may be selected from different groups of symbols depending on whether the first and/or second frenzy mode is active for a given play of the game of chance.

For example, if the game of chance is a slot-type game of chance, then the symbols that are displayed as part of any given outcome for the game of chance may be selected, in some instances, by selecting one or more symbols from a group of symbols that are then displayed in one or more corresponding locations in the outcome.

The selection of which set of reel strips to use for any particular play of the game of chance may be made in a variety of ways. In some instances, the selection may be made according to a preset rule. For example, if there is only one non-frenzy mode reel strip set for a given game of chance, then, by default, that single non-frenzy mode reel strip set will be the reel strip that is selected for every play of the game of chance when there is no frenzy mode active. In other instances, the selection may be randomly made (or randomly made according to various weighting factors).

For example, in some example slot-type games, the symbols that are selected for display in each column of a rectangular array of symbols that are provided for each outcome may be selected from virtual "reel strips," as discussed earlier herein. Each such reel strip may be an ordered set of symbols (or, more correctly, a data structure that represents an ordered set of symbols) that includes a much larger number of symbols than the number of symbols that are to be selected therefrom for display as part of an outcome. As part of each play of the game of chance, a set of sequentially adjacent symbols in each reel strip may be randomly selected for display in the symbol positions of each column (each column may thus represent a "reel" of a conventional, mechanical slot-type game of chance). Thus, for example, if there are three symbol positions in a given column of the outcome, three sequentially adjacent symbols from the reel strip may be selected for display and then displayed in the same sequence in those symbol positions as part of the outcome. For example, the electronic gaming system may randomly select one of the symbols in a reel strip and then select the two symbols that sequentially follow the randomly selected symbol in the reel strip in order to select a total of three sequentially adjacent symbols from the reel strip. The symbols in the reel strips may be configured in a modular sequence, e.g., such that the sequence is treated as if it repeats (as it would, for example, if the reel strip were a physical strip of symbols wrapped around the outer circumference of a physical reel). Thus, if the second-to-last symbol in such a reel strip is randomly selected and the next two sequentially adjacent symbols thereto are additionally selected, this would cause the last symbol in the reel strip and the first symbol in the reel strip to be selected for display.

The symbols that are included in each reel strip may be selected so as to adjust the frequency and the amount (or type) of awards that can potentially be won in the game of chance. However, in games of chance such as those discussed herein, there may be multiple sets of reel strips from which reel strips may be selected in order to provide an outcome for the game of chance in response to a particular play of the game of chance.

For example, a game of chance such as the above slot-type game of chance may utilize a plurality of sets of reel strips, each set of reel strips having a number of reel strips within it that correspond to the number of reels that are used to provide an outcome for the game of chance. Thus, for example, if the game of chance displays outcomes that are indicative of a five-reel game of chance, each set of reel strips would correspondingly have five reel strips.

In such an implementation, the electronic gaming system providing the game of chance may be configured to randomly or non-randomly select between the different sets of reel strips in order to determine an outcome for any particular play of the game of chance. The population of sets of different reel strips that the electronic gaming system may select between may be modified depending on the particular mode that the game of chance is operating in. For example, there may be one or more sets of reel strips in which the plurality of reel strips in each set of reel strips includes at least one reel strip that has at least one first or second frenzy mode symbol on it; such a set of reel strips may be referred to herein as a "frenzy mode reel strip set." Similarly, there may also be one or more sets of reel strips in which the plurality of reel strips in each set of reel strips includes no first frenzy mode symbols, such a set of reel strips may be referred to herein as a "non-frenzy mode reel strip set." Thus, when the game of chance is operating in a non-frenzy mode, e.g., a normal play mode in which the first and/or second frenzy modes are not active, the electronic gaming machine may be configured to select a set of reel strips to be used for determining an outcome for the game of chance from the one or more non-frenzy mode reel strip sets that may be available in the game of chance.

However, when the game of chance is operating in the first frenzy mode, e.g., a play mode in which the first frenzy mode is active, the electronic gaming machine may be configured to select a set of reel strips to be used for determining an outcome for the game of chance from the one or more frenzy mode reel strip sets or, optionally, the one or more non-frenzy mode reel strip sets.

The frenzy mode reel strip sets that are available for selection in determining outcomes for a particular game of chance may, in some instances, be further subdivided into first frenzy mode reel strip sets and second frenzy mode reel strip sets. Thus, for example, the one or more frenzy mode reel strip sets may include one or more first frenzy mode reel strip sets in which the plurality of reel strips therein each include at least one reel strip that has at least one first frenzy mode symbol on it. The one or more frenzy mode reel strip sets may also include one or more second frenzy mode reel strip sets in which the plurality of reel strips therein each include at least one reel strip that has at least one second frenzy mode symbol on it. In such implementations, if a frenzy mode reel strip set is to be selected by the electronic gaming system for use in determining an outcome for the game of chance, the electronic gaming system may, if the first frenzy mode is active and the second frenzy mode is not, select a frenzy mode reel strip set only from the one or more sets of first frenzy mode reel strip sets. Similarly, if a frenzy mode reel strip set is to be selected by the electronic gaming system for use in determining an outcome for the game of chance when the second frenzy mode is active, the electronic gaming system may select a frenzy mode reel strip set from the one or more sets of second frenzy mode reel strip sets or, optionally, the one or more sets of first frenzy mode reel strip sets (in some implementations, outcomes while second frenzy mode is active may potentially include an outcome that would normally potentially occur while the first frenzy mode is active in addition to outcomes that could only potentially occur while the second frenzy mode is active).

In some implementations, the one or more non-frenzy mode reel strip sets that may be available for use in determining outcomes for a game of chance may include a plurality of non-frenzy mode reel strip sets that may include different types of reel strips for different non-frenzy mode situations. For example, there may be a "normal" or "default" reel strip set that includes reel strips for a base game that does not have any special features that are presently active. In addition to the normal or default reel strip set that may be present, there may also be one or more additional types of non-frenzy mode reel strip sets that are available in such implementations, including a "random wilds" reel strip set in which wilds are randomly placed within the visible reel window and provide for additional winning combinations of symbols, one or more reel strips includes at least one "wild" symbol that may, for the purposes of determining whether a particular outcome features a winning pattern of symbols, be interpreted as being equivalent to any of a plurality of different symbols, a "mini," "minor," "major," or "grand" (or "mega") "jackpot" reel strip set in which one or more of reel strips includes at least one jackpot symbol that may cause a corresponding jackpot award to be granted if displayed or if displayed as part of a particular jackpot-winning symbol pattern, a "multiplier" reel strip set in which one or more reel strips includes at least one "multiplier" symbol that may cause an award that is provided due to a particular winning pattern of symbols being displayed in an outcome to be multiplied by an associated multiplier amount (such an effect may occur, in some cases, if such a multiplier symbol is simply displayed as part of the outcome, whereas in other cases, the effect may only occur if the multiplier symbol is located in a symbol position that is in the winning pattern).

In some additional or alternative implementations, the one or more frenzy mode reel strip sets that may be available for use in determining outcomes for a game of chance may include a plurality of frenzy mode reel strip sets that may each include different numbers of first and/or second frenzy mode symbols therein. For example, there may be frenzy mode reel strip sets that have increasing percentages of the symbol positions therein that include first and/or second frenzy item symbols. For example, if the frenzy mode reel strip sets each have five reel strips that each have 100 symbols/symbol positions each, there may be one frenzy mode reel strip set in which 20 of the 500 symbols/symbol positions in that reel strip set have first and/or second frenzy item symbols (4%), a second frenzy mode reel strip set in which 40 of the 500 symbols/symbol positions in that reel strip set have first and/or second frenzy item symbols (8%), and a third frenzy mode reel strip set in which 80 of the 500 symbols/symbol positions (16%) in that reel strip set have first and/or second frenzy item symbols.

It will be understood that in some implementations, the same (or nearly the same) frenzy mode reel strip sets may be used regardless of whether it is the first frenzy mode that is active or the second frenzy mode that is active. For example, in some such implementations, the reel strips in a given frenzy reel strip set may remain the same when used to determine outcomes during the first frenzy mode or the second frenzy mode except that one or more (or all) of the reel strip symbol positions that display first frenzy mode item symbols when the first frenzy mode is active while the second frenzy mode is not are instead caused to display second frenzy mode item symbols when the second frenzy mode is active.

It will also be understood that in some implementations, a first frenzy mode reel strip set may also include one or more reel strips that include one or more second frenzy mode item symbols in addition to one or more reel strips that include one or more first frenzy mode item symbols. Similarly, in some additional or alternative implementations, a second frenzy mode reel strip set may also include one or more reel strips that include one or more first frenzy mode item symbols in addition to one or more reel strips that include one or more second frenzy mode item symbols.

For example, in some implementations, a second frenzy mode reel strip set may include reel strips that collectively include both first and second frenzy mode item symbols, thus allowing for both first and/or second frenzy mode item symbols to potentially be part of outcomes that are determined while the second frenzy mode is active. In another example, a first frenzy mode reel strip set may, in some implementations, include a number of second frenzy item symbols that may, if displayed as part of an outcome while the first frenzy mode is active, cause the electronic gaming system that provides the game of chance to activate the second frenzy mode. In such implementations, such second frenzy item symbols act, in effect, as second frenzy mode trigger symbols when the second frenzy mode is not active, and act as second frenzy item symbols when the second frenzy mode is active. In such implementations, the first frenzy mode reel strip set and the second frenzy mode reel set may be, in effect, identical except that the second frenzy mode trigger symbols become second frenzy item symbols when the reel strip set is used while the second frenzy mode is active.

In some additional such implementations, the display of a second frenzy item symbol while the first frenzy mode is active and the second frenzy mode is not may not only cause the electronic gaming system to activate the second frenzy mode, but may additionally cause the electronic gaming system to increment the number of frenzy items in the featured set of frenzy items that have been obtained by the second value.

In some implementations, the game of chance may be configured such that one or more second frenzy mode trigger symbols are potentially displayable as part of an outcome for the game of chance while the second frenzy mode is active. In some such implementations, the display of a second frenzy mode trigger symbol while the second frenzy mode is active may cause the electronic gaming system that is providing the game of chance to extend the second frenzy mode, e.g., restart or extend the second time period.

In implementations where second frenzy item symbols are potentially displayable as part of an outcome while the first frenzy mode is activated and the second frenzy mode is not, the electronic gaming system may cause the game of chance to operate such that the probability of a second frenzy mode item symbol being displayed as part of an outcome is significantly higher while the second frenzy mode is active than when it is not. For example, the second frenzy mode reel strip set(s) may have an increased percentage of the symbol positions of the reel strips therein that have a second frenzy item symbol displayed therein. Alternatively, if the same sets of reel strips are used as both the first frenzy mode reel strip sets and the second frenzy mode reel strip sets, then at least some, most, or all of the symbol positions that show first frenzy mode item symbols when the first frenzy mode is active without the second frenzy mode being active may be caused to show second frenzy mode item symbols instead.

As noted earlier, a particular set of reel strips may be selected for each play of the game of chance (or a previously selected set of reel strips re-used) and used to determine an outcome for that play of the game of chance. In some implementations, the selection of a particular set of reel strips may be made on a random basis for at least some, if not all, plays of the game of chance. In such implementations, the sets of reel strips that are available for selection by the electronic gaming system for a particular play of the game of chance may be filtered based on the particular state that the game of chance is in, e.g., if the game of chance is in a non-frenzy mode, then the frenzy mode reel strip set(s) may be caused to not be available for selection. The electronic gaming machine may then randomly select between the various reel strip sets that are eligible to be selected based on the state of the game of chance, and then randomly select symbols from each selected reel set in order to generate an outcome for the game of chance. In some such implementations, the various reel strip sets that are eligible for selection may be pre-assigned a weighting factor or a weight that affects how frequently or infrequently such a reel set will be randomly selected. For example, if there are four eligible reel strip sets and three of the reel strip sets are given a weight of 10 and the fourth a weight of 20, then the fourth reel strip set may be randomly selected twice as often as any of the other reel strip sets, e.g., the first three reel strip sets may each have a 20% chance of being randomly selected and the fourth reel strip set may have a 40% chance of being randomly selected based on such weightings.

By using such a technique, the probabilities of particular outcomes being achieved may be fine-tuned through a multi-layered application of probabilities. Within each reel strip set, the number and arrangement of symbols on each reel strip may provide a particular probability of achieving a particular outcome using that reel strip and may thus define a reel-strip set-specific return-to-player, e.g., an expected average return to players for each play of the game of chance using that reel strip set. Such an average rate of return may factor in various sources of winnings based on the outcomes from such a reel strip set, including, for example, the occurrence of winning symbol patterns in the outcomes that are generated using that reel strip set, the occurrence of any winning jackpot symbols (if potentially available during play of the game of chance), the occurrence of first and/or second frenzy item symbols and/or the obtainment of all of the frenzy items in the featured set of frenzy items (either through directly obtaining them via an outcome displaying one or more first and/or second frenzy item symbols or, if the feature is available, via the player making a winning selection from the graphical indicator(s) indicating the unobtained frenzy items in the featured set of frenzy items, or from other sources. The reel-strip-set-specific return to player (RTP) thus represents a first layer of probabilities (or, more technically, the expected result or consequence of such probabilities).

Another layer of probability that may be controlled to adjust the probabilities of particular outcomes being achieved is that associated with the selection of the reel strip set to be used to generate any particular outcome of the game of chance. For example, if a particular reel strip set had an average RTP of 95% but was weighted such that that reel strip set was only chosen for use in determining an outcome 5% of the time, then this particular reel strip would actually only provide approximately 4.75% RTP. Thus, by controlling the weightings that affect how frequently a particular reel strip set is selected to provide an outcome in the game of chance, it is possible to fine-tune the total RTP for the game of chance while also controlling the frequency with which players experience certain outcomes. For example, the weighting of a reel strip set that includes a larger number of first frenzy mode item symbols may be decreased to cause that reel strip set to be selected less frequently for the purposes of generating an outcome, thereby tempering the effect on RTP that that reel strip set may have. However, when such a reel strip set is selected for use in generating an outcome, the end result may be quite exciting to the player since it may result in an increased chance of obtaining one or more first frenzy item symbols.

Yet another layer of probabilistic control that is offered by the above-discussed examples, if desired, and that is particularly tailored to use in the context of a frenzy mode feature of the game of chance is afforded by the use of different reel strip set weights in association with different featured sets of frenzy items. For example, a given game of chance may have a total of ten sets of frenzy items, each of which may be sequentially designated to be the featured set of frenzy items after the most recent previous set of frenzy items is obtained. Each such set of frenzy items may have associated therewith a different set of weights that may be applied to the various reel strip sets that are eligible for selection during the first and/or second frenzy mode while that particular set of frenzy items is the featured set of frenzy items in order to determine an outcome for the game of chance while that set of frenzy items is the featured set of frenzy items. By judiciously selecting the reel strip set weightings associated with each set of frenzy items, the RTP for any given set of frenzy items can be adjusted and controlled so as to provide a particular game play experience. For example, it may be desirable to generally weight frenzy reel strip sets with higher numbers of first and/or second frenzy item symbols with higher weights than frenzy reel strip sets with lower numbers of first and/or second frenzy symbols for sets of frenzy items with lower numbers of frenzy items in them and to then, as the sets of frenzy items include more and more frenzy items (or more and more initially unobtained frenzy items), adjust the weightings so that the frenzy reel strip sets with lower numbers of first and/or second frenzy item symbols are weighted higher than those frenzy reel strips with higher numbers of first and/or second frenzy items. This generally results in a gameplay experience in which it is easier for a player to obtain all of the frenzy items in featured sets of frenzy items having lower frenzy item counts but becomes increasingly more difficult to obtain all of the frenzy items in featured sets of frenzy items having higher frenzy item counts. Moreover, the time available to complete each featured set of frenzy items will typically become shorter and shorter as the first time period elapses. Between the continuously decreasing amount of the first time period remaining and the generally decreasing chance of completing each sequentially presented featured set of frenzy items, the likelihood of obtaining further featured set prizes as a result of obtaining all of the frenzy items in a given featured set of frenzy items may generally decrease with each featured set in which the frenzy items are completely obtained.

However, the tunability of the above approach also allows for departures from such a paradigm. For example, in some implementations, one or more of the sets of weightings that are applied to the frenzy reel strip sets for some sets of frenzy items, e.g., one or more sets of frenzy items that are, for example, in the middle 50% of the population of sets of frenzy items in terms of the number of frenzy items within each set of frenzy items may be adjusted so as to increase the probability of obtaining all of the frenzy items within such sets of frenzy items when one of such sets of frenzy items is made the featured set of frenzy items. This may result in a player finding it progressively more challenging to obtain all of the frenzy items in a given featured set of frenzy items as the featured set of frenzy items is replaced by new sets of frenzy items with higher numbers of unobtained frenzy items, but also finding that after successfully obtaining all of the frenzy items in a number of different featured sets of frenzy items, it is suddenly much easier to obtain all of the frenzy items in one or more subsequent featured sets of frenzy items. This may inject an element of anticipation if the player is aware of this behavior and is close to causing one of such sets of frenzy items to become the featured set of frenzy items.

The approach outlined above provides a highly tunable framework for providing a game of chance that offers both first and second frenzy modes. Such a framework allows for highly flexible tuning of the RTP for the game of chance while also allowing the gameplay experience to be minutely adjusted to facilitate more engaging gaming experiences by players of the game of chance.

Figure 28:
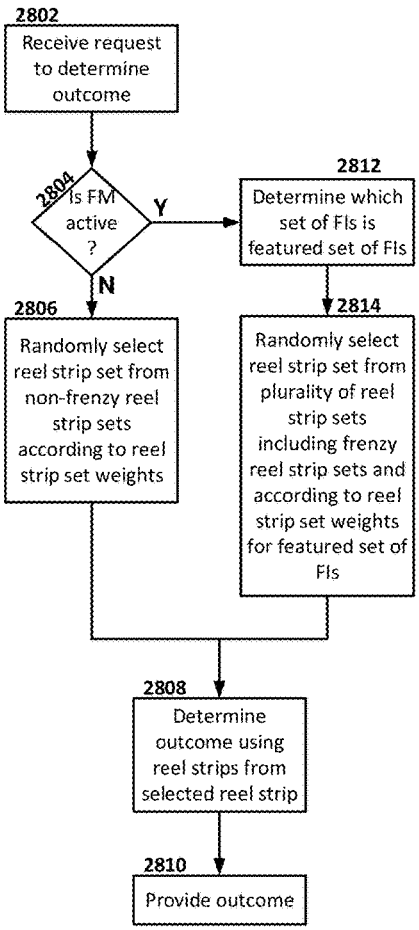
FIG. 28 depicts a flow diagram for a technique for determining an outcome for a game of chance.

FIG. 28 depicts a flow diagram of a technique for providing an outcome, e.g., as may be used to determine outcomes for the game of chance in blocks 2708, 2718, or 2744 of FIG. 27. In block 2802, a request may be received to determine an outcome for a game of chance such as is described herein. The technique may then proceed to block 2804, in which a determination may be made as to whether the first and/or second frenzy mode is active. If it is determined in block 2804 that neither frenzy mode is active, then the technique may proceed to block 2806, in which a reel strip set may be selected from a plurality of non-frenzy reel strip sets according to a weighted randomized selection that uses different weights established for each non-frenzy reel strip set. The technique may then proceed to block 2808, in which the outcome may be determined using the reel strips in the selected reel strip, e.g., based on a random selection of one or more symbols that are provided as part of each reel strip in the selected reel strip set. The outcome may then be provided, e.g., for use in determining whether a winning pattern has occurred, in block 2810.

If it is determined in block 2804 that the first and/or second frenzy mode is active, then the technique may proceed to block 2812, in which a determination may be made as to which set of frenzy items is currently the featured set of frenzy items. In block 2814, a reel strip set may be selected from a plurality of reel strip sets that includes frenzy reel strip sets. Such a selection may be made according to a weighted randomized selection that uses the weights that are a) associated with each of the reel strip sets from which a selection of a reel strip set may potentially be made and b) associated with the set of frenzy items that is the featured set of frenzy items, as determined in block 2812. The technique may then proceed to block 2808, in which an outcome may be determined using the selected reel strip set, as discussed above.

Figure 29:
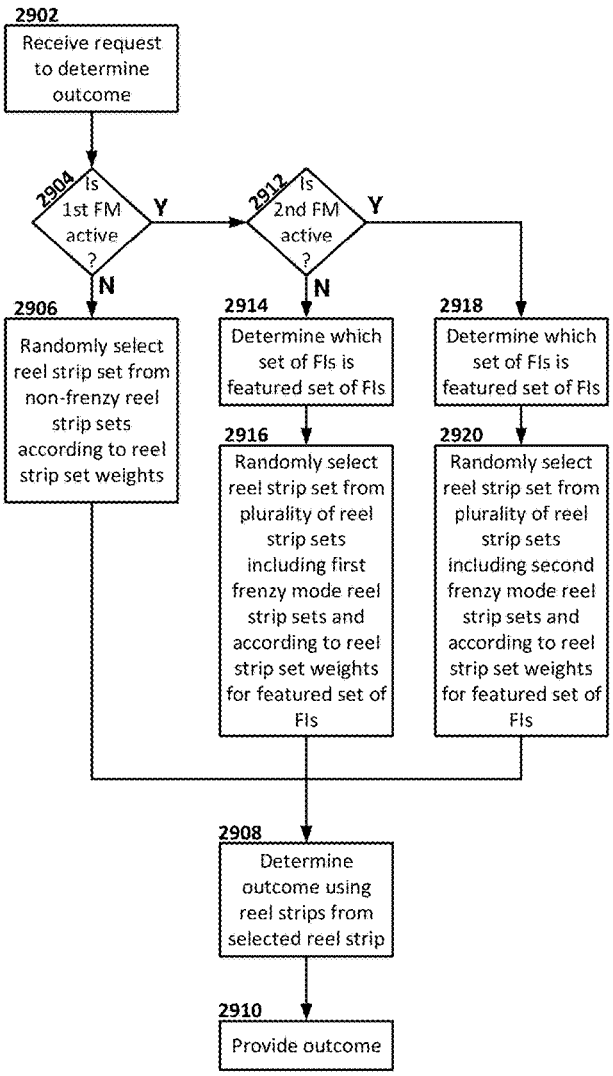
FIG. 29 depicts a flow diagram for another technique for determining an outcome for a game of chance.

FIG. 29 depicts a flow diagram for another technique for providing an outcome, e.g., as may be used to determine outcomes for the game of chance in blocks 2708, 2718, or 2744 of FIG. 27. The technique of FIG. 29 is similar to that of FIG. 28, but may be used when different reel strip sets may be used during the first and second frenzy modes.

In block 2902, a request may be received to determine an outcome for a game of chance such as is described herein. The technique may then proceed to block 2904, in which a determination may be made as to whether the first frenzy mode is active. If it is determined in block 2904 that the first frenzy mode is not active, then the technique may proceed to block 2906, in which a reel strip set may be selected from a plurality of non-frenzy reel strip sets according to a weighted randomized selection that uses different weights established for each non-frenzy reel strip set. The technique may then proceed to block 2908, in which the outcome may be determined using the reel strips in the selected reel strip, e.g., based on a random selection of one or more symbols that are provided as part of each reel strip of the selected reel strip set. The outcome may then be provided, e.g., for use in determining whether a winning pattern has occurred, in block 2910.

If it is determined in block 2904 that the first frenzy mode is active, then the technique may proceed to block 2912, in which a further determination may be made as to whether the second frenzy mode is active. If it is determined in block 2912 that the second frenzy mode is not active, the technique may proceed to block 2914, in which a determination may be made as to which set of frenzy items is currently the featured set of frenzy items. In block 2916, a reel strip set may be selected from a plurality of reel strip sets that includes first frenzy mode reel strip sets. Such a selection may be made according to a weighted randomized selection that uses the weights that are a) associated with each of the reel strip sets from which a selection of a reel strip set may potentially be made and b) associated with the set of frenzy items that is the featured set of frenzy items, as determined in block 2914. The technique may then proceed to block 2908, in which an outcome may be determined using the selected reel strip set, as discussed above.

If it is determined in block 2912 that the second frenzy mode is active, then the technique may proceed to block 2918, in which a determination may be made as to which set of frenzy items is currently the featured set of frenzy items. In block 2920, a reel strip set may be selected from a plurality of reel strip sets that includes second frenzy mode reel strip sets. Such a selection may be made according to a weighted randomized selection that uses the weights that are a) associated with each of the reel strip sets from which a selection of a reel strip set may potentially be made and b) associated with the set of frenzy items that is the featured set of frenzy items, as determined in block 2918. The technique may then proceed to block 2908, in which an outcome may be determined using the selected reel strip set, as discussed above.

It will be appreciated that other techniques for determining outcomes may be used as well, depending on the particular implementation, and the games of chance disclosed herein may be provided using any suitable technique for determining outcomes.

FIG. 30 depicts a table showing example reel set weights that may be used for a plurality of sets of reel strip sets for a given game of chance. In FIG. 30, weighting data for seven different reel sets is shown; the table in question is for reel strip set selection while the game of chance is in a frenzy mode. The reel strips are listed along the left side (a). The first two reel strip sets (1 and 2) are non-frenzy reel strip sets that are usable by the game of chance to determine outcomes during both frenzy mode and non-frenzy mode game play. The remaining five reel strips (3-7) are frenzy reel strip sets that are usable by the game of chance to determine outcomes during frenzy mode game play. The frenzy reel strip sets have increasingly higher numbers of frenzy item symbols associated therewith.

Across the top of the table are numeric indicators that each correspond to a different set of frenzy items that may be presented as the featured set of frenzy items during the first and/or second frenzy mode. The sets (b) of frenzy items are intended to be presented in sequential order, e.g., with set #1 being used as the featured set of frenzy items presented when the first frenzy mode is initiated, and with set #2 being used as the featured set of frenzy items when the featured set of frenzy items has been completely obtained, and with set #3 being used as the featured set of frenzy items when the second featured set of frenzy items (based on set #2) has been obtained, and so forth. In this example, frenzy item sets 1 and 2 each have four frenzy items, frenzy item sets 3 and 4 each have nine frenzy items, frenzy item sets 5-7 each have sixteen frenzy items, and frenzy item sets 8-10 each have 25 frenzy items, although it will be recognized that other implementations may feature different numbers of frenzy items in each frenzy item set.

In the section marked (c) are listed numbers that serve as weights for each reel strip set. Each reel strip set may have a weight that may be independently set in association with each set of frenzy items—the weights that are used when randomly determining which reel strip set to use when determining an outcome for the game of chance may be obtained from the column that corresponds with whichever set of frenzy items is being used as the featured set of frenzy items when that outcome is determined. Thus, for example, each reel strip set has ten weights that each correspond to a different one of the sets of frenzy items (some of these weights may, in some cases, be the same between two or more sets of frenzy items for a given reel strip set, although not necessarily so).

In this depicted example, there is no distinction between reel strip sets used during first frenzy mode and during second frenzy mode since the same reel strips are, in this case, usable in both frenzy modes. When the first frenzy mode is active, some symbol locations on the reel strips of the reel strip sets may, if displayed as part of an outcome, cause the electronic gaming system that is presenting the game of chance to enter the second frenzy mode—under such conditions, the symbols that are caused to be displayed in such symbol positions may be second frenzy mode trigger symbols. Those same symbol positions may, if displayed as part of an outcome while the second frenzy mode is active, cause the electronic gaming system that is presenting the game of chance to increment the number of frenzy items of the featured set of frenzy items that have been obtained by the second value. Under such conditions, the symbols that are caused to be displayed in such symbol positions may be second frenzy item symbols. However, in other implementations, completely separate reel strip sets may be provided for during the first or second frenzy modes.

The weights, for example, may cause the frequency with which a particular reel strip set is selected for determination of an outcome in the game of chance during the first (or second, in this example) frenzy mode to be adjusted depending on which set of frenzy items is the featured set of frenzy items. Thus, for example, if the third set of frenzy items is the featured set of frenzy items, the "Frenzy item symbols—max" reel strip set may, aside from the normal reel strip set, have the highest probability of being selected (a weight of 245000, which would be 29.7% of the time). If the fifth set of frenzy items is the featured set of frenzy items, however, the probability of the "Frenzy item symbols—max" reel strip set being selected may drop to 0.6% (5000/825000).

Rows (d) through (f) represent the RTP contribution that is provided by outcomes determined using each of the different types of reel strips while each of the sets of frenzy items is the featured set of frenzy items. For example, (d) indicates the RTP contribution that is attributable to the reel strip set 1, (e) indicates the RTP contribution that is attributable to the reel strip set 2, and (f) indicates the RTP contribution that is attributable to the reel strip sets 3-7. Thus, for example, for outcomes determined while the frenzy item set 1 is the featured set of frenzy items, outcomes that are determined using reel strip set 1 cause, on average, 61.28% of the amount wagered to be awarded back to the player, outcomes that are determined using reel strip set 2 cause, on average, 14.65% of the amount wagered to be awarded back to the player, and outcomes that are determined using reel strip sets 3-7 cause, on average, 9.21% of the amount wagered to be awarded back to the player. Thus, the total RTP (g) during game play that occurs while the frenzy item set 1 is the featured set of frenzy items is 85.14%.

The row (h) represents the average percentage of the number of game plays that occur during the first and/or second frenzy mode in which each set of frenzy items will be the featured set of frenzy items (in this example, it is assumed that there is one play of the game of chance per second during the first and second frenzy modes and that the first frenzy mode is 120 seconds). Such determinations may be made through simulation, for example, using a Monte Carlo method based on the weights shown and the probabilities of particular outcomes according to the symbols assigned to each reel strip in each reel strip set. As can be seen, the first set of frenzy items is, on average, only the featured set of frenzy items for ~9.05% of the total frenzy mode game plays, i.e., the first ~10-11 game plays during the first time period. Similarly, the second set of frenzy items is, on average, only the featured set of frenzy items for 7.38% of the frenzy mode game plays, i.e., ~8-9 game plays during the first time period. Thus, on average, by the time ~19-20 game plays have occurred during the first time period, the third set of frenzy items will have become the featured set of frenzy items (and the first two sets of frenzy items will have been completely obtained by the player). In this example, the third through fifth frenzy item sets are, on average, the featured sets of frenzy items for nearly 74% of the game plays during the frenzy mode, which is a reflection of the fact that the first and second frenzy item sets have a relatively high likelihood of being completed in relatively short periods of time during the first time period, e.g., within 9 to 11 seconds each, leaving, on average, ~100 seconds left of the first time period by the time that the third frenzy item set is made the featured item set. The third through fifth frenzy item sets may collectively take ~88 seconds to be completed, at which point the first time period will usually be close to expiring, resulting in the sixth frenzy item set rarely being completed and the seventh through tenth frenzy item sets rarely being presented as the featured frenzy item set. As indicated in FIG. 30, the seventh frenzy item set is typically the featured set of frenzy items for only about 1%, on average, of the first time period, the eighth frenzy item set is typically the featured set of frenzy items for only about 0.04%, on average, and the ninth and tenth frenzy item sets are typically the featured set of frenzy items for effectively 0% of the first time period (while it cannot be seen in FIG. 30, the ninth frenzy item set may be expected to be the featured set of frenzy items ~0.00002% of the time in this example).

When one factors in the percentage of the plays of the game of chance during the first time period that are made in association with each frenzy item set being the featured set of frenzy items, e.g., by multiplying the total RTP for each frenzy item set by the percent of frenzy spins that tend to occur while that frenzy item set is the featured item set, it can be seen that the nominal RTP (i) for the indicated game of chance is nearly 95%.

It can also be seen that the first set of frenzy items has a relatively high likelihood of being obtained since the reel strip with the highest number of frenzy item symbols on it has the highest weight of the frenzy reel strips 3-7 and thus not only has the highest probability of providing one or more frenzy items when used to determine an outcome, but also has the highest chance of being used to determine an outcome while the first set of frenzy items is the featured set of frenzy items. In the depicted table, as each of the third through fifth frenzy item sets becomes the featured set of frenzy items, the probability of obtaining frenzy items in an outcome tends to trend downward, as reel strip sets with fewer frenzy items have a higher chance of being selected due to their weighting as compared with higher-frenzy-item-count reel strip sets. For higher-difficulty frenzy item sets, e.g., those that tend to have higher numbers of frenzy items and that are typically encountered later in the first time period/closer to the end of the first time period (such as frenzy item sets 6-8), the weighting for reel strip sets with higher probabilities of yielding a frenzy item symbol may again be increased so as to allow players potentially have a more realistic chance at completing such a featured set of frenzy items or at least completing a significant portion of such a featured set of frenzy items. This may enhance player enjoyment of the game of chance and encourage the player to continue playing during the tail end of the first frenzy mode (as opposed to simply giving up since the odds are perceived as insurmountable).

It will be understood that the above example is simply one example of a weighting table for selecting reel strips, and that other weights other than those indicated may be used as desired to provide different RTPs and/or different gameplay experiences.

It is to be understood that the phrases "for each <item> of the one or more <items>," "each <item> of the one or more <items>," or the like, if used herein, are inclusive of both a single-item group and multiple-item groups, i.e., the phrase "for . . . each" is used in the sense that it is used in programming languages to refer to each item of whatever population of items is referenced. For example, if the population of items referenced is a single item, then "each" would refer to only that single item (despite the fact that dictionary definitions of "each" frequently define the term to refer to "every one of two or more things") and would not imply that there must be at least two of those items. Similarly, the term "set" or "subset" should not be viewed, in itself, as necessarily encompassing a plurality of items—it will be understood that a set or a subset can encompass only one member or multiple members (unless the context indicates otherwise).

The term "between," as used herein and when used with a range of values, is to be understood, unless otherwise indicated, as being inclusive of the start and end values of that range. For example, between 1 and 5 is to be understood to be inclusive of the numbers 1, 2, 3, 4, and 5, not just the numbers 2, 3, and 4.

The use, if any, of ordinal indicators, e.g., (a), (b), (c) . . . or the like, in this disclosure and claims is to be understood as not conveying any particular order or sequence, except to the extent that such an order or sequence is explicitly indicated. For example, if there are three steps labeled (i), (ii), and (iii), it is to be understood that these steps may be performed in any order (or even concurrently, if not otherwise contraindicated) unless indicated otherwise. For example, if step (ii) involves the handling of an element that is created in step (i), then step (ii) may be viewed as happening at some point after step (i). Similarly, if step (i) involves the handling of an element that is created in step (ii), the reverse is to be understood. It is also to be understood that use of the ordinal indicator "first" herein, e.g., "a first item," should not be read as suggesting, implicitly or inherently, that there is necessarily a "second" instance, e.g., "a second item."

While the disclosure has been described with respect to the figures, it will be appreciated that many modifications and changes may be made by those skilled in the art without departing from the spirit of the disclosure. Any variation and derivation from the above description and figures are included in the scope of the present disclosure as defined by the claims.

What is claimed is:

1. An electronic gaming system comprising:

one or more displays; and a game controller that includes one or more processors and one or more memory devices, wherein:

the one or more processors, the one or more memory devices, and the one or more displays are operably connected, and the one or more memory devices store computer-executable instructions for controlling the one or more processors to:

cause a graphical user interface (GUI) for a game of chance to be presented via the one or more displays;

cause, during presentation of the game of chance and responsive to one or more first frenzy mode trigger conditions being met, the GUI to indicate that a first frenzy mode is active;

cause, during presentation of the game of chance and while the first frenzy mode is active, the GUI to display a first number of visual indicators responsive to each qualifying first frenzy item symbol displayed during presentation of the game of chance while the first frenzy mode is active, each visual indicator representing a corresponding frenzy item in a featured set of frenzy items, wherein the featured set of frenzy items is obtained from a plurality of sets of frenzy items and a) each set of frenzy items in the plurality of sets of frenzy items is associated with a corresponding plurality of reel strip sets to be used in generating outcomes in the game of chance when that set of frenzy items is the featured set of frenzy items, b) each reel strip set in the plurality of reel strip sets that is associated with each set of frenzy items is associated with a corresponding reel strip set weight, and c) each reel strip has a set of symbols associated therewith;

cause, while the first frenzy mode is active and responsive to one or more second frenzy mode trigger conditions being met, the GUI to indicate that a second frenzy mode is active;

cause, during presentation of the game of chance and while the second frenzy mode is active, the GUI to display a second number of visual indicators responsive to each qualifying second frenzy item symbol displayed during presentation of the game of chance while the second frenzy mode is active;

select, using weighted random selection based on the corresponding reel strip set weight for each of the reel strip sets in the plurality of reel strip sets associated with the featured set of frenzy items, a selected reel strip set from the plurality of reel strip sets associated with the featured set of frenzy items, wherein the plurality of reel strip sets from which the selected reel strip set is selected for use while the first frenzy mode is active includes at least one reel strip set that has at least one reel strip with at least one first frenzy item symbol and the plurality of reel strip sets from which the selected reel strip set is selected while the second frenzy mode is active includes at least one reel strip set that has at least one reel strip with at least one second frenzy item symbol; and generate outcomes for the game of chance by selecting symbols from the selected reel strip set based on output of a random number generator, wherein:

the second number is larger than the first number, a first time period in which the first frenzy mode is active at least partially temporally overlaps with a second time period in which the second frenzy mode is active, and the second time period is shorter than the first time period.

2. The electronic gaming system of claim 1, wherein the first number is one and the second number is two.

3. The electronic gaming system of claim 1, wherein the one or more memory devices further store additional computer-executable instructions for further controlling the one or more processors to cause, responsive to visual indicators representing all of the frenzy items in the featured set of frenzy items being displayed, the GUI to indicate a featured set prize associated with the featured set of frenzy items.

4. The electronic gaming system of claim 3, wherein the one or more memory devices further store additional computer-executable instructions for further controlling the one or more processors to:

cause the GUI to display a first graphical indicator for each frenzy item in a first subset of frenzy items in the featured set of frenzy items, wherein the number of frenzy items in the first subset is equal to the number of frenzy items in the featured set of frenzy items minus the number of visual indicators that have been displayed by the GUI for the featured set of frenzy items, and cause, responsive to determining that a selected first graphical indicator is a winning selection, the featured set prize associated with the featured set of frenzy items to be indicated by the GUI.

5. The electronic gaming system of claim 1, wherein the one or more memory devices further store additional computer-executable instructions for further controlling the one or more processors to cause, responsive to each display of a qualifying first frenzy item symbol, the GUI to indicate a first frenzy item symbol prize associated with that qualifying first frenzy item symbol.

6. The electronic gaming system of claim 1, wherein the one or more memory devices further store additional computer-executable instructions for further controlling the one or more processors to cause, during at least the first time period and responsive to visual indicators for all of the frenzy items in the featured set of frenzy items being displayed in the GUI, a new set of frenzy items to be obtained for use as the featured set of frenzy items and the GUI to reset the visual indicators displayed by the GUI such that the number of visual indicators displayed by the GUI is less than a number of frenzy items in the new set of frenzy items.

7. The electronic gaming system of claim 6, wherein the one or more memory devices further store additional computer-executable instructions for further controlling the one or more processors to reset the visual indicators displayed by the GUI such that the number of visual indicators displayed by the GUI is zero for the new set of frenzy items.

8. One or more non-transitory computer-readable media storing computer-executable instructions for controlling one or more processors to:

cause a graphical user interface (GUI) for a game of chance to be presented via one or more displays;

cause, during presentation of the game of chance and responsive to one or more first frenzy mode trigger conditions being met, the GUI to indicate that a first frenzy mode is active cause, during presentation of the game of chance and while the first frenzy mode is active, the GUI to display a first number of visual indicators responsive to each qualifying first frenzy item symbol displayed during presentation of the game of chance while the first frenzy mode is active, each visual indicator representing a corresponding frenzy item in a featured set of frenzy items, wherein the featured set of frenzy items is obtained from a plurality of sets of frenzy items and a) each set of frenzy items in the plurality of sets of frenzy items is associated with a corresponding plurality of reel strip sets to be used in generating outcomes in the game of chance when that set of frenzy items is the featured set of frenzy items, b) each reel strip set in the plurality of reel strip sets that is associated with each set of frenzy items is associated with a corresponding reel strip set weight, and c) each reel strip has a set of symbols associated therewith;

cause, while the first frenzy mode is active and responsive to one or more second frenzy mode trigger conditions being met, the GUI to indicate that a second frenzy mode is active;

cause, during presentation of the game of chance and while the second frenzy mode is active, the GUI to display a second number of visual indicators responsive to each qualifying second frenzy item symbol displayed during presentation of the game of chance while the second frenzy mode is active;

select, using weighted random selection based on the corresponding reel strip set weight for each of the reel strip sets in the plurality of reel strip sets associated with the featured set of frenzy items, a selected reel strip set from the plurality of reel strip sets associated with the featured set of frenzy items, wherein the plurality of reel strip sets from which the selected reel strip set is selected for use while the first frenzy mode is active includes at least one reel strip set that has at least one reel strip with at least one first frenzy item symbol and the plurality of reel strip sets from which the selected reel strip set is selected while the second frenzy mode is active includes at least one reel strip set that has at least one reel strip with at least one second frenzy item symbol; and generate outcomes for the game of chance by selecting symbols from the selected reel strip set based on output of a random number generator, wherein:

the second number is larger than the first number, a first time period in which the first frenzy mode is active at least partially temporally overlaps with a second time period in which the second frenzy mode is active, and the second time period is shorter than the first time period.

9. The one or more non-transitory computer-readable media of claim 8, wherein the first number is one and the second number is two.

10. The one or more non-transitory computer-readable media of claim 8, further storing additional computer-executable instructions for controlling the one or more processors to cause, responsive to visual indicators representing all of the frenzy items in the featured set of frenzy items being displayed, the GUI to indicate a featured set prize associated with the featured set of frenzy items.

11. The one or more non-transitory computer-readable media of claim 10, further storing additional computer-executable instructions for controlling the one or more processors to:

cause the GUI to display a first graphical indicator for each frenzy item in a first subset of frenzy items in the featured set of frenzy items, wherein the number of frenzy items in the first subset is equal to the number of frenzy items in the featured set of frenzy items minus the number of visual indicators that have been displayed by the GUI for the featured set of frenzy items, and cause, responsive to determining that a selected first graphical indicator is a winning selection, the featured set prize associated with the featured set of frenzy items to be indicated by the GUI.

12. The one or more non-transitory computer-readable media of claim 8, further storing additional computer-executable instructions for controlling the one or more processors to cause, responsive to each display of a qualifying first frenzy item symbol, the GUI to indicate a first frenzy item symbol prize associated with that qualifying first frenzy item symbol.

13. The one or more non-transitory computer-readable media of claim 8, further storing additional computer-executable instructions for controlling the one or more processors to cause, during at least the first time period and responsive to visual indicators for all of the frenzy items in the featured set of frenzy items being displayed in the GUI, a new set of frenzy items to be obtained for use as the featured set of frenzy items and the GUI to reset the visual indicators displayed by the GUI such that the number of visual indicators displayed by the GUI is less than a number of frenzy items in the new set of frenzy items.

14. The one or more non-transitory computer-readable media of claim 13, further storing additional computer-executable instructions for controlling the one or more processors to reset the visual indicators displayed by the GUI such that the number of visual indicators displayed by the GUI is zero for the new set of frenzy items.

15. A method, provided using one or more processors, comprising:

causing a graphical user interface (GUI) for a game of chance to be presented via one or more displays;

causing, during presentation of the game of chance and responsive to one or more first frenzy mode trigger conditions being met, the GUI to indicate that a first frenzy mode is active;

causing, during presentation of the game of chance and while the first frenzy mode is active, the GUI to display a first number of visual indicators responsive to each qualifying first frenzy item symbol displayed during presentation of the game of chance while the first frenzy mode is active, each visual indicator representing a corresponding frenzy item in a featured set of frenzy items, wherein the featured set of frenzy items is obtained from a plurality of sets of frenzy items and a) each set of frenzy items in the plurality of sets of frenzy items is associated with a corresponding plurality of reel strip sets to be used in generating outcomes in the game of chance when that set of frenzy items is the featured set of frenzy items, b) each reel strip set in the plurality of reel strip sets that is associated with each set of frenzy items is associated with a corresponding reel strip set weight, and c) each reel strip has a set of symbols associated therewith;

causing, while the first frenzy mode is active and responsive to one or more second frenzy mode trigger conditions being met, the GUI to indicate that a second frenzy mode is active;

causing, during presentation of the game of chance and while the second frenzy mode is active, the GUI to display a second number of visual indicators responsive to each qualifying second frenzy item symbol displayed during presentation of the game of chance while the second frenzy mode is active;

selecting, using weighted random selection based on the corresponding reel strip set weight for each of the reel strip sets in the plurality of reel strip sets associated with the featured set of frenzy items, a selected reel strip set from the plurality of reel strip sets associated with the featured set of frenzy items, wherein the plurality of reel strip sets from which the selected reel strip set is selected for use while the first frenzy mode is active includes at least one reel strip set that has at least one reel strip with at least one first frenzy item symbol and the plurality of reel strip sets from which the selected reel strip set is selected while the second frenzy mode is active includes at least one reel strip set that has at least one reel strip with at least one second frenzy item symbol; and generating outcomes for the game of chance by selecting symbols from the selected reel strip set based on output of a random number generator, wherein:

the second number is larger than the first number, a first time period in which the first frenzy mode is active at least partially temporally overlaps with a second time period in which the second frenzy mode is active, and the second time period is shorter than the first time period.

16. The method of claim 15, wherein the first number is one and the second number is two.

17. The method of claim 15, further comprising causing, responsive to visual indicators representing all of the frenzy items in the featured set of frenzy items being displayed, the GUI to indicated a featured set prize associated with the featured set of frenzy items.

18. The method of claim 17, further comprising:

causing the GUI to display a first graphical indicator for each frenzy item in a first subset of frenzy items in the featured set of frenzy items, wherein the number of frenzy items in the first subset is equal to the number of frenzy items in the featured set of frenzy items minus the number of visual indicators that have been displayed by the GUI for the featured set of frenzy items, and causing, responsive to determining that a selected first graphical indicator is a winning selection, the featured set prize associated with the featured set of frenzy items to be indicated by the GUI.

19. The method of claim 15, further comprising causing, responsive to each display of a qualifying first frenzy item symbol, the GUI to indicate a first frenzy item symbol prize associated with that qualifying first frenzy item symbol.

20. The method of claim 15, further comprising causing, during at least the first time period and responsive to visual indicators for all of the frenzy items in the featured set of frenzy items being displayed in the GUI, a new set of frenzy items to be obtained for use as the featured set of frenzy items and the GUI to reset the visual indicators displayed by the GUI such that the number of visual indicators displayed by the GUI is less than a number of frenzy items in the new set of frenzy items.

* * * * *